US012038017B2

(12) United States Patent
Hayashi et al.

(10) Patent No.: US 12,038,017 B2
(45) Date of Patent: Jul. 16, 2024

(54) CENTRIFUGAL AIR-SENDING DEVICE, AIR-SENDING APPARATUS, AIR-CONDITIONING APPARATUS, AND REFRIGERATION CYCLE APPARATUS

(71) Applicant: Mitsubishi Electric Corporation, Tokyo (JP)

(72) Inventors: Hiroyasu Hayashi, Tokyo (JP); Takuya Teramoto, Tokyo (JP); Kazuya Michikami, Tokyo (JP); Ryo Horie, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 875 days.

(21) Appl. No.: 17/255,826

(22) PCT Filed: Aug. 31, 2018

(86) PCT No.: PCT/JP2018/032363
§ 371 (c)(1),
(2) Date: Dec. 23, 2020

(87) PCT Pub. No.: WO2020/044540
PCT Pub. Date: Mar. 5, 2020

(65) Prior Publication Data

US 2021/0148377 A1 May 20, 2021

(51) Int. Cl.
*F04D 29/42* (2006.01)
*F04D 29/28* (2006.01)
*F25D 17/06* (2006.01)

(52) U.S. Cl.
CPC ..... *F04D 29/4206* (2013.01); *F04D 29/281* (2013.01); *F25D 17/067* (2013.01)

(58) Field of Classification Search
CPC ... F04D 29/4206; F04D 29/281; F25D 17/067
(Continued)

(56) References Cited

U.S. PATENT DOCUMENTS 4,252,502 A 2/1981 Scheidel
6,574,967 B1 * 6/2003 Park ..... F25B 21/02 62/428

(Continued)

FOREIGN PATENT DOCUMENTS

DE 8808417 U1 10/1989
EP 3333431 A1 6/2018

(Continued)

OTHER PUBLICATIONS

Office Action dated Sep. 9, 2021, issued in corresponding IN Patent Application No. 202127002898 (and English Machine Translation).

(Continued)

*Primary Examiner* — Raheena R Malik
(74) *Attorney, Agent, or Firm* — Posz Law Group, PLC

(57) ABSTRACT

In a centrifugal air-sending device, a first area portion has a first vertex that is an intersection point of a curve line formed by a tongue portion and a bisector of a first connection straight line connecting a winding start portion and an end of a discharge portion. A second area portion has a second vertex that is an intersection point of the curve line formed by the tongue portion and a bisector of a second connection straight line connecting the winding start portion and the end of the discharge portion. When a virtual straight line connecting a rotational axis and the first vertex is defined as a first straight line, and a virtual straight line connecting the rotational axis and the second vertex is defined as a second straight line, the second straight line is longer than the first straight line.

19 Claims, 17 Drawing Sheets

(58) Field of Classification Search
USPC ..... 62/428
See application file for complete search history.

(56) References Cited

U.S. PATENT DOCUMENTS

| | | | | |
|---|---|---|---|---|
| 10,655,640 | B1 * | 5/2020 | Dickinson | F04D 17/162 |
| 11,274,678 | B2 * | 3/2022 | Teramoto | F04D 29/4226 |
| 11,592,032 | B2 * | 2/2023 | Teramoto | F04D 29/4226 |
| 2004/0253099 | A1 | 12/2004 | Hancock | |
| 2021/0140445 | A1 * | 5/2021 | Teramoto | F04D 29/424 |
| 2021/0199125 | A1 * | 7/2021 | Teramoto | F04D 29/5826 |
| 2023/0151821 | A1 * | 5/2023 | Teramoto | F04D 29/441 415/204 |

FOREIGN PATENT DOCUMENTS

| | | | | |
|---|---|---|---|---|
| JP | S54089510 | U | | 12/1979 |
| JP | 855023432 | U | | 8/1980 |
| JP | S64087900 | A | | 3/1989 |
| JP | H05038395 | U | | 5/1993 |
| JP | H08-001198 | B | | 1/1996 |
| JP | 2000234600 | A | | 8/2000 |
| JP | 2007146817 | A | | 6/2007 |
| JP | 2009287427 | A | * | 12/2009 |
| JP | 2009287427 | A | | 12/2009 |

OTHER PUBLICATIONS

Office Action dated May 6, 2022 issued in corresponding CN Patent Application No. 201880096395.6 (and Machine Translation).
Office Action dated Jul. 24, 2023 issued in corresponding European patent application No. 18931455.2.
Office Action dated Jun. 15, 2021, issued in corresponding JP Patent Application No. 2020-539988 (and English Machine Translation).
International Search Report of the International Searching Authority mailed Nov. 27, 2018 for the corresponding International application No. PCT/JP2018/032363 (and English translation).
Office Action issued May 4, 2020 in corresponding TW patent application No. 10920413680 (with English translation).
Extended European Search Report dated Jul. 30, 2021 issued in corresponding European patent application No. 18931455.2.
Examination Report dated Feb. 23, 2022 issued in connection with AU patent application No. 2018439003.

* cited by examiner

CENTRIFUGAL AIR-SENDING DEVICE, AIR-SENDING APPARATUS, AIR-CONDITIONING APPARATUS, AND REFRIGERATION CYCLE APPARATUS

CROSS REFERENCE TO RELATED APPLICATION

This application is a U.S. national stage application of PCT/JP2018/032363 filed on Aug. 31, 2018, the contents of which are incorporated herein by reference.

TECHNICAL FIELD

The present disclosure relates to a centrifugal air-sending device including a scroll casing, and to an air-sending apparatus, an air-conditioning apparatus, and a refrigeration cycle apparatus including the centrifugal air-sending device.

BACKGROUND ART

Some centrifugal air-sending device includes a centrifugal fan including a main plate having a disk shape and many blades in a scroll casing, and a tongue portion that is a narrowed portion necessary to achieve such a condition that air flowing into the centrifugal fan through a suction port at the end of the centrifugal fan in its rotational axis direction is blown in a centrifugal direction of the centrifugal fan and the pressure of the air is increased. For example, the shape of the tongue portion in a range from the main plate to the suction port is a straight shape when the tongue portion is viewed from a discharge port of the centrifugal air-sending device. In the centrifugal air-sending device, the air flow entering the scroll casing through the suction port and traveling toward the discharge port may partially re-enter the scroll at the tongue portion used as a branch point. The re-entry of the air flow is the cause of a decrease in air-sending performance and an increase in noise level. In view of this phenomenon, a centrifugal air-sending device has been proposed that has a shape in which parts of a tongue portion of a casing in a rotational direction of an air-sending fan are shifted gradually in the rotational direction in a range from a suction port to a main plate of the centrifugal fan (see, for example, Patent Literature 1). With this structure and the tongue portion of the centrifugal air-sending device of Patent Literature 1, the amount of re-entry of an air flow that is traveling toward the discharge port may be reduced. Thus, the air-sending performance may be improved and turbulent noise may be reduced.

CITATION LIST

Patent Literature

Patent Literature 1: Japanese Unexamined Patent Application Publication No. 2007-146817

SUMMARY OF INVENTION

Technical Problem

In the centrifugal air-sending device of Patent Literature 1, however, the tongue portion extends in a direction opposite to the rotational direction with a constant clearance kept between the tongue portion and blades in a range from the main plate to a side plate having the suction port. Therefore, in the centrifugal air-sending device of Patent Literature 1, the pressure in the scroll casing locally fluctuates in the vicinity of the tongue portion at the parts close to the main plate and the suction port, which are different in terms of the amounts of an air flow traveling toward the discharge port and an air flow re-entering the scroll. Thus, the noise level may increase.

The present disclosure has been made to solve the problem described above and provides a centrifugal air-sending device in which noise is reduced, and an air-sending apparatus, an air-conditioning apparatus, and a refrigeration cycle apparatus including the centrifugal air-sending device.

Solution to Problem

A centrifugal air-sending device according to an embodiment of the present disclosure includes an impeller including a main plate having a disk shape and a plurality of blades arranged on a peripheral edge of the main plate, and a scroll casing housing the impeller. The scroll casing includes a discharge portion including a discharge port through which an air flow produced by the impeller is discharged, and a scroll portion including at least one side wall covering the impeller in a direction perpendicular to an axial direction of a rotational axis of the impeller and including a suction port through which air is suctioned, a peripheral wall surrounding the impeller in a direction parallel to the axial direction of the rotational axis, and a tongue portion forming a curve surface, positioned between an end of the discharge portion and a winding start portion of the peripheral wall, and configured to introduce the air flow produced by the impeller to the discharge port. The tongue portion includes a first area portion facing the main plate in the direction parallel to the axial direction of the rotational axis, and a second area portion positioned closer to the at least one side wall than is the first area portion. In a section perpendicular to the rotational axis, where the first area portion has a first vertex that is an intersection point of a curve line formed by the tongue portion and a bisector of a first connection straight line connecting the winding start portion and the end of the discharge portion, the second area portion has a second vertex that is an intersection point of the curve line formed by the tongue portion and a bisector of a second connection straight line connecting the winding start portion and the end of the discharge portion, a virtual straight line connecting the rotational axis and the first vertex is defined as a first straight line, and a virtual straight line connecting the rotational axis and the second vertex is defined as a second straight line, the second straight line is longer than the first straight line.

Advantageous Effects of Invention

In the centrifugal air-sending device according to an embodiment of the present disclosure, the tongue portion includes the first area portion facing the main plate in the direction parallel to the axial direction of the rotational axis, and the second area portion positioned closer to the side wall than is the first area portion. In the section perpendicular to the rotational axis, the first area portion has the first vertex, which is the intersection point of the curve line formed by the tongue portion and the bisector of the first connection straight line connecting the winding start portion and the end of the discharge portion. The second area portion has the second vertex, which is the intersection point of the curve line formed by the tongue portion and the bisector of the second connection straight line connecting the winding start portion and the end of the discharge portion. When the virtual straight line connecting the rotational axis and the first vertex is defined as the first straight line and the virtual straight line connecting the rotational axis and the second vertex is defined as the second straight line, the second straight line is longer than the first straight line. With this structure of the tongue portion, a stagnation point of air flows at the tongue portion can be shifted depending on an air flow around the main plate and an air flow around the suction port, which are different in terms of their flow directions. As a result, it is possible to control, in the centrifugal air-sending device, the amount of the air flow that re-enters the scroll portion with the stagnation point of air flows as a border. Along with this, local pressure fluctuation can be suppressed. Thus, noise can be reduced.

DESCRIPTION OF EMBODIMENTS

Figure 1:
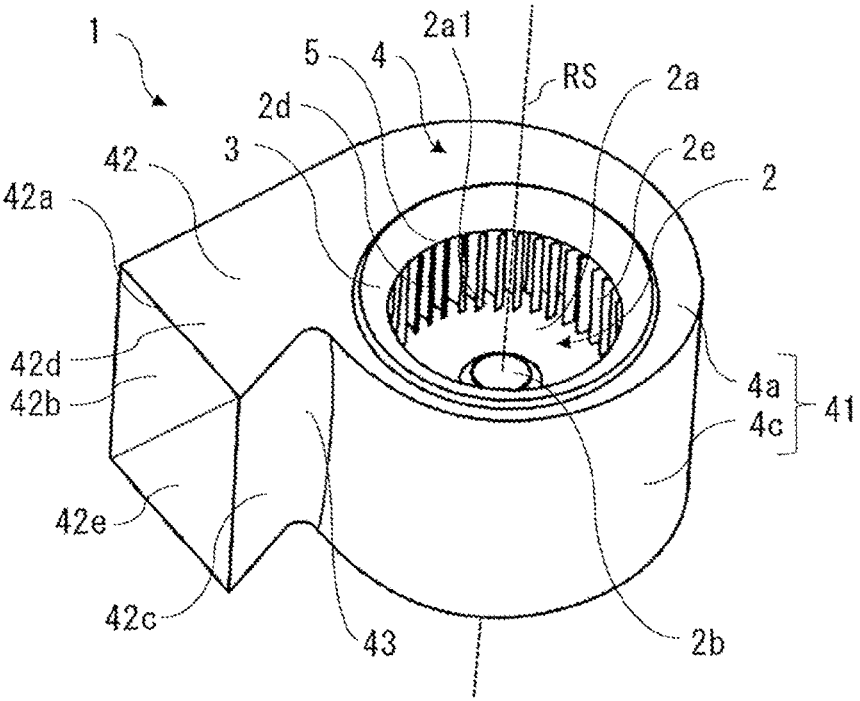
FIG. 1 is a perspective view of a centrifugal air-sending device according to Embodiment 1 of the present disclosure.

A centrifugal air-sending device 1, a centrifugal air-sending device 1A, a centrifugal air-sending device 1B, a centrifugal air-sending device 1C, an air-sending apparatus 30, an air-conditioning apparatus 40, and a refrigeration cycle apparatus 50 according to Embodiments 1 to 7 of the present disclosure are described below with reference to the drawings. In the drawings including FIG. 1 to which reference is made below, the relative relationship of dimensions of component elements and the shapes of component elements may differ from an actual relationship and actual shapes. In the drawings to which reference is made below, elements represented by the same reference signs are identical or corresponding elements and are common throughout the description herein. Terms of directions (for example, "up", "down", "right", "left", "front", and "rear") are used as appropriate for facilitating understanding. These terms are used only for convenience of the description but do not limit dispositions and directions of devices or components.

Embodiment 1

[Centrifugal Air-sending Device 1]

Figure 2:
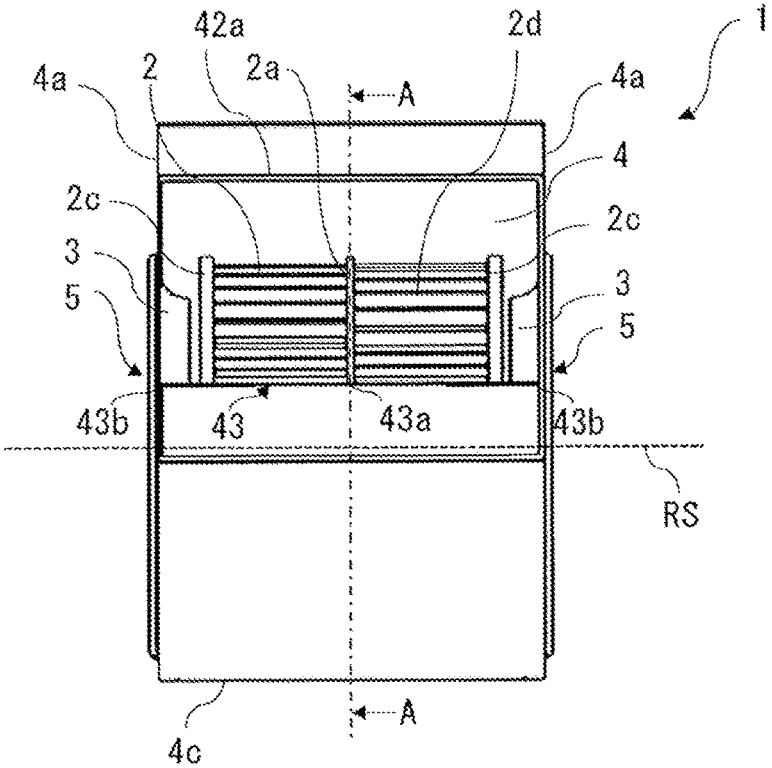
FIG. 2 is a side view of the centrifugal air-sending device of FIG. 1 that is viewed from a discharge port.
Figure 3:
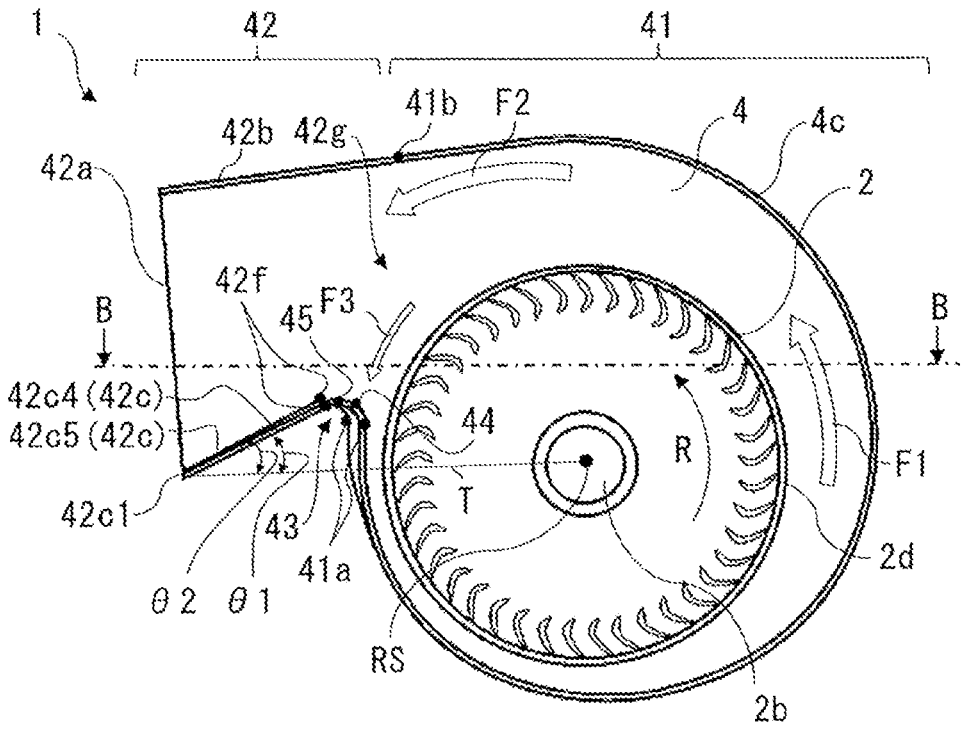
FIG. 3 is a sectional view of the centrifugal air-sending device that is cut along a line A-A in FIG. 2.
Figure 4:
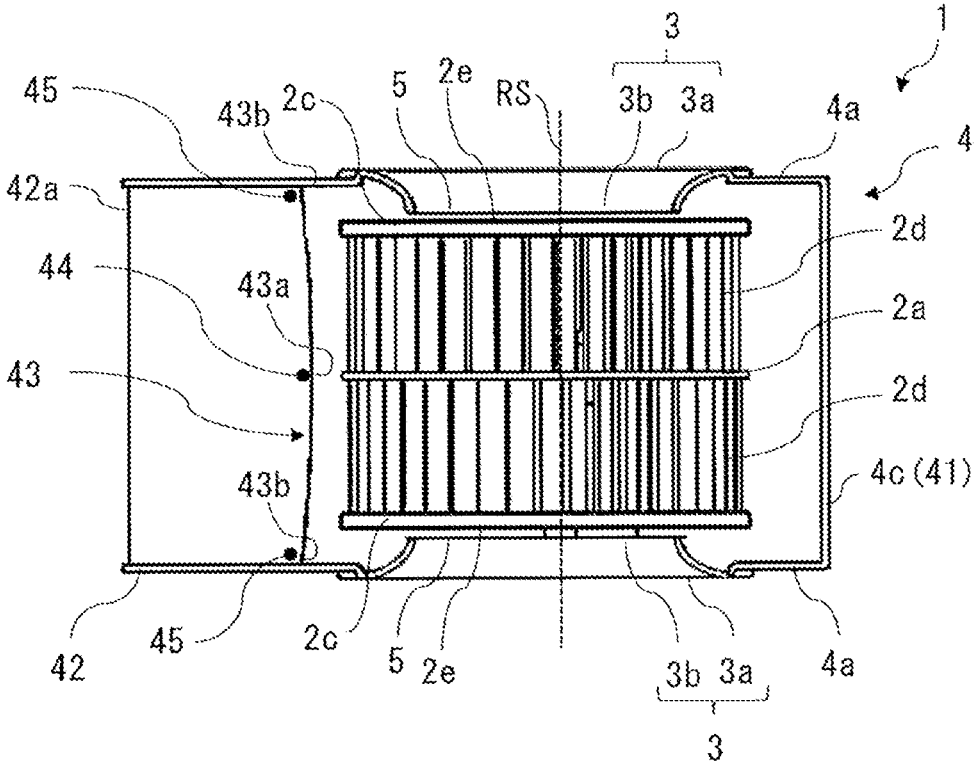
FIG. 4 is a horizontal sectional view of the centrifugal air-sending device of FIG. 1 at a part of a line B-B on the centrifugal air-sending device of FIG. 3.

FIG. 1 is a perspective view of the centrifugal air-sending device 1 according to Embodiment 1 of the present disclosure. FIG. 2 is a side view of the centrifugal air-sending device 1 of FIG. 1 that is viewed from a discharge port 42*a*. FIG. 3 is a sectional view of the centrifugal air-sending device 1 that is cut along a line A-A in FIG. 2. FIG. 4 is a horizontal sectional view of the centrifugal air-sending device 1 of FIG. 1 at a part of a line B-B on the centrifugal air-sending device 1 of FIG. 3. The basic structure of the centrifugal air-sending device 1 is described with reference to FIG. 1 to FIG. 4. The centrifugal air-sending device 1 is a multi-blade centrifugal air-sending device 1 including an impeller 2 configured to produce an air flow, and a scroll casing 4 housing the impeller 2.

(Impeller 2)

The impeller 2 is driven to rotate by a motor or other devices (not illustrated) and forcibly sends air radially outward by a centrifugal force produced through the rotation. As illustrated in FIG. 1 and FIG. 2, the impeller 2 includes a main plate 2*a* having a disk shape, and a plurality of blades 2*d* arranged on a peripheral edge 2*a*1 of the main plate 2*a*. A shaft 2*b* is provided at the center of the main plate 2*a*. A fan motor (not illustrated) is connected to the center of the shaft 2*b*. The impeller 2 is rotated by a drive force of the motor. As illustrated in FIG. 2 and FIG. 4, the impeller 2 has ring-shaped side plates 2*c* each facing the main plate 2*a* and positioned at respective sets of the ends of the plurality of blades 2*d* opposite to sets of the ends close to the main plate 2*a* in an axial direction of a rotational axis RS of the shaft 2*b*. Each side plate 2*c* couples the plurality of blades 2*d* to keep a positional relationship among the distal ends of the blades 2*d* and reinforce the plurality of blades 2*d*. The impeller 2 may have a structure without the side plate 2*c*. If the impeller 2 has the side plate 2*c*, one end of each of the plurality of blades 2*d* is connected to the main plate 2*a* and the other end of each of the plurality of blades 2*d* is connected to the side plate 2*c*. Thus, the plurality of blades 2*d* are disposed between the main plate 2*a* and the side plate 2*c*. The impeller 2 is formed into a cylindrical shape by the main plate 2*a* and the plurality of blades 2*d* and has a suction port 2*e* close to each of the side plates 2*c* opposite to the main plate 2*a* in the axial direction of the rotational axis RS of the shaft 2*b*.

The plurality of blades 2*d* are disposed in a circular form around the shaft 2*b* and the proximal ends are fixed onto the surface of the main plate 2*a*. As illustrated in FIG. 2 and FIG. 4, pluralities of blades 2*d* are provided on both sides of the main plate 2*a* in the axial direction of the rotational axis RS of the shaft 2*b*. The blades 2*d* are disposed along the peripheral edge 2*a*1 of the main plate 2*a* at constant intervals. For example, each blade 2*d* has a curved rectangular plate shape and is disposed along a radial direction or inclined at a predetermined angle from the radial direction.

The impeller 2 structured and rotated as described above can send air suctioned into a space surrounded by the main plate 2*a* and the plurality of blades 2*d* radially outward through spaces between adjacent blades 2*d*. In Embodiment 1, each blade 2*d* is provided substantially upright from the main plate 2*a* but the posture is not particularly limited to this posture. Each blade 2*d* may be inclined from a direction perpendicular to the main plate 2*a*.

(Scroll Casing 4)

The scroll casing 4 surrounds the impeller 2 and regulates a flow of air blown from the impeller 2. The scroll casing 4 includes a discharge portion 42 and a scroll portion 41. The discharge portion 42 has the discharge port 42*a* through which an air flow produced by the impeller 2 and passing through the scroll portion 41 is discharged. The scroll portion 41 has an air passage through which a dynamic pressure of the air flow produced by the impeller 2 is converted into a static pressure. The scroll portion 41 includes side walls 4*a* covering the impeller 2 in the axial direction of the rotational axis RS of the shaft 2*b* of the impeller 2, and each having a suction port 5 through which air is suctioned, and a peripheral wall 4*c* surrounding the impeller 2 in a radial direction of the rotational axis RS of the shaft 2*b*. The scroll portion 41 further includes a tongue portion 43 forming a curve surface, positioned between a winding start portion 41*a* of the peripheral wall 4*c* and a connection portion 42*f*, which is an end of the discharge portion 42 closer to the peripheral wall 4*c* than is the opposite end, and configured to introduce the air flow produced by the impeller 2 and passing through the scroll portion 41 to the discharge port 42*a*. The radial direction of the shaft 2*b* is a direction perpendicular to the shaft 2*b*. An internal space of the scroll portion 41 defined by the peripheral wall 4*c* and the side walls 4*a* is a space where the air blown from the impeller 2 flows along the peripheral wall 4*c*.

(Side Wall 4*a*)

Each side wall 4*a* is disposed perpendicular to the axial direction of the rotational axis RS of the impeller 2 and covers the impeller 2. The side wall 4*a* of the scroll casing 4 has the suction port 5 through which air can flow between the impeller 2 and the outside of the scroll casing 4. Further, the side wall 4*a* is provided with a bell mouth 3 configured to guide an air flow to be suctioned into the scroll casing 4 through the suction port 5. The bell mouth 3 is formed in a part where the bell mouth 3 faces the suction port 2*e* of the impeller 2. The bell mouth 3 has an annular shape in which an air passage is narrowed from an upstream end 3*a*, which is an end located upstream in the air flow to be suctioned into the scroll casing 4 through the suction port 5, toward a downstream end 3*b*, which is an end located downstream in the air flow. The suction port 5 has a circular shape and is disposed such that the center of the suction port 5 and the center of the shaft 2*b* of the impeller 2 substantially coincide with each other. With this structure of the side wall 4*a*, air in the vicinity of the suction port 5 smoothly flows and efficiently enters the impeller 2 from the suction port 5. As illustrated in FIG. 1 to FIG. 4, the centrifugal air-sending device 1 includes a double-suction scroll casing 4 including the side walls 4*a* each having the suction port 5 on both sides of the main plate 2*a* in the axial direction of the rotational axis RS of the shaft 2*b*. That is, the scroll casing 4 of the centrifugal air-sending device 1 has two side walls 4*a* and the side walls 4*a* are disposed to face each other.

(Peripheral Wall 4*c*)

The peripheral wall 4*c* surrounds the impeller 2 in the radial direction of the shaft 2*b* and has an inner peripheral surface facing the plurality of blades 2*d* on the outer periphery of the impeller 2 in the radial direction. The peripheral wall 4*c* is disposed in parallel to the axial direction of the rotational axis RS of the impeller 2 and covers the impeller 2. As illustrated in FIG. 3, the peripheral wall 4*c* is provided in a part ranging from the winding start portion 41*a* positioned at a boundary between the tongue portion 43 and the scroll portion 41 to a winding end portion 41*b* positioned at a boundary between the discharge portion 42 and the scroll portion 41 located away from the tongue portion 43 along a rotational direction of the impeller 2. In the peripheral wall 4*c* having a curve surface, the winding start portion 41*a* is an end located upstream in an air flow produced by rotation of the impeller 2, and the winding end portion 41*b* is an end located downstream in the air flow produced by the rotation of the impeller 2.

The peripheral wall 4*c* is wide in the axial direction of the rotational axis RS of the impeller 2. As illustrated in FIG. 3, the peripheral wall 4*c* has a spiral shape defined by a predetermined expansion rate at which a distance from the rotational axis RS of the shaft 2*b* gradually increases in the rotational direction of the impeller 2 (arrow R direction). That is, a distance between the peripheral wall 4*c* and the outer periphery of the impeller 2 increases at a predetermined rate from the tongue portion 43 to the discharge portion 42 and the air passage area gradually increases. Examples of the spiral shape defined by the predetermined expansion rate include spiral shapes based on a logarithmic spiral, an Archimedean spiral, and an involute curve. The inner peripheral surface of the peripheral wall 4*c* is a curve surface that is smoothly curved along a circumferential direction of the impeller 2 from the winding start portion 41*a*, which is a start of the spiral shape, to the winding end portion 41*b*, which is an end of the spiral shape. With this structure, air sent out from the impeller 2 smoothly flows along a space between the impeller 2 and the peripheral wall 4*c* in a direction of an arrow F1 in FIG. 3. Therefore, the static pressure of air from the tongue portion 43 toward the discharge portion 42 efficiently increases in the scroll casing 4.

(Discharge Portion 42)

The discharge portion 42 is a hollow pipe having a rectangular section orthogonal to the direction in which air flows along the peripheral wall 4*c*. As illustrated in FIG. 3 and FIG. 4, the discharge portion 42 has a passage through which air sent out from the impeller 2 and flowing along the space between the peripheral wall 4*c* and the impeller 2 is guided such that the air is discharged into outside air. One end of the discharge portion 42 is fixed to the scroll casing 4 to form an inflow port 42*g* through which air flows into the discharge portion 42 from the scroll casing 4. The other end of the discharge portion 42 forms the discharge port 42*a* through which air flowing through the passage in the discharge portion 42 is discharged into the outside air. An arrow F2 in FIG. 3 represents an air flow from the scroll casing 4 toward the discharge port 42*a* of the discharge portion 42.

As illustrated in FIG. 1, the discharge portion 42 includes an extension plate 42*b*, a diffuser plate 42*c*, a first side plate 42*d*, and a second side plate 42*e*. The extension plate 42*b* is integrated with the scroll casing 4 by extending smoothly to the winding end portion 41*b*, which is the downstream end of the peripheral wall 4*c*. The diffuser plate 42*c* extends to the tongue portion 43 of the scroll casing 4, faces the extension plate 42*b*, and is positioned at a predetermined angle from the extension plate 42*b* such that the sectional area of the passage gradually increases along the air flow direction in the discharge portion 42. That is, the diffuser plate 42*c* extends from the tongue portion 43 of the scroll casing 4 radially outward in the rotational direction of the impeller 2 (arrow R direction). As illustrated in FIG. 3, the diffuser plate 42*c* includes a first diffuser portion 42*c*4 extending to a first area portion 43*a* described later, and a second diffuser portion 42*c*5 extending to a second area portion 43*b* described later. The first side plate 42*d* extends to the side wall 4*a* of the scroll casing 4. The second side plate 42*e* extends to the opposite side wall 4*a* of the scroll casing 4. The first side plate 42*d* and the second side plate 42*e* facing each other are connected by the extension plate 42*b* and the diffuser plate 42*c*. Thus, the discharge portion 42 has a passage having a rectangular section by the extension plate 42*b*, the diffuser plate 42*c*, the first side plate 42*d*, and the second side plate 42*e*.

(Tongue Portion 43)

The scroll casing 4 has the tongue portion 43 between the diffuser plate 42*c* of the discharge portion 42 and the winding start portion 41*a* of the peripheral wall 4*c*. The tongue portion 43 introduces an air flow produced by the impeller 2 and passing through the scroll portion 41 to the discharge port 42*a*. The tongue portion 43 is a projection provided at a boundary between the scroll portion 41 and the discharge portion 42. In the scroll casing 4, the tongue portion 43 extends in a direction parallel to the axial direction of the rotational axis RS of the shaft 2*b*.

As illustrated in FIG. 3, the tongue portion 43 is bent to project toward the passage at the inflow port 42*g* of the discharge portion 42. The tongue portion 43 has a predetermined curvature radius and the peripheral wall 4*c* is smoothly connected to the diffuser plate 42*c* via the tongue portion 43. When air passing through the suction ports 5 and sent out from the impeller 2 is gathered by the scroll casing 4 and flows into the discharge portion 42, the tongue portion 43 is of use as a branch point in the passage. That is, the inflow port 42*g* of the discharge portion 42 has a passage of an air flow toward the discharge port 42*a* (arrow F2) and a passage of an air flow that re-enters the upstream portion from the tongue portion 43 (arrow F3). The air flow traveling toward the discharge portion 42 has a static pressure increasing while the air flow is passing through the scroll casing 4. Therefore, the pressure is higher than the pressure in the scroll casing 4. The tongue portion 43 is thus configured to define the pressure difference, and is configured to introduce the air traveling toward the discharge portion 42 to the individual passages by the curve surface.

Figure 5:
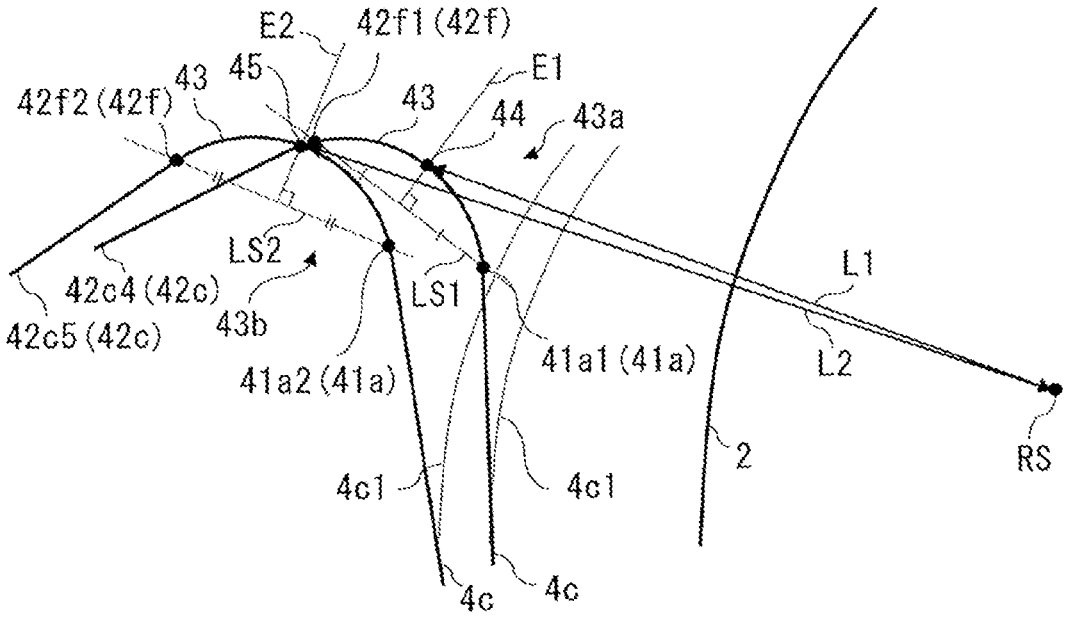
FIG. 5 is a conceptual diagram illustrating a relationship between a tongue portion and a rotational axis of an impeller in the centrifugal air-sending device of FIG. 1.

FIG. 5 is a conceptual diagram illustrating a relationship between the tongue portion 43 and the rotational axis RS of the impeller 2 in the centrifugal air-sending device 1 of FIG. 1. The structure of the tongue portion 43 is further described with reference to FIG. 2 to FIG. 5. The tongue portion 43 includes the first area portion 43*a* facing the main plate 2*a* in the direction parallel to the axial direction of the rotational axis RS of the impeller 2, and the second area portions 43*b* positioned closer to the respective side walls 4*a* than is the first area portion 43*a*. When the tongue portion 43 is viewed from the discharge port 42*a* as illustrated in FIG. 2, the tongue portion 43 has a straight shape parallel to the rotational axis RS of the shaft 2*b*. That is, the tongue portion 43 is formed such that the first area portion 43*a* facing the main plate 2*a* and the second area portions 43*b* connected to the respective side walls 4*a* each having the suction port 5 are disposed on the same straight line when the tongue portion 43 is viewed from the discharge port 42*a*. The first area portion 43*a* is a part of the tongue portion 43 facing the main plate 2*a* of the impeller 2 and positioned at the center of the tongue portion 43 in the direction parallel to the axial direction of the rotational axis RS of the shaft 2*b*. The second area portion 43*b* is a part of the tongue portion 43 extending to each of the side walls 4*a* each having the suction port 5 and positioned at each end of the tongue portion 43 in the direction parallel to the axial direction of the rotational axis RS of the shaft 2*b*. The first area portion 43*a* is a part of the tongue portion 43 positioned closer to the main plate 2*a* than are the second area portions 43*b*. Each of the second area portions 43*b* is a part of the tongue portion 43 positioned closer to the corresponding suction port 5 than is the first area portion 43*a*. The second area portion 43*b* may include not only the part of the tongue portion 43 extending to the side wall 4*a* having the suction port 5 but also a part of the tongue portion 43 positioned closer to the side wall 4*a* than to the main plate 2*a* in the direction parallel to the axial direction of the rotational axis RS of the shaft 2*b*.

When the tongue portion 43 is viewed in a direction from the extension plate 42*b* to the diffuser plate 42*c* as illustrated in FIG. 4, the tongue portion 43 is curved such that the first area portion 43*a* is positioned closer to the rotational axis RS of the impeller 2 than are the second area portions 43*b*. In other words, when the tongue portion 43 is viewed in the direction from the extension plate 42*b* to the diffuser plate 42*c* as illustrated in FIG. 4, the tongue portion 43 is curved such that the second area portions 43*b* are positioned farther away from the rotational axis RS of the impeller 2 than is the first area portion 43*a*. That is, the tongue portion 43 has a smooth U-shape such that the tongue portion 43 is positioned gradually away from the impeller 2 and close to the discharge port 42*a* with increasing distance from the first area portion 43*a* to each of the second area portions 43*b*. As illustrated in FIG. 3 and FIG. 4, a part of the peripheral wall 4*c* extending to the tongue portion 43 has a shape conforming to the shape of the tongue portion 43. That is, the peripheral wall 4*c* is curved such that the part of the peripheral wall 4*c* is positioned gradually close to the rotational axis RS of the impeller 2 with increasing distance from each of the side walls 4*a* to the main plate 2*a*. That is, the scroll casing 4 is formed such that the center of the tongue portion 43 and the center of the part of the peripheral wall 4*c* extending to the tongue portion 43 in the axial direction of the rotational axis RS of the impeller 2 are gently recessed inward of the scroll casing 4. Thus, the peripheral wall 4*c* is curved in a shape conforming to the shape of the tongue portion 43.

The structure of the tongue portion 43 is described in more detail with reference to FIG. 3 and FIG. 5. As described above, the tongue portion 43 is positioned between the peripheral wall 4*c* and the diffuser plate 42*c*. The winding start portion 41*a* is positioned at a boundary between the tongue portion 43 and the peripheral wall 4*c* of the scroll portion 41. As illustrated in FIG. 3, in a section perpendicular to the rotational axis RS of the shaft 2*b*, the winding start portion 41*a* is an inflection point between a curve line of the tongue portion 43 and a curve line of the peripheral wall 4*c*. In FIG. 5, a central winding start portion 41*a*1 is a winding start portion 41*a* at the first area portion 43*a*. A terminal winding start portion 41*a*2 is a winding start portion 41*a* at the second area portion 43*b*. As described above, the peripheral wall 4*c* has the spiral shape in the section perpendicular to the rotational axis RS of the impeller 2. As illustrated in FIG. 5, in the section perpendicular to the rotational axis RS of the shaft 2*b*, the winding start portion 41*a* is positioned closer to the discharge port 42*a* than is a virtual spiral curve 4*c*1 obtained by extending a curve of the spiral shape in a direction opposite to the air flow direction.

The connection portion 42*f* is positioned at a boundary between the tongue portion 43 and the diffuser plate 42*c* of the discharge portion 42. When the diffuser plate 42*c* is a plate having a curve surface, the connection portion 42*f* is an inflection point between the curve line of the tongue portion 43 and a curve line of the diffuser plate 42*c* in the section perpendicular to the rotational axis RS of the shaft 2*b*. When the diffuser plate 42*c* is a flat plate, as illustrated in FIG. 3, the connection portion 42*f*, which is the end of the discharge portion 42 closer to the peripheral wall 4*c* than is the opposite end, is a boundary between a straight line of the diffuser plate 42*c* and the curve line of the tongue portion 43 in the section perpendicular to the rotational axis RS of the shaft 2*b*. In FIG. 5, a central connection portion 42*f*1 is a connection portion 42*f* at the first area portion 43*a*. A terminal connection portion 42*f*2 is a connection portion 42*f* at the second area portion 43*b*. As illustrated in FIG. 5, the central connection portion 42*f*1 and the terminal connection portion 42*f*2 are disposed at different positions in the section perpendicular to the rotational axis RS of the shaft 2*b*. As illustrated in FIG. 3, the connection portion 42*f* positioned at the boundary between the tongue portion 43 and the diffuser plate 42*c* is an end of the tongue portion 43 and also an end of the diffuser plate 42*c*. In the section perpendicular to the rotational axis RS of the shaft 2*b*, the first diffuser portion 42*c*4 having the central connection portion 42*f*1 as its end and the second diffuser portion 42*c*5 having the terminal connection portion 42*f*2 as its end have different discharge port angles. More specifically, in the section perpendicular to the rotational axis RS of the shaft 2*b*, a virtual straight line connecting the rotational axis RS of the shaft 2*b* and a discharge port end 42*c*1 of the diffuser plate 42*c* included in the discharge port 42*a* is defined as a reference straight line T. An angle between the first diffuser portion 42*c*4 and the reference straight line T is defined as a first discharge port angle θ1. An angle between the second diffuser portion 42*c*5 and the reference straight line T is defined as a second discharge port angle θ2. In the centrifugal air-sending device 1, the second discharge port angle θ2 of the second diffuser portion 42*c*5 is larger than the first discharge port angle θ1 of the first diffuser portion 42*c*4.

As illustrated in FIG. 5, the tongue portion 43 has a first vertex 44 and a second vertex 45 in the section perpendicular to the rotational axis RS of the impeller 2. The first vertex 44 is a vertex of the tongue portion 43 at the first area portion 43*a*. In the section perpendicular to the rotational axis RS of the impeller 2, the first vertex 44 is an intersection point of the curve line formed by the tongue portion 43 and a bisector E1 of a first connection straight line LS1 connecting the central winding start portion 41*a*1 and the central connection portion 42*f*1. The first connection straight line LS1 and the bisector E1 intersect at a right angle in the section perpendicular to the rotational axis RS of the shaft 2*b*. The second vertex 45 is a vertex of the tongue portion 43 at the second area portion 43*b*. In the section perpendicular to the rotational axis RS of the impeller 2, the second vertex 45 is an intersection point of the curve line formed by the tongue portion 43 and a bisector E2 of a second connection straight line LS2 connecting the terminal winding start portion 41*a*2 and the terminal connection portion 42*f*2. The second connection straight line LS2 and the bisector E2 intersect at a right angle in the section perpendicular to the rotational axis RS of the shaft 2*b*.

A virtual straight line connecting the rotational axis RS of the impeller 2 and the first vertex 44 is defined as a first straight line L1. A virtual straight line connecting the rotational axis RS of the impeller 2 and the second vertex 45 is defined as a second straight line L2. In the centrifugal air-sending device 1, the first straight line L1 connecting the first vertex 44 and the rotational axis RS is shorter than the second straight line L2 connecting the second vertex 45 and the rotational axis RS in the section perpendicular to the rotational axis RS of the shaft 2*b*. In other words, in the centrifugal air-sending device 1, the second straight line L2 connecting the second vertex 45 and the rotational axis RS is longer than the first straight line L1 connecting the first vertex 44 and the rotational axis RS in the section perpendicular to the rotational axis RS of the shaft 2*b*. Therefore, the second vertex 45 of the second area portion 43*b* is positioned farther away from the rotational axis RS than is the first vertex 44 of the first area portion 43*a*. Thus, in the section perpendicular to the rotational axis RS of the shaft 2*b*, the space between the impeller 2 and the tongue portion 43 is wider in the second area portion 43*b* than in the first area portion 43*a*. As illustrated in FIG. 3, in the centrifugal air-sending device 1, the second vertex 45 is positioned closer to the discharge port end 42*c*1 than is the first vertex 44 on a line between the rotational axis RS and the discharge port end 42*c*1 on the reference straight line T. Thus, in the section perpendicular to the rotational axis RS of the shaft 2*b*, the space between the impeller 2 and the tongue portion 43 is wider in the second area portion 43*b* than in the first area portion 43*a*.

Figure 6:
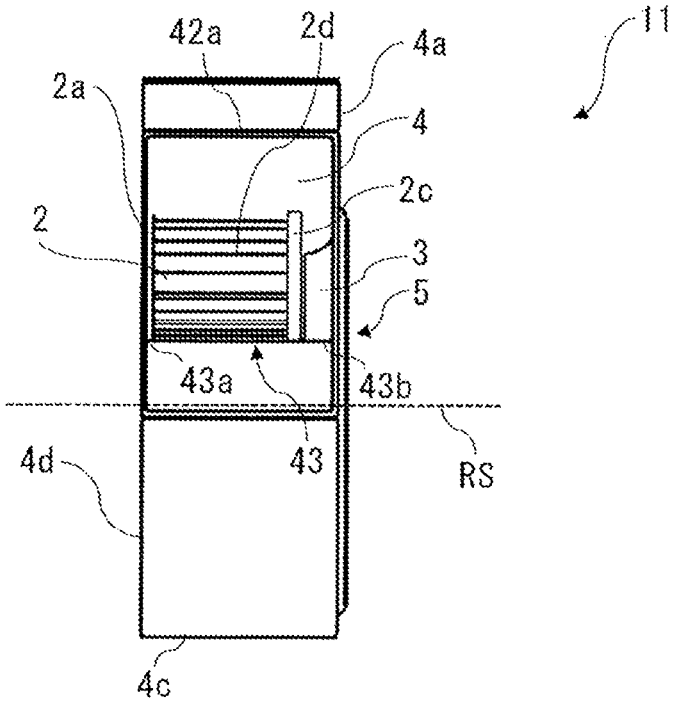
FIG. 6 is a side view of a modified example of the centrifugal air-sending device according to Embodiment 1 of the present disclosure that is viewed from the discharge port.
Figure 7:
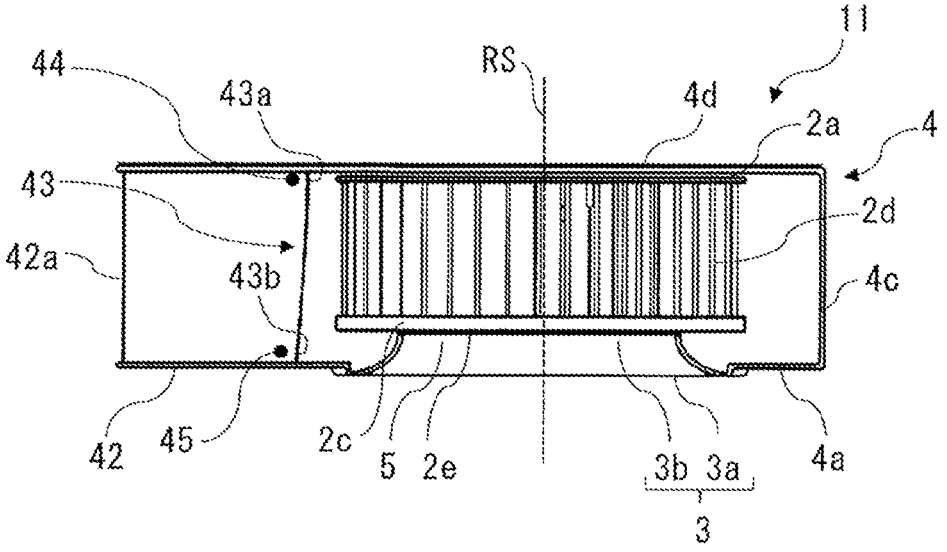
FIG. 7 is a horizontal sectional view of the centrifugal air-sending device of FIG. 6 at the part of the line B-B in FIG. 3.
Figure 8:
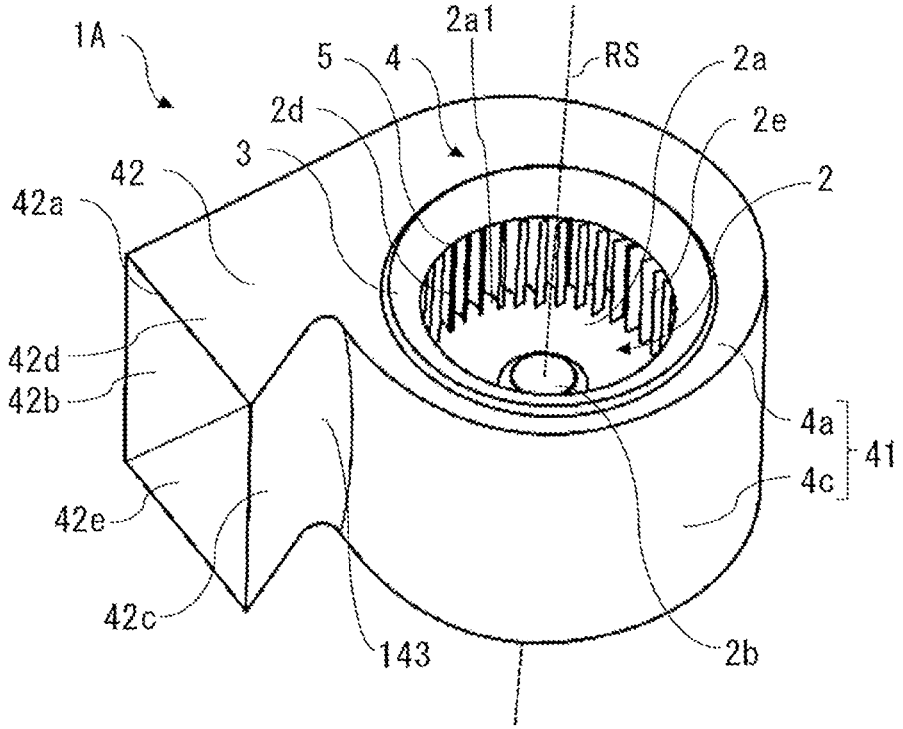
FIG. 8 is a perspective view of a centrifugal air-sending device according to Embodiment 2 of the present disclosure.

FIG. 6 is a side view of a modified example of the centrifugal air-sending device 1 according to Embodiment 1 of the present disclosure that is viewed from the discharge port 42*a*. FIG. 7 is a horizontal sectional view of a centrifugal air-sending device 11 of FIG. 6 at the part of the line B-B in FIG. 3. Although the double-suction centrifugal air-sending device 1 is described with reference to FIG. 1 to FIG. 5, the centrifugal air-sending device 1 is not limited to the double-suction centrifugal air-sending device 1 but may be a single-suction centrifugal air-sending device 11. Thus, the centrifugal air-sending device 11 is only required to have at least one side wall 4*a* having the suction port 5. The scroll portion 41 of the centrifugal air-sending device 11 includes the side wall 4*a* covering the impeller 2 in the axial direction of the rotational axis RS of the shaft 2*b* of the impeller 2, and having the suction port 5 through which air is suctioned, and the peripheral wall 4*c* surrounding the impeller 2 in the radial direction of the rotational axis RS of the shaft 2*b*. The scroll portion 41 of the single-suction centrifugal air-sending device 11 further includes a side wall 4*d* perpendicular to the axial direction of the rotational axis RS. The side wall 4*d* has no suction port 5. The side wall 4*d* and the side wall 4*a* face each other. As illustrated in FIG. 6 and FIG. 8, the plurality of blades 2*d* of the centrifugal air-sending device 11 are provided on one side of the main plate 2*a* in the axial direction of the rotational axis RS of the shaft 2*b*.

The tongue portion 43 of the centrifugal air-sending device 11 includes the first area portion 43*a* facing the main plate 2*a* in the direction parallel to the axial direction of the rotational axis RS of the impeller 2, and the second area portion 43*b* positioned closer to the side wall 4*a* than is the first area portion 43*a*. When the tongue portion 43 is viewed from the discharge port 42*a* as illustrated in FIG. 6, the tongue portion 43 has a straight shape parallel to the rotational axis RS of the shaft 2*b*. That is, the tongue portion 43 is formed such that the first area portion 43*a* facing the main plate 2*a* and the second area portion 43*b* connected to the side wall 4*a* having the suction port 5 are disposed on the same straight line when the tongue portion 43 is viewed from the discharge port 42*a*. The first area portion 43*a* is a part of the tongue portion 43 facing the main plate 2*a* of the impeller 2 and positioned close to one end of the tongue portion 43 in the direction parallel to the axial direction of the rotational axis RS of the shaft 2*b*. The second area portion 43*b* is a part of the tongue portion 43 extending to the side wall 4*a* having the suction port 5 and positioned close to the other end of the tongue portion 43 in the direction parallel to the axial direction of the rotational axis RS of the shaft 2*b*. The first area portion 43*a* is a part of the tongue portion 43 positioned closer to the main plate 2*a* than is the second area portion 43*b*. The second area portion 43*b* is a part of the tongue portion 43 positioned closer to the suction port 5 than is the first area portion 43*a*. The second area portion 43*b* may include not only the part of the tongue portion 43 extending to the side wall 4*a* having the suction port 5 but also a part of the tongue portion 43 positioned closer to the side wall 4*a* than to the main plate 2*a* in the direction parallel to the axial direction of the rotational axis RS of the shaft 2*b*.

When the tongue portion 43 is viewed in a direction from the extension plate 42*b* to the diffuser plate 42*c* as illustrated in FIG. 7, the tongue portion 43 is curved such that the first area portion 43*a* is positioned closer to the rotational axis RS of the impeller 2 than is the second area portion 43*b*. In other words, when the tongue portion 43 is viewed in the direction from the extension plate 42*b* to the diffuser plate 42*c*, the tongue portion 43 is curved such that the second area portion 43*b* is positioned farther away from the rotational axis RS of the impeller 2 than is the first area portion 43*a*. That is, the tongue portion 43 is smoothly curved such that the tongue portion 43 is positioned gradually away from the impeller 2 and close to the discharge port 42*a* with increasing distance from the first area portion 43*a* to the second area portion 43*b*. Further, a part of the peripheral wall 4*c* extending to the tongue portion 43 has a shape conforming to the shape of the tongue portion 43. That is, the peripheral wall 4*c* is curved such that the part of the peripheral wall 4*c* is positioned gradually close to the rotational axis RS of the impeller 2 with increasing distance from the side wall 4*a* to the main plate 2*a*. That is, the scroll casing 4 is formed such that the part of the tongue portion 43 positioned closer to the side wall 4*d* and the part of the peripheral wall 4*c* extending to the tongue portion 43 and positioned closer to the side wall 4*d* in the axial direction of the rotational axis RS of the impeller 2 are gently recessed inward of the scroll casing 4. Thus, the peripheral wall 4*c* is curved in a shape conforming to the shape of the tongue portion 43.

[Operation of Centrifugal Air-Sending Device 1]

When the impeller 2 rotates, air outside the scroll casing 4 is suctioned into the scroll casing 4 through the suction ports 5. The air suctioned into the scroll casing 4 is guided by the bell mouths 3 and suctioned into the impeller 2. The air suctioned into the impeller 2 causes an air flow to which a dynamic pressure and a static pressure are applied while the air passes through the plurality of blades 2*d*. The air flow is blown radially outward from the impeller 2. While the air flow blown from the impeller 2 is guided between the inner surface of the peripheral wall 4*c* and the blades 2*d* in the scroll portion 41, the dynamic pressure is converted into a static pressure. After the air flow blown from the impeller 2 passes through the scroll portion 41, the air flow is blown out of the scroll casing 4 from the discharge port 42*a* of the discharge portion 42 (arrow F2). The air flow blown from the impeller 2 concentrates at the main plate 2*a*. Apart of the air flow blown from the main plate 2*a* impinges on the inner surface of the peripheral wall 4*c* of the scroll portion 41 and flows toward the suction ports 5 along the peripheral wall 4*c* of the scroll portion 41. The air flow around the main plate 2*a* and the air flow having flowed toward the suction ports 5 are different in terms of their flow directions. After the air flows are guided between the inner surface of the peripheral wall 4*c* and the blades 2*d* in the scroll portion 41 and pass through the scroll portion 41, a part of the air flows re-enters the scroll portion 41 with the tongue portion 43 as a border (arrow F3).

[Advantageous Effects of Centrifugal Air-Sending Device 1]

As described above, the tongue portion 43 of the centrifugal air-sending device 1 includes the first area portion 43*a* facing the main plate 2*a* in the direction parallel to the axial direction of the rotational axis RS, and the second area portions 43*b* positioned closer to the respective side walls 4*a* than is the first area portion 43*a*. The first area portion 43*a* has the first vertex 44 in the section perpendicular to the rotational axis RS. The first vertex 44 is the intersection point of the curve line formed by the tongue portion 43 and the bisector E1 of the first connection straight line LS1 connecting the winding start portion 41*a* and the connection portion 42*f*, which is the end of the discharge portion 42. The second area portion 43*b* has the second vertex 45, which is the intersection point of the curve line formed by the tongue portion 43 and the bisector E2 of the second connection straight line LS2 connecting the winding start portion 41*a* and the connection portion 42*f*, which is the end of the discharge portion 42 closer to the peripheral wall 4*c* than is the opposite end. When the virtual straight line connecting the rotational axis RS and the first vertex 44 is defined as the first straight line L1 and the virtual straight line connecting the rotational axis RS and the second vertex 45 is defined as the second straight line L2, the second straight line L2 is longer than the first straight line L1. With this structure of the tongue portion 43, a stagnation point of air flows at the tongue portion 43 can be shifted depending on the air flow around the main plate 2*a* and the air flow around the suction ports 5 that are different in terms of their flow directions. As a result, it is possible to control, in the centrifugal air-sending device 1, the amount of the air flow that re-enters the scroll portion 41 with the stagnation point of air flows as the border. Along with this, local pressure fluctuation can be suppressed. Thus, noise can be reduced.

The winding start portion 41*a* is positioned closer to the discharge port 42*a* than is the virtual spiral curve 4*c*1 obtained by extending the curve of the spiral shape in the direction opposite to the air flow direction. With this structure of the centrifugal air-sending device 1, the stagnation point of air flows at the tongue portion 43 can be shifted depending on the air flow around the main plate 2*a* and the air flow around the suction ports 5 that are different in terms of their flow directions. As a result, it is possible to control, in the centrifugal air-sending device 1, the amount of the air flow that re-enters the scroll portion 41 with the stagnation point of air flows as the border. Along with this, the local pressure fluctuation can be suppressed. Thus, noise can be reduced.

In the centrifugal air-sending device 1, in the section perpendicular to the rotational axis RS, the virtual straight line connecting the rotational axis RS and the discharge port end 42*c*1 of the diffuser plate 42*c* included in the discharge port 42*a* is defined as the reference straight line T. The angle between the first diffuser portion 42*c*4 and the reference straight line T is defined as the first discharge port angle θ1. The angle between the second diffuser portion 42*c*5 and the reference straight line T is defined as the second discharge port angle θ2. In this case, the second discharge port angle θ2 is larger than the first discharge port angle θ1. With this structure of the centrifugal air-sending device 1, the stagnation point of air flows at the tongue portion 43 can be shifted depending on the air flow around the main plate 2*a* and the air flow around the suction ports 5 that are different in terms of their flow directions. As a result, it is possible to control, in the centrifugal air-sending device 1, the amount of the air flow that re-enters the scroll portion 41 with the stagnation point of air flows as the border. Along with this, the local pressure fluctuation can be suppressed. Thus, noise can be reduced.

In the tongue portion 43, the second vertex 45 is positioned closer to the discharge port end 42*c*1 than is the first vertex 44 on the line between the rotational axis RS and the discharge port end 42*c*1 on the reference straight line T. With this structure of the centrifugal air-sending device 1, the stagnation point of air flows at the tongue portion 43 can be shifted depending on the air flow around the main plate 2*a* and the air flow around the suction ports 5 that are different in terms of their flow directions. As a result, it is possible to control, in the centrifugal air-sending device 1, the amount of the air flow that re-enters the scroll portion 41 with the stagnation point of air flows as the border. Along with this, the local pressure fluctuation can be suppressed. Thus, noise can be reduced.

The tongue portion 43 is curved such that the second area portions 43*b* are positioned farther away from the rotational axis RS than is the first area portion 43*a*. With this structure of the centrifugal air-sending device 1, the stagnation point of air flows at the tongue portion 43 can be shifted depending on the air flow around the main plate 2*a* and the air flow around the suction ports 5 that are different in terms of their flow directions. As a result, it is possible to control, in the centrifugal air-sending device 1, the amount of the air flow that re-enters the scroll portion 41 with the stagnation point of air flows as the border. Along with this, the local pressure fluctuation can be suppressed. Thus, noise can be reduced.

The peripheral wall 4*c* is curved in a shape conforming to the shape of the tongue portion 43. With the structure of the tongue portion 43 of the centrifugal air-sending device 1, the stagnation point of air flows at the tongue portion 43 can be shifted depending on the air flow around the main plate 2*a* and the air flow around the suction ports 5 that are different in terms of their flow directions. As the peripheral wall 4*c* is curved in the shape conforming to the shape of the tongue portion 43, the air flows can be introduced smoothly. As a result, it is possible to control, in the centrifugal air-sending device 1, the amount of the air flow that re-enters the scroll portion 41 with the stagnation point of air flows as the border. Along with this, the local pressure fluctuation can be suppressed. Thus, noise can be reduced.

Embodiment 2

Figure 9:
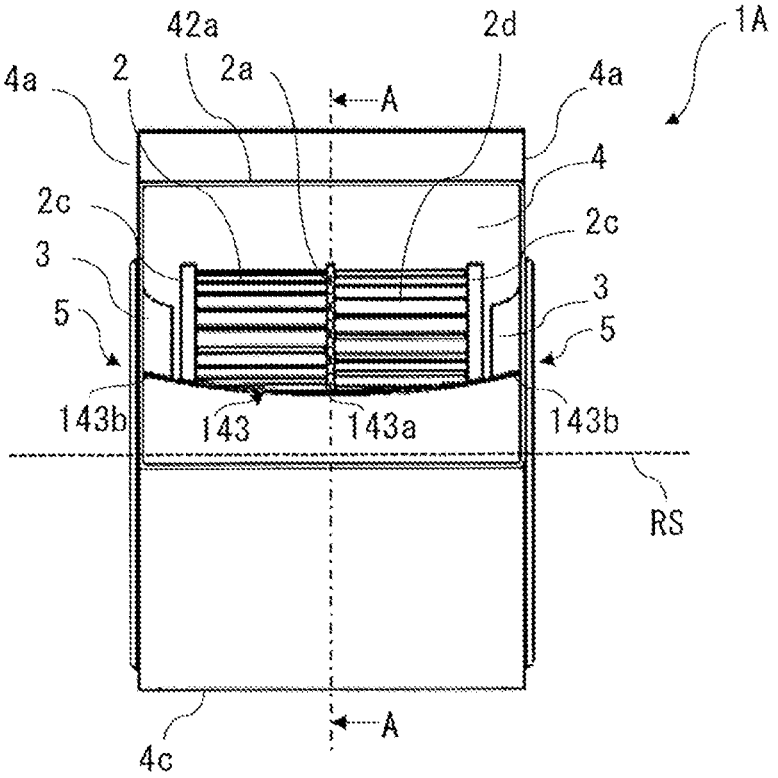
FIG. 9 is a side view of the centrifugal air-sending device of FIG. 8 that is viewed from the discharge port.
Figure 10:
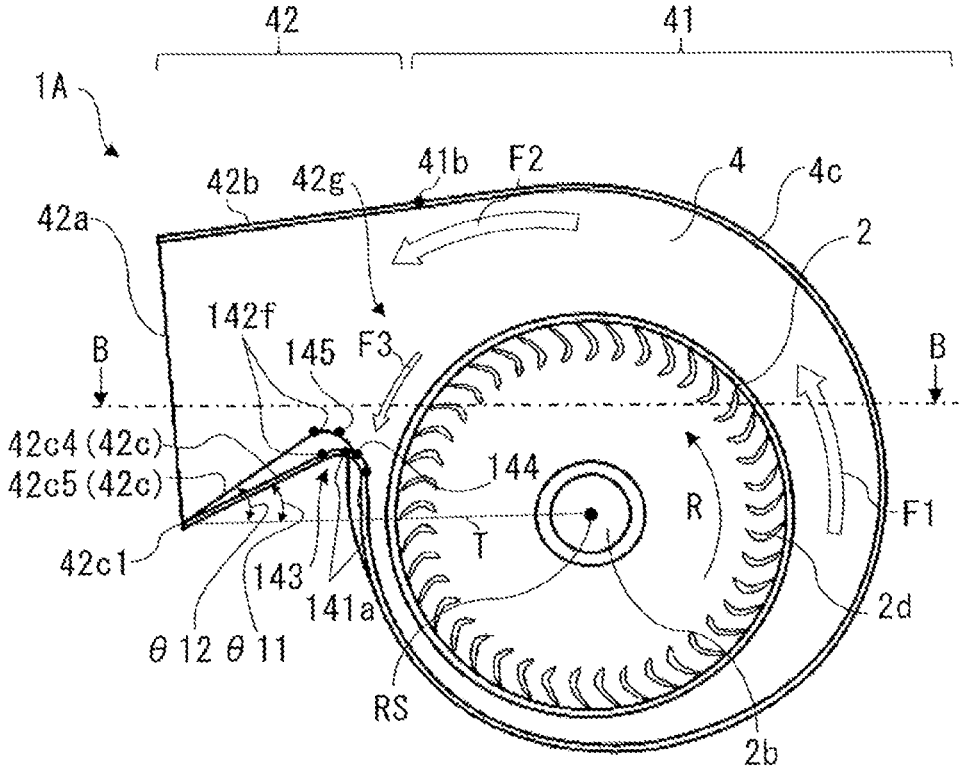
FIG. 10 is a sectional view of the centrifugal air-sending device that is cut along a line A-A in FIG. 9.
Figure 11:
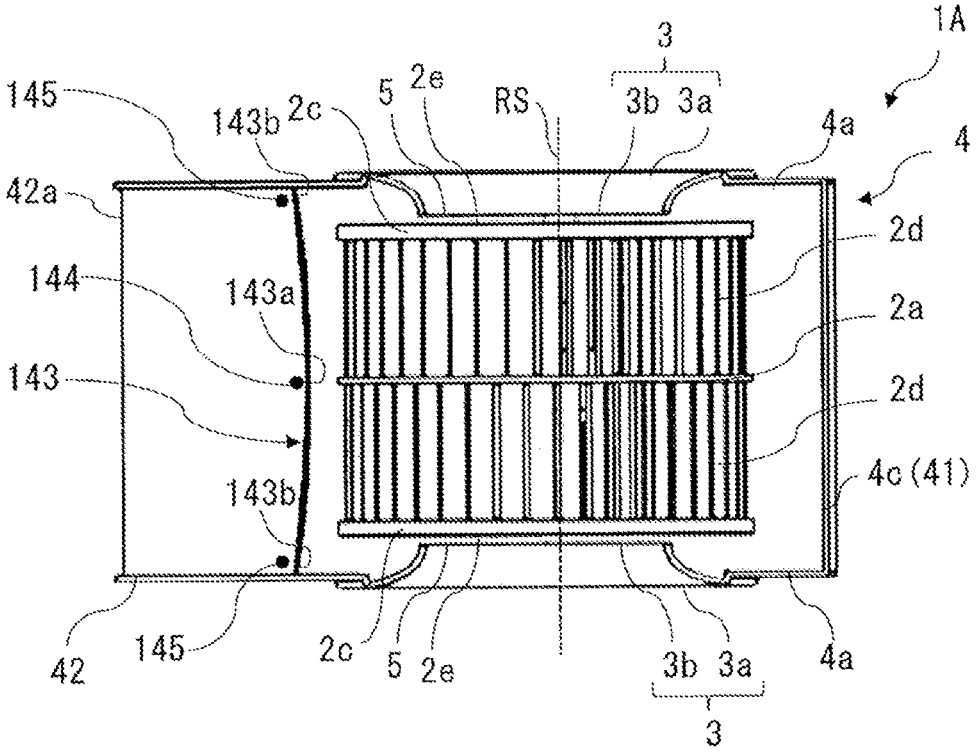
FIG. 11 is a horizontal sectional view of the centrifugal air-sending device of FIG. 8 at a part of a line B-B on the centrifugal air-sending device of FIG. 10.
Figure 12:
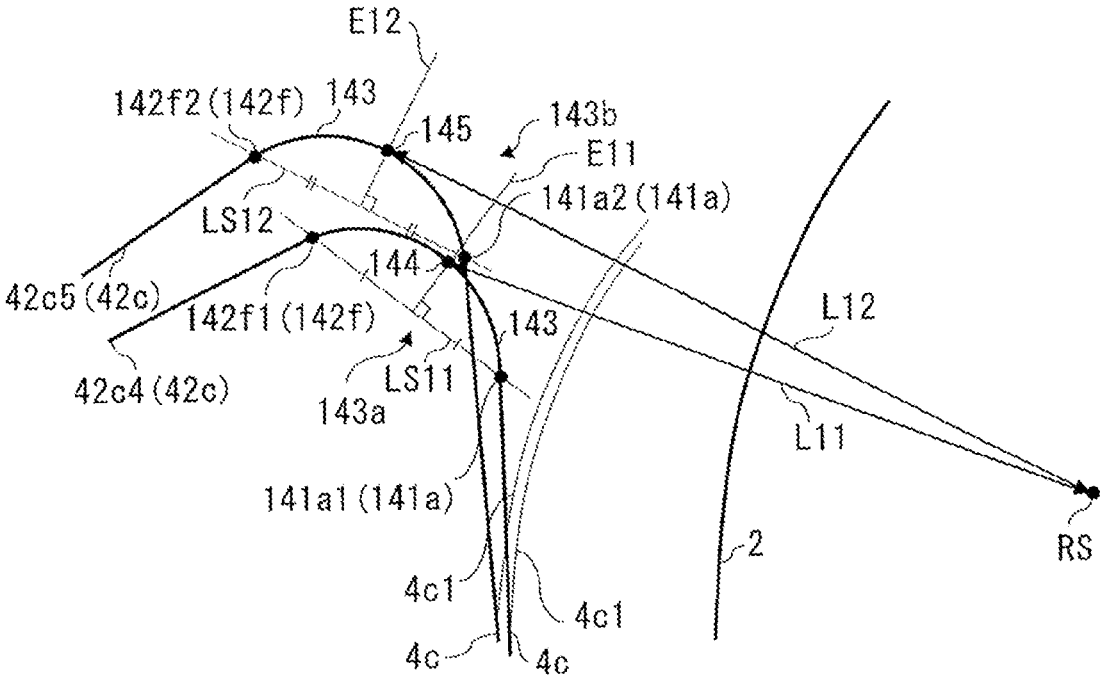
FIG. 12 is a conceptual diagram illustrating a relationship between a tongue portion and the rotational axis of the impeller in the centrifugal air-sending device of FIG. 8.

FIG. 8 is a perspective view of a centrifugal air-sending device 1A according to Embodiment 2 of the present disclosure. FIG. 9 is a side view of the centrifugal air-sending device 1A of FIG. 8 that is viewed from the discharge port 42*a*. FIG. 10 is a sectional view of the centrifugal air-sending device 1A that is cut along a line A-A in FIG. 9. FIG. 11 is a horizontal sectional view of the centrifugal air-sending device 1A of FIG. 8 at a part of a line B-B on the centrifugal air-sending device 1A of FIG. 10. FIG. 12 is a conceptual diagram illustrating a relationship between a tongue portion 143 and the rotational axis RS of the impeller 2 in the centrifugal air-sending device 1A of FIG. 8. Portions having the same structures as those of the centrifugal air-sending device 1 of FIG. 1 to FIG. 5 are represented by the same reference signs and description of the portions is omitted. The centrifugal air-sending device 1A according to Embodiment 2 is different from the centrifugal air-sending device 1 according to Embodiment 1 in terms of the structure of the tongue portion 43. The structures of portions other than the tongue portion 43 are similar to the structures in the centrifugal air-sending device 1 according to Embodiment 1. Thus, the following description is mainly directed to the structure of the tongue portion 143 of the centrifugal air-sending device 1A according to Embodiment 2 with reference to FIG. 8 to FIG. 12.

(Tongue Portion 143)

The scroll casing 4 has the tongue portion 143 between the diffuser plate 42*c* of the discharge portion 42 and a winding start portion 141*a* of the peripheral wall 4*c*. The tongue portion 143 introduces an air flow produced by the impeller 2 and passing through the scroll portion 41 to the discharge port 42*a*. The tongue portion 143 is a projection provided at the boundary between the scroll portion 41 and the discharge portion 42. In the scroll casing 4, the tongue portion 143 extends in the direction parallel to the axial direction of the rotational axis RS of the shaft 2*b*.

As illustrated in FIG. 10, the tongue portion 143 is bent to project toward the passage at the inflow port 42*g* of the discharge portion 42. The tongue portion 143 has a predetermined curvature radius and the peripheral wall 4*c* is smoothly connected to the diffuser plate 42*c* via the tongue portion 143. When air passing through the suction ports 5 and sent out from the impeller 2 is gathered by the scroll casing 4 and flows into the discharge portion 42, the tongue portion 143 is of use as a branch point in the passage. That is, the inflow port 42*g* of the discharge portion 42 has a passage of an air flow toward the discharge port 42*a* (arrow F2) and a passage of an air flow that re-enters the upstream portion from the tongue portion 143 (arrow F3). The air flow traveling toward the discharge portion 42 has a static pressure increasing while the air flow is passing through the scroll casing 4. Therefore, the pressure is higher than the pressure in the scroll casing 4. The tongue portion 143 is thus configured to define the pressure difference, and is configured to introduce the air traveling toward the discharge portion 42 to the individual passages by the curve surface.

The structure of the tongue portion 143 is further described with reference to FIG. 9 to FIG. 12. The tongue portion 143 includes a first area portion 143*a* facing the main plate 2*a* in the direction parallel to the axial direction of the rotational axis RS of the impeller 2, and second area portions 143*b* positioned closer to the respective side walls 4*a* than is the first area portion 143*a*. When the tongue portion 143 is viewed from the discharge port 42*a* as illustrated in FIG. 9, the tongue portion 143 is curved in a U-shape such that the first area portion 143*a* is positioned close to the rotational axis RS of the shaft 2*b*. That is, in the centrifugal air-sending device 1A, when the tongue portion 143 is viewed from the discharge port 42*a*, the first area portion 143*a* facing the main plate 2*a* is positioned closer to the rotational axis RS of the shaft 2*b* than is the second area portions 143*b* connected to the respective side walls 4*a* each having the suction port 5. The tongue portion 143 is formed such that the first area portion 143*a* facing the main plate 2*a* and the second area portions 143*b* connected to the respective side walls 4*a* each having the suction port 5 are disposed on the same curve line when the tongue portion 143 is viewed from the discharge port 42*a*. The first area portion 143*a* is a part of the tongue portion 143 facing the main plate 2*a* of the impeller 2 and positioned at the center of the tongue portion 143 in the direction parallel to the axial direction of the rotational axis RS of the shaft 2*b*. The second area portion 143*b* is a part of the tongue portion 143 extending to each of the side walls 4*a* each having the suction port 5 and positioned at each end of the tongue portion 143 in the direction parallel to the axial direction of the rotational axis RS of the shaft 2*b*. The first area portion 143*a* is a part of the tongue portion 143 positioned closer to the main plate 2*a* than are the second area portions 143*b*. Each of the second area portions 143*b* is a part of the tongue portion 143 positioned closer to the corresponding suction port 5 than is the first area portion 143*a*. The second area portion 143*b* may include not only the part of the tongue portion 143 extending to the side wall 4*a* having the suction port 5 but also a part of the tongue portion 143 positioned closer to the side wall 4*a* than to the main plate 2*a* in the direction parallel to the axial direction of the rotational axis RS of the shaft 2*b*.

When the tongue portion 143 is viewed in a direction from the extension plate 42*b* to the diffuser plate 42*c* as illustrated in FIG. 11, the tongue portion 143 is curved such that the first area portion 143*a* is positioned closer to the rotational axis RS of the impeller 2 than are the second area portions 143*b*. In other words, when the tongue portion 143 is viewed in the direction from the extension plate 42*b* to the diffuser plate 42*c* as illustrated in FIG. 11, the tongue portion 143 is curved such that the second area portions 143*b* are positioned farther away from the rotational axis RS of the impeller 2 than is the first area portion 143*a*. That is, the tongue portion 143 has a smooth U-shape such that the tongue portion 143 is positioned gradually away from the impeller 2 and close to the discharge port 42*a* with increasing distance from the first area portion 143*a* to each of the second area portions 143*b*. As illustrated in FIG. 10 and FIG. 11, a part of the peripheral wall 4*c* extending to the tongue portion 143 has a shape conforming to the shape of the tongue portion 143. That is, the peripheral wall 4*c* is curved such that the part of the peripheral wall 4*c* is positioned gradually close to the rotational axis RS of the impeller 2 with increasing distance from each of the side walls 4*a* to the main plate 2*a*. That is, the scroll casing 4 is formed such that the center of the tongue portion 143 and the center of the part of the peripheral wall 4*c* extending to the tongue portion 143 in the axial direction of the rotational axis RS of the impeller 2 are gently recessed inward of the scroll casing 4. Thus, the peripheral wall 4*c* is curved in a shape conforming to the shape of the tongue portion 143. Compared with the centrifugal air-sending device 1 according to Embodiment 1, the centrifugal air-sending device 1A is formed such that each of the second area portions 143*b* is positioned closer to the extension plate 42*b* than is the first area portion 143*a* and bulges toward the passage at the inflow port 42*g* more than does the first area portion 143*a*.

The structure of the tongue portion 143 is described in more detail with reference to FIG. 10 and FIG. 12. The tongue portion 143 is positioned between the peripheral wall 4*c* and the diffuser plate 42*c*. The winding start portion 141*a* is positioned at a boundary between the tongue portion 143 and the peripheral wall 4*c* of the scroll portion 41. As illustrated in FIG. 10, in the section perpendicular to the rotational axis RS of the shaft 2*b*, the winding start portion 141*a* is an inflection point between a curve line of the tongue portion 143 and the curve line of the peripheral wall 4*c*. A central winding start portion 141*a*1 is a winding start portion 141*a* at the first area portion 143*a*. A terminal winding start portion 141*a*2 is a winding start portion 141*a* at the second area portion 143*b*. As described above, the peripheral wall 4*c* has the spiral shape in the section perpendicular to the rotational axis RS of the impeller 2. As illustrated in FIG. 12, in the section perpendicular to the rotational axis RS of the shaft 2*b*, the winding start portion 141*a* is positioned closer to the discharge port 42*a* than is the virtual spiral curve 4*c*1 obtained by extending the curve of the spiral shape in the direction opposite to the air flow direction.

A connection portion 142*f* is positioned at a boundary between the tongue portion 143 and the diffuser plate 42*c* of the discharge portion 42. When the diffuser plate 42*c* is a plate having a curve surface, the connection portion 142*f* is an inflection point between the curve line of the tongue portion 143 and the curve line of the diffuser plate 42*c* in the section perpendicular to the rotational axis RS of the shaft 2*b*. When the diffuser plate 42*c* is a flat plate, as illustrated in FIG. 10, the connection portion 142*f*, which is the end of the discharge portion 42 closer to the peripheral wall 4*c* than is the opposite end, is a boundary between the straight line of the diffuser plate 42*c* and the curve line of the tongue portion 143 in the section perpendicular to the rotational axis RS of the shaft 2*b*. A central connection portion 142*f*1 is a connection portion 142*f* at the first area portion 143*a*. A terminal connection portion 142*f*2 is a connection portion 142*f* at the second area portion 143*b*. As illustrated in FIG. 12, the central connection portion 142*f*1 and the terminal connection portion 142*f*2 are disposed at different positions in the section perpendicular to the rotational axis RS of the shaft 2*b*. As illustrated in FIG. 10, the connection portion 142*f* positioned at the boundary between the tongue portion 143 and the diffuser plate 42*c* is an end of the tongue portion 143 and also the end of the diffuser plate 42*c*. In the section perpendicular to the rotational axis RS of the shaft 2*b*, the first diffuser portion 42*c*4 having the central connection portion 142*f*1 as its end and the second diffuser portion 42*c*5 having the terminal connection portion 142*f*2 as its end have different discharge port angles. More specifically, in the section perpendicular to the rotational axis RS of the shaft 2*b*, a virtual straight line connecting the rotational axis RS of the shaft 2*b* and the discharge port end 42*c*1 of the diffuser plate 42*c* included in the discharge port 42*a* is defined as the reference straight line T. An angle between the first diffuser portion 42*c*4 and the reference straight line T is defined as a first discharge port angle θ11. An angle between the second diffuser portion 42*c*5 and the reference straight line T is defined as a second discharge port angle θ12. In the centrifugal air-sending device 1A, the second discharge port angle θ12 of the second diffuser portion 42*c*5 is larger than the first discharge port angle θ11 of the first diffuser portion 42*c*4.

As illustrated in FIG. 12, the tongue portion 143 has a first vertex 144 and a second vertex 145. The first vertex 144 is a vertex of the tongue portion 143 at the first area portion 143*a*. In the section perpendicular to the rotational axis RS of the impeller 2, the first vertex 144 is an intersection point of the curve line formed by the tongue portion 143 and a bisector E11 of a first connection straight line LS11 connecting the central winding start portion 141*a*1 and the central connection portion 142*f*1. The first connection straight line LS11 and the bisector E11 intersect at a right angle in the section perpendicular to the rotational axis RS of the shaft 2*b*. The second vertex 145 is a vertex of the tongue portion 143 at the second area portion 143*b*. In the section perpendicular to the rotational axis RS of the impeller 2, the second vertex 145 is an intersection point of the curve line formed by the tongue portion 143 and a bisector E12 of a second connection straight line LS12 connecting the terminal winding start portion 141*a*2 and the terminal connection portion 142*f*2. The second connection straight line LS12 and the bisector E12 intersect at a right angle in the section perpendicular to the rotational axis RS of the shaft 2*b*.

A virtual straight line connecting the rotational axis RS of the impeller 2 and the first vertex 144 is defined as a first straight line L11. A virtual straight line connecting the rotational axis RS of the impeller 2 and the second vertex 145 is defined as a second straight line L12. In the centrifugal air-sending device 1A, the first straight line L11 connecting the first vertex 144 and the rotational axis RS is shorter than the second straight line L12 connecting the second vertex 145 and the rotational axis RS in the section perpendicular to the rotational axis RS of the shaft 2*b*. In other words, in the centrifugal air-sending device 1A, the second straight line L12 connecting the second vertex 145 and the rotational axis RS is longer than the first straight line L11 connecting the first vertex 144 and the rotational axis RS in the section perpendicular to the rotational axis RS of the shaft 2*b*. Therefore, the second vertex 145 of the second area portion 143*b* is positioned farther away from the rotational axis RS than is the first vertex 144 of the first area portion 143*a*. Thus, in the section perpendicular to the rotational axis RS of the shaft 2*b*, the space between the impeller 2 and the tongue portion 143 is wider in the second area portion 143*b* than in the first area portion 143*a*. As illustrated in FIG. 10, in the centrifugal air-sending device 1A, the second vertex 145 is positioned closer to the discharge port end 42*c*1 than is the first vertex 144 on the line between the rotational axis RS and the discharge port end 42*c*1 on the reference straight line T. In the tongue portion 143, the shortest distance between the second vertex 145 and the reference straight line T is longer than the shortest distance between the first vertex 144 and the reference straight line T. Thus, in the section perpendicular to the rotational axis RS of the shaft 2*b*, the space between the impeller 2 and the tongue portion 143 is wider in the second area portion 143*b* than in the first area portion 143*a*.

Figure 13:
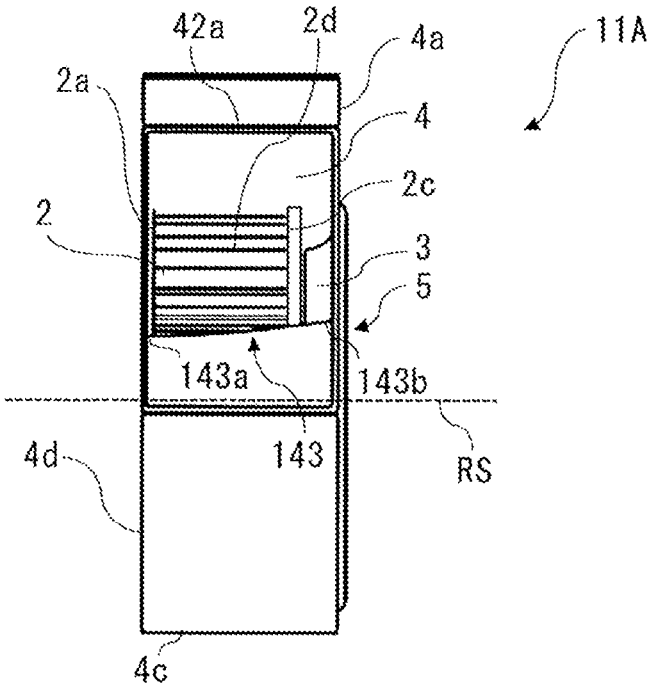
FIG. 13 is a side view of a modified example of the centrifugal air-sending device according to Embodiment 2 of the present disclosure that is viewed from the discharge port.
Figure 14:
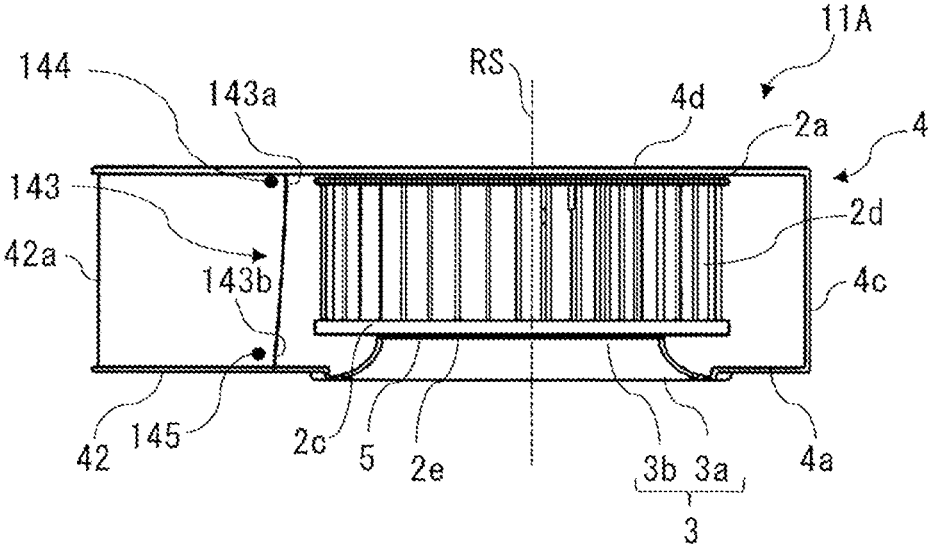
FIG. 14 is a horizontal sectional view of the centrifugal air-sending device of FIG. 13 at the part of the line B-B in FIG. 10.

FIG. 13 is a side view of a modified example of the centrifugal air-sending device 1A according to Embodiment 2 of the present disclosure that is viewed from the discharge port 42*a*. FIG. 14 is a horizontal sectional view of a centrifugal air-sending device 11A of FIG. 13 at the part of the line B-B in FIG. 10. Although the double-suction centrifugal air-sending device 1A is described with reference to FIG. 8 to FIG. 12, the centrifugal air-sending device 1A is not limited to the double-suction centrifugal air-sending device 1A but may be a single-suction centrifugal air-sending device 11A. Thus, the centrifugal air-sending device 11A is only required to have at least one side wall 4*a* having the suction port 5. The scroll portion 41 of the centrifugal air-sending device 11A includes the side wall 4*a* covering the impeller 2 in the axial direction of the rotational axis RS of the shaft 2*b* of the impeller 2, and having the suction port 5 through which air is suctioned, and the peripheral wall 4*c* surrounding the impeller 2 in the radial direction of the rotational axis RS of the shaft 2*b*. The scroll portion 41 of the single-suction centrifugal air-sending device 11A further includes the side wall 4*d* perpendicular to the axial direction of the rotational axis RS. The side wall 4*d* has no suction port 5. The side wall 4*d* and the side wall 4*a* face each other. As illustrated in FIG. 13 and FIG. 14, the plurality of blades 2*d* of the centrifugal air-sending device 11A are provided on one side of the main plate 2*a* in the axial direction of the rotational axis RS of the shaft 2*b*.

The tongue portion 143 includes the first area portion 143*a* facing the main plate 2*a* in the direction parallel to the axial direction of the rotational axis RS of the impeller 2, and the second area portion 143*b* positioned closer to the side wall 4*a* than is the first area portion 143*a*. When the tongue portion 143 is viewed from the discharge port 42*a* as illustrated in FIG. 13, the tongue portion 143 is curved such that the first area portion 143*a* is positioned close to the rotational axis RS of the shaft 2*b*. That is, in the centrifugal air-sending device 1A, when the tongue portion 143 is viewed from the discharge port 42*a*, the first area portion 143*a* facing the main plate 2*a* is positioned closer to the rotational axis RS of the shaft 2*b* than is the second area portion 143*b* connected to the side wall 4*a* having the suction port 5. The tongue portion 143 is formed such that the first area portion 143*a* facing the main plate 2*a* and the second area portion 143*b* connected to the side wall 4*a* having the suction port 5 are disposed on the same curve line when the tongue portion 143 is viewed from the discharge port 42*a*. The first area portion 143*a* is a part of the tongue portion 143 facing the main plate 2*a* of the impeller 2 and positioned close to one end of the tongue portion 143 in the direction parallel to the axial direction of the rotational axis RS of the shaft 2*b*. The second area portion 143*b* is a part of the tongue portion 143 extending to the side wall 4*a* having the suction port 5 and positioned close to the other end of the tongue portion 143 in the direction parallel to the axial direction of the rotational axis RS of the shaft 2*b*. The first area portion 143*a* is a part of the tongue portion 143 positioned closer to the main plate 2*a* than is the second area portion 143*b*. The second area portion 143*b* is a part of the tongue portion 143 positioned closer to the suction port 5 than is the first area portion 143*a*. The second area portion 143*b* may include not only the part of the tongue portion 143 extending to the side wall 4*a* having the suction port 5 but also a part of the tongue portion 143 positioned closer to the side wall 4*a* than to the main plate 2*a* in the direction parallel to the axial direction of the rotational axis RS of the shaft 2*b*.

When the tongue portion 143 is viewed in a direction from the extension plate 42*b* to the diffuser plate 42*c* as illustrated in FIG. 14, the tongue portion 143 is curved such that the first area portion 143*a* is positioned closer to the rotational axis RS of the impeller 2 than is the second area portion 143*b*. In other words, when the tongue portion 143 is viewed in the direction from the extension plate 42*b* to the diffuser plate 42*c*, the tongue portion 143 is curved such that the second area portion 143*b* is positioned farther away from the rotational axis RS of the impeller 2 than is the first area portion 143*a*. That is, the tongue portion 143 is smoothly curved such that the tongue portion 143 is positioned gradually away from the impeller 2 and close to the discharge port 42*a* with increasing distance from the first area portion 143*a* to the second area portion 143*b*. Further, a part of the peripheral wall 4*c* extending to the tongue portion 143 has a shape conforming to the shape of the tongue portion 143. That is, the peripheral wall 4*c* is curved such that the part of the peripheral wall 4*c* is positioned gradually close to the rotational axis RS of the impeller 2 with increasing distance from the side wall 4*a* to the main plate 2*a*. That is, the scroll casing 4 is formed such that the part of the tongue portion 143 positioned closer to the side wall 4*d* and the part of the peripheral wall 4*c* extending to the tongue portion 143 and positioned closer to the side wall 4*d* in the axial direction of the rotational axis RS of the impeller 2 are gently recessed inward of the scroll casing 4. Thus, the peripheral wall 4*c* is curved in a shape conforming to the shape of the tongue portion 143. Compared with the centrifugal air-sending device 11, the centrifugal air-sending device 11A is formed such that the second area portion 143*b* is positioned closer to the extension plate 42*b* than is the first area portion 143*a* and bulges toward the passage at the inflow port 42*g* more than does the first area portion 143*a*.

[Operation of Centrifugal Air-Sending Device 1A]

When the impeller 2 rotates, air outside the scroll casing 4 is suctioned into the scroll casing 4 through the suction ports 5. The air suctioned into the scroll casing 4 is guided by the bell mouths 3 and suctioned into the impeller 2. The air suctioned into the impeller 2 causes an air flow to which a dynamic pressure and a static pressure are applied while the air passes through the plurality of blades 2*d*. The air flow is blown radially outward from the impeller 2. While the air flow blown from the impeller 2 is guided between the inner surface of the peripheral wall 4*c* and the blades 2*d* in the scroll portion 41, the dynamic pressure is converted into a static pressure. After the air flow blown from the impeller 2 passes through the scroll portion 41, the air flow is blown out of the scroll casing 4 from the discharge port 42*a* of the discharge portion 42 (arrow F2). The air flow blown from the impeller 2 concentrates at the main plate 2*a*. Apart of the air flow blown from the main plate 2*a* impinges on the inner surface of the peripheral wall 4*c* of the scroll portion 41 and flows toward the suction ports 5 along the peripheral wall 4*c* of the scroll portion 41. The air flow around the main plate 2*a* and the air flow having flowed toward the suction ports 5 are different in terms of their flow directions. After the air flows are guided between the inner surface of the peripheral wall 4*c* and the blades 2*d* in the scroll portion 41 and pass through the scroll portion 41, a part of the air flows re-enters the scroll portion 41 with the tongue portion 143 as the border (arrow F3).

[Advantageous Effects of Centrifugal Air-Sending Device 1A]

As described above, the tongue portion 143 of the centrifugal air-sending device 1A includes the first area portion 143*a* facing the main plate 2*a* in the direction parallel to the axial direction of the rotational axis RS, and the second area portions 143*b* positioned closer to the respective side walls 4*a* than is the first area portion 143*a*. The first area portion 143*a* has the first vertex 144 in the section perpendicular to the rotational axis RS. The first vertex 144 is the intersection point of the curve line formed by the tongue portion 143 and the bisector E11 of the first connection straight line LS11 connecting the winding start portion 141*a* and the connection portion 142*f*, which is the end of the discharge portion 42. The second area portion 143*b* has the second vertex 145, which is the intersection point of the curve line formed by the tongue portion 143 and the bisector E12 of the second connection straight line LS12 connecting the winding start portion 141*a* and the connection portion 142*f*, which is the end of the discharge portion 42 closer to the peripheral wall 4*c* than is the opposite end. When the virtual straight line connecting the rotational axis RS and the first vertex 144 is defined as the first straight line L11 and the virtual straight line connecting the rotational axis RS and the second vertex 145 is defined as the second straight line L12, the second straight line L12 is longer than the first straight line L11. With this structure of the tongue portion 143, a stagnation point of air flows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, local pressure fluctuation can be suppressed. Thus, noise can be reduced.

The winding start portion 141*a* is positioned closer to the discharge port 42*a* than is the virtual spiral curve 4*c*1 obtained by extending the curve of the spiral shape in the direction opposite to the air flow direction. With this structure of the centrifugal air-sending device 1A, the stagnation point of airflows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

In the centrifugal air-sending device 1A, the angle between the first diffuser portion 42*c*4 and the reference straight line T is defined as the first discharge port angle θ11 and the angle between the second diffuser portion 42*c*5 and the reference straight line T is defined as the second discharge port angle θ12. In this case, the second discharge port angle θ12 is larger than the first discharge port angle θ11. With this structure of the centrifugal air-sending device 1A, the stagnation point of airflows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

In the tongue portion 143, the second vertex 145 is positioned closer to the discharge port end 42*c*1 than is the first vertex 144 on the line between the rotational axis RS and the discharge port end 42*c*1 on the reference straight line T. With this structure of the centrifugal air-sending device 1A, the stagnation point of airflows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

In the tongue portion 143, the shortest distance between the second vertex 145 and the reference straight line T is longer than the shortest distance between the first vertex 144 and the reference straight line T. With this structure of the centrifugal air-sending device 1A, the stagnation point of airflows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

The tongue portion 143 is curved such that the first area portion 143*a* is positioned close to the rotational axis RS when the tongue portion 143 is viewed from the discharge port 42*a*. With this structure of the centrifugal air-sending device 1A, the stagnation point of air flows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

The tongue portion 143 is curved such that the second area portions 143*b* are positioned farther away from the rotational axis RS than is the first area portion 143*a*. With this structure of the centrifugal air-sending device 1A, the stagnation point of air flows at the tongue portion 143 can be shifted depending on the air flow around the main plate 2*a* and the air flow around the suction ports 5 that are different in terms of their flow directions. As a result, it is possible to control, in the centrifugal air-sending device 1A, the amount of the air flow that re-enters the scroll portion 41 with the stagnation point of air flows as the border. Along with this, the local pressure fluctuation can be suppressed. Thus, noise can be reduced.

Embodiment 3

Figure 15:
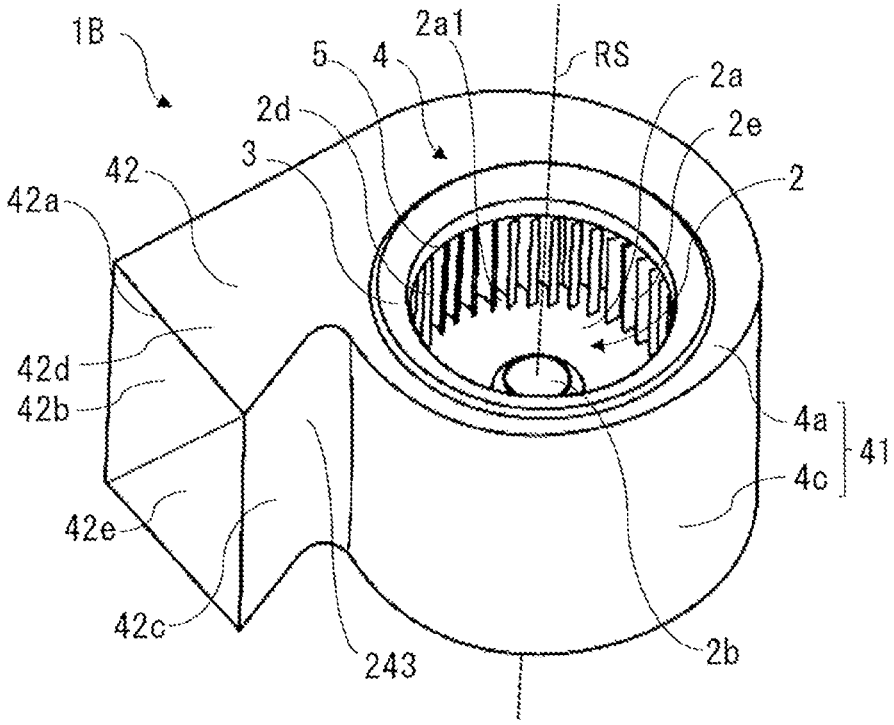
FIG. 15 is a perspective view of a centrifugal air-sending device according to Embodiment 3 of the present disclosure.
Figure 16:
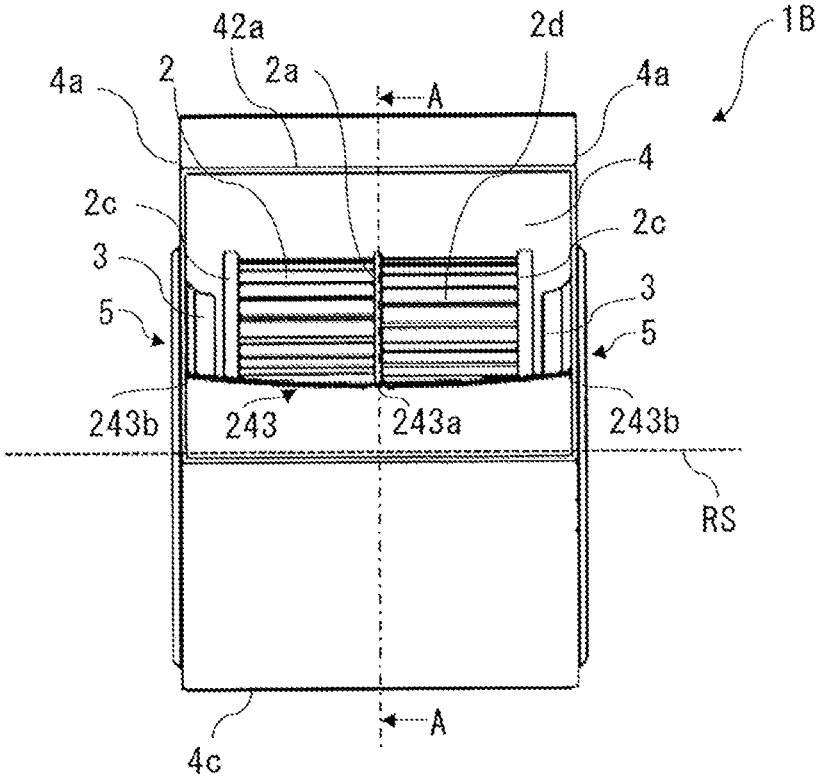
FIG. 16 is a side view of the centrifugal air-sending device of FIG. 15 that is viewed from the discharge port.
Figure 17:
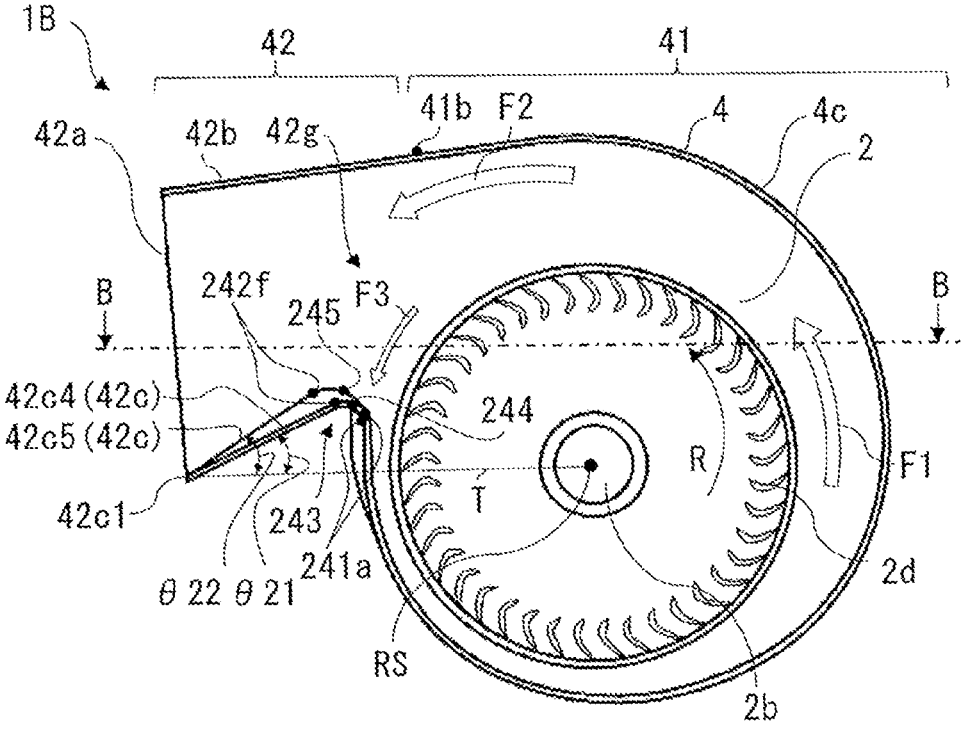
FIG. 17 is a sectional view of the centrifugal air-sending device that is cut along a line A-A in FIG. 16.
Figure 18:
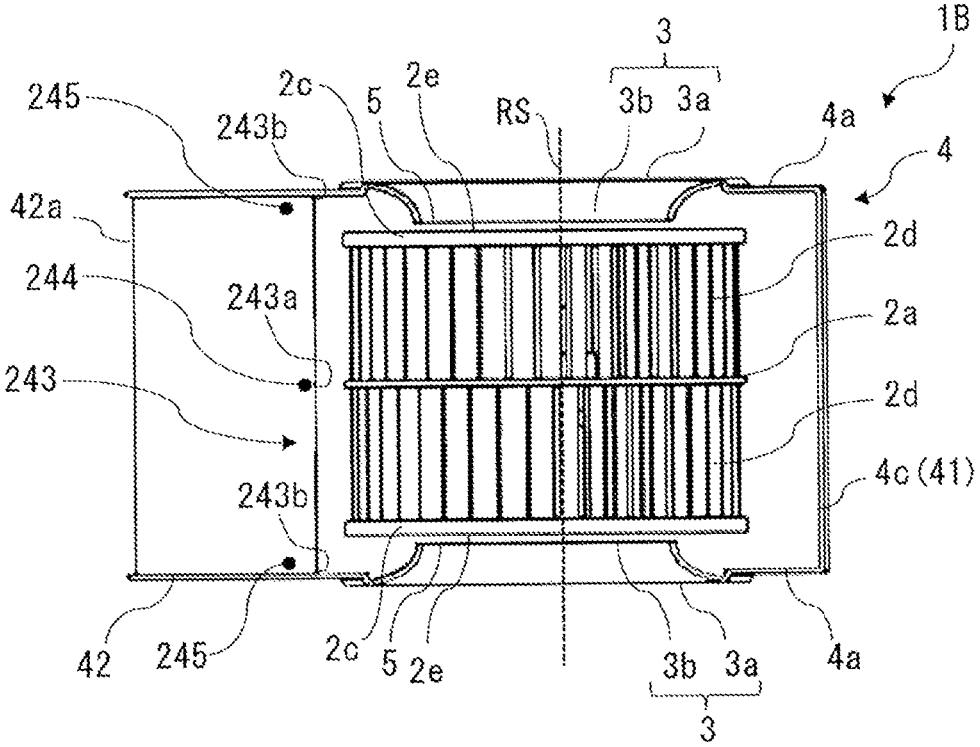
FIG. 18 is a horizontal sectional view of the centrifugal air-sending device of FIG. 15 at a part of a line B-B on the centrifugal air-sending device of FIG. 17.
Figure 19:
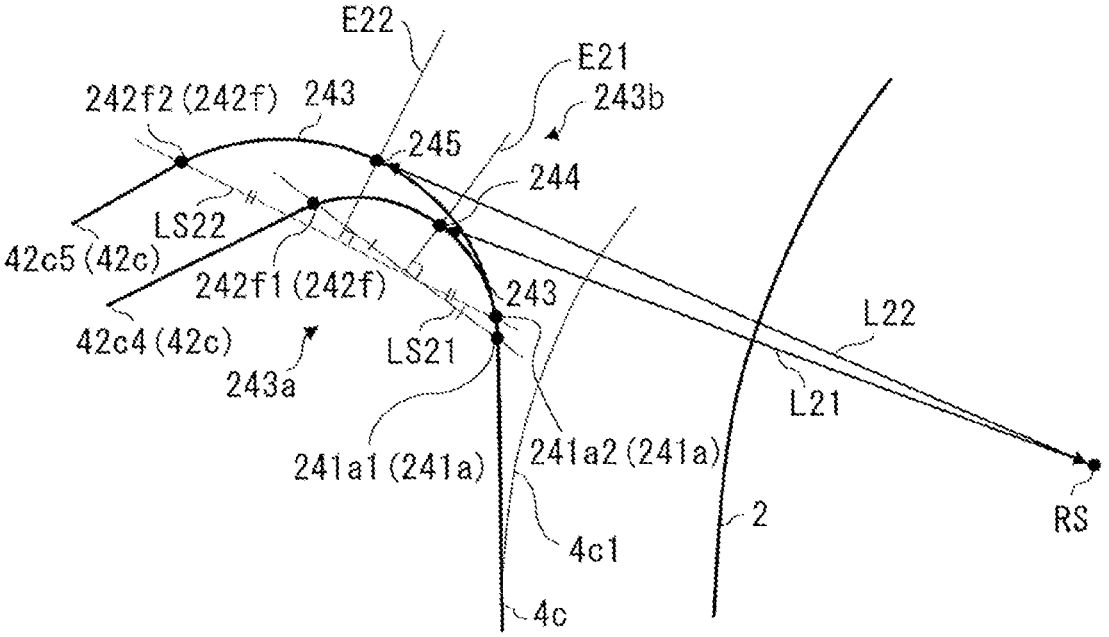
FIG. 19 is a conceptual diagram illustrating a relationship between a tongue portion and the rotational axis of the impeller in the centrifugal air-sending device of FIG. 15.

FIG. 15 is a perspective view of a centrifugal air-sending device 1B according to Embodiment 3 of the present disclosure. FIG. 16 is a side view of the centrifugal air-sending device 1B of FIG. 15 that is viewed from the discharge port 42*a*. FIG. 17 is a sectional view of the centrifugal air-sending device 1B that is cut along a line A-A in FIG. 16. FIG. 18 is a horizontal sectional view of the centrifugal air-sending device 1B of FIG. 15 at a part of a line B-B on the centrifugal air-sending device 1B of FIG. 17. FIG. 19 is a conceptual diagram illustrating a relationship between a tongue portion 243 and the rotational axis RS of the impeller 2 in the centrifugal air-sending device 1B of FIG. 15. Portions having the same structures as those of the centrifugal air-sending device 1 or the centrifugal air-sending device 1A of FIG. 1 to FIG. 12 are represented by the same reference signs and description of the portions is omitted. The centrifugal air-sending device 1B according to Embodiment 3 is different from the centrifugal air-sending device 1 according to Embodiment 1 in terms of the structure of the tongue portion 43. The structures of portions other than the tongue portion 43 are similar to the structures in the centrifugal air-sending device 1 according to Embodiment 1. Thus, the following description is mainly directed to the structure of the tongue portion 243 of the centrifugal air-sending device 1B according to Embodiment 3 with reference to FIG. 15 to FIG. 19.

(Tongue Portion 243)

The scroll casing 4 has the tongue portion 243 between the diffuser plate 42*c* of the discharge portion 42 and a winding start portion 241*a* of the peripheral wall 4*c*. The tongue portion 243 introduces an air flow produced by the impeller 2 and passing through the scroll portion 41 to the discharge port 42*a*. The tongue portion 243 is a projection provided at the boundary between the scroll portion 41 and the discharge portion 42. In the scroll casing 4, the tongue portion 243 extends in the direction parallel to the axial direction of the rotational axis RS of the shaft 2*b*.

As illustrated in FIG. 17, the tongue portion 243 is bent to project toward the passage at the inflow port 42*g* of the discharge portion 42. The tongue portion 243 has a predetermined curvature radius and the peripheral wall 4*c* is smoothly connected to the diffuser plate 42*c* via the tongue portion 243. When air passing through the suction ports 5 and sent out from the impeller 2 is gathered by the scroll casing 4 and flows into the discharge portion 42, the tongue portion 243 is of use as a branch point in the passage. That is, the inflow port 42*g* of the discharge portion 42 has a passage of an air flow toward the discharge port 42*a* (arrow F2) and a passage of an air flow that re-enters the upstream portion from the tongue portion 243 (arrow F3). The air flow traveling toward the discharge portion 42 has a static pressure increasing while the air flow is passing through the scroll casing 4. Therefore, the pressure is higher than the pressure in the scroll casing 4. The tongue portion 243 is thus configured to define the pressure difference, and is configured to introduce the air traveling toward the discharge portion 42 to the individual passages by the curve surface.

The structure of the tongue portion 243 is further described with reference to FIG. 16 to FIG. 19. The tongue portion 243 includes a first area portion 243*a* facing the main plate 2*a* in the direction parallel to the axial direction of the rotational axis RS of the impeller 2, and second area portions 243*b* positioned closer to the respective side walls 4*a* than is the first area portion 243*a*. When the tongue portion 243 is viewed from the discharge port 42*a* as illustrated in FIG. 16, the tongue portion 243 is curved in a U-shape such that the first area portion 243*a* is positioned close to the rotational axis RS of the shaft 2*b*. That is, in the centrifugal air-sending device 1B, when the tongue portion 243 is viewed from the discharge port 42*a*, the first area portion 243*a* facing the main plate 2*a* is positioned closer to the rotational axis RS of the shaft 2*b* than is the second area portions 243*b* connected to the respective side walls 4*a* each having the suction port 5. The tongue portion 243 is formed such that the first area portion 243*a* facing the main plate 2*a* and the second area portions 243*b* connected to the respective side walls 4*a* each having the suction port 5 are disposed on the same curve line when the tongue portion 243 is viewed from the discharge port 42*a*. The first area portion 243*a* is a part of the tongue portion 243 facing the main plate 2*a* of the impeller 2 and positioned at the center of the tongue portion 243 in the direction parallel to the axial direction of the rotational axis RS of the shaft 2*b*. The second area portion 243*b* is a part of the tongue portion 243 extending to each of the side walls 4*a* each having the suction port 5 and positioned at each end of the tongue portion 243 in the direction parallel to the axial direction of the rotational axis RS of the shaft 2*b*. The first area portion 243*a* is a part of the tongue portion 243 positioned closer to the main plate 2*a* than are the second area portions 243*b*. Each of the second area portions 243*b* is a part of the tongue portion 243 positioned closer to the corresponding suction port 5 than is the first area portion 243*a*. The second area portion 243*b* may include not only the part of the tongue portion 243 extending to the side wall 4*a* having the suction port 5 but also a part of the tongue portion 243 positioned closer to the side wall 4*a* than to the main plate 2*a* in the direction parallel to the axial direction of the rotational axis RS of the shaft 2*b*.

When the tongue portion 243 is viewed in a direction from the extension plate 42*b* to the diffuser plate 42*c* as illustrated in FIG. 18, a part of the tongue portion 243 closest to the impeller 2 has a straight shape parallel to the rotational axis RS of the impeller 2. The first area portion 243*a* and the second area portions 243*b* of the tongue portion 243 are positioned at equal distances from the rotational axis RS of the impeller 2. That is, when the tongue portion 243 is viewed in the direction from the extension plate 42*b* to the diffuser plate 42*c* as illustrated in FIG. 18, the first area portion 243*a* and the second area portions 243*b* at the part of the tongue portion 243 closest to the impeller 2 are disposed on the same straight line. In the centrifugal air-sending device 1 according to Embodiment 1, the scroll casing 4 is formed such that the center of the tongue portion 243 and the center of the part of the peripheral wall 4*c* extending to the tongue portion 243 in the axial direction of the rotational axis RS of the impeller 2 are gently recessed inward of the scroll casing 4. In the centrifugal air-sending device 1B according to Embodiment 3, however, the peripheral wall 4*c* is formed along a single curve surface without irregularities in the rotational axis direction RS of the impeller 2 as illustrated in FIG. 17 and FIG. 19.

The structure of the tongue portion 243 is described in more detail with reference to FIG. 17 and FIG. 19. The tongue portion 243 is positioned between the peripheral wall 4*c* and the diffuser plate 42*c*. The winding start portion 241*a* is positioned at a boundary between the tongue portion 243 and the peripheral wall 4*c* of the scroll portion 41. As illustrated in FIG. 17, in the section perpendicular to the rotational axis RS of the shaft 2*b*, the winding start portion 241*a* is an inflection point between a curve line of the tongue portion 243 and the curve line of the peripheral wall 4*c*. A central winding start portion 241*a*1 is a winding start portion 241*a* at the first area portion 243*a*. A terminal winding start portion 241*a*2 is a winding start portion 241*a* at the second area portion 243*b*. Compared with the centrifugal air-sending device 1 according to Embodiment 1, the centrifugal air-sending device 1B is formed such that each of the second area portions 243*b* is positioned closer to the extension plate 42*b* than is the first area portion 243*a* and bulges toward the passage at the inflow port 42*g* more than does the first area portion 243*a*. As described above, the peripheral wall 4*c* has the spiral shape in the section perpendicular to the rotational axis RS of the impeller 2. As illustrated in FIG. 19, in the section perpendicular to the rotational axis RS of the shaft 2*b*, the winding start portion 241*a* is positioned closer to the discharge port 42*a* than is the virtual spiral curve 4*c*1 obtained by extending the curve of the spiral shape in the direction opposite to the air flow direction.

A connection portion 242*f* is positioned at a boundary between the tongue portion 243 and the diffuser plate 42*c* of the discharge portion 42. When the diffuser plate 42*c* is a plate having a curve surface, the connection portion 242*f* is an inflection point between the curve line of the tongue portion 243 and the curve line of the diffuser plate 42*c* in the section perpendicular to the rotational axis RS of the shaft 2*b*. When the diffuser plate 42*c* is a flat plate, as illustrated in FIG. 17, the connection portion 242*f*, which is the end of the discharge portion 42 closer to the peripheral wall 4*c* than is the opposite end, is a boundary between the straight line of the diffuser plate 42*c* and the curve line of the tongue portion 243 in the section perpendicular to the rotational axis RS of the shaft 2*b*. A central connection portion 242*f*1 is a connection portion 242*f* at the first area portion 243*a*. A terminal connection portion 242*f*2 is a connection portion 242*f* at the second area portion 243*b*. As illustrated in FIG. 19, the central connection portion 242*f*1 and the terminal connection portion 242*f*2 are disposed at different positions in the section perpendicular to the rotational axis RS of the shaft 2*b*. As illustrated in FIG. 17, the connection portion 242*f* positioned at the boundary between the tongue portion 243 and the diffuser plate 42*c* is an end of the tongue portion 243 and also the end of the diffuser plate 42*c*. In the section perpendicular to the rotational axis RS of the shaft 2*b*, the first diffuser portion 42*c*4 having the central connection portion 242*f*1 as its end and the second diffuser portion 42*c*5 having the terminal connection portion 242*f*2 as its end have different discharge port angles. More specifically, in the section perpendicular to the rotational axis RS of the shaft 2*b*, a virtual straight line connecting the rotational axis RS of the shaft 2*b* and the discharge port end 42*c*1 of the diffuser plate 42*c* included in the discharge port 42*a* is defined as the reference straight line T. An angle between the first diffuser portion 42*c*4 and the reference straight line T is defined as a first discharge port angle θ21. An angle between the second diffuser portion 42*c*5 and the reference straight line T is defined as a second discharge port angle θ22. In the centrifugal air-sending device 1B, the second discharge port angle θ22 of the second diffuser portion 42*c*5 is larger than the first discharge port angle θ21 of the first diffuser portion 42*c*4.

As illustrated in FIG. 19, the tongue portion 243 has a first vertex 244 and a second vertex 245. The first vertex 244 is a vertex of the tongue portion 243 at the first area portion 243*a*. In the section perpendicular to the rotational axis RS of the impeller 2, the first vertex 244 is an intersection point of the curve line formed by the tongue portion 243 and a bisector E21 of a first connection straight line LS21 connecting the central winding start portion 241*a*1 and the central connection portion 242*f*1. The first connection straight line LS21 and the bisector E21 intersect at a right angle in the section perpendicular to the rotational axis RS of the shaft 2*b*. The second vertex 245 is a vertex of the tongue portion 243 at the second area portion 243*b*. In the section perpendicular to the rotational axis RS of the impeller 2, the second vertex 245 is an intersection point of the curve line formed by the tongue portion 243 and a bisector E22 of a second connection straight line LS22 connecting the terminal winding start portion 241*a*2 and the terminal connection portion 242*f*2. The second connection straight line LS22 and the bisector E22 intersect at a right angle in the section perpendicular to the rotational axis RS of the shaft 2*b*.

A virtual straight line connecting the rotational axis RS of the impeller 2 and the first vertex 244 is defined as a first straight line L21. A virtual straight line connecting the rotational axis RS of the impeller 2 and the second vertex 245 is defined as a second straight line L22. In the centrifugal air-sending device 1B, the first straight line L21 connecting the first vertex 244 and the rotational axis RS is shorter than the second straight line L22 connecting the second vertex 245 and the rotational axis RS in the section perpendicular to the rotational axis RS of the shaft 2*b*. In other words, in the centrifugal air-sending device 1B, the second straight line L22 connecting the second vertex 245 and the rotational axis RS is longer than the first straight line L21 connecting the first vertex 244 and the rotational axis RS in the section perpendicular to the rotational axis RS of the shaft 2*b*. Therefore, the second vertex 245 of the second area portion 243*b* is positioned farther away from the rotational axis RS than is the first vertex 244 of the first area portion 243*a*. Thus, in the section perpendicular to the rotational axis RS of the shaft 2*b*, the space between the impeller 2 and the tongue portion 243 is wider in the second area portion 243*b* than in the first area portion 243*a*. As illustrated in FIG. 17, in the centrifugal air-sending device 1B, the second vertex 245 is positioned closer to the discharge port end 42*c*1 than is the first vertex 244 on the line between the rotational axis RS and the discharge port end 42*c*1 on the reference straight line T. In the tongue portion 243, the shortest distance between the second vertex 245 and the reference straight line T is longer than the shortest distance between the first vertex 244 and the reference straight line T. Thus, in the section perpendicular to the rotational axis RS of the shaft 2*b*, the space between the impeller 2 and the tongue portion 243 is wider in the second area portion 243*b* than in the first area portion 243*a*.

Figure 20:
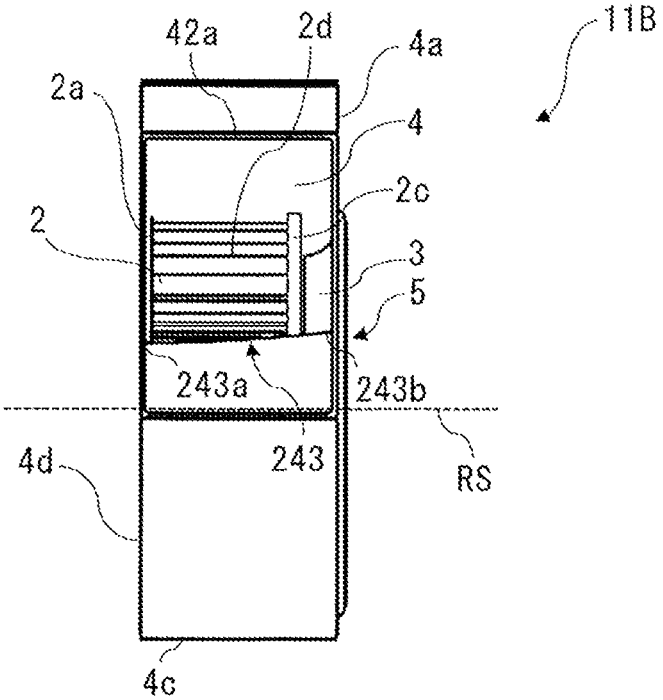
FIG. 20 is a side view of a modified example of the centrifugal air-sending device according to Embodiment 3 of the present disclosure that is viewed from the discharge port.
Figure 21:
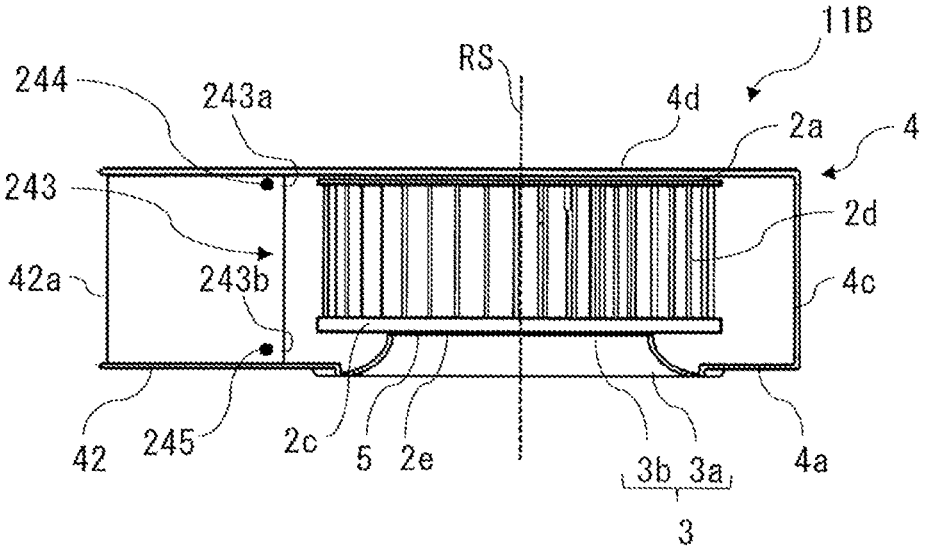
FIG. 21 is a horizontal sectional view of the centrifugal air-sending device of FIG. 20 at the part of the line B-B in FIG. 17.

FIG. 20 is a side view of a modified example of the centrifugal air-sending device 1B according to Embodiment 3 of the present disclosure that is viewed from the discharge port 42*a*. FIG. 21 is a horizontal sectional view of a centrifugal air-sending device 11B of FIG. 20 at the part of the line B-B in FIG. 17. Although the double-suction centrifugal air-sending device 1B is described with reference to FIG. 15 to FIG. 19, the centrifugal air-sending device 1B is not limited to the double-suction centrifugal air-sending device 1B but may be a single-suction centrifugal air-sending device 11B.

Thus, the centrifugal air-sending device 11B is only required to have at least one side wall 4*a* having the suction port 5. The scroll portion 41 of the centrifugal air-sending device 11B includes the side wall 4*a* covering the impeller 2 in the axial direction of the rotational axis RS of the shaft 2*b* of the impeller 2, and having the suction port 5 through which air is suctioned, and the peripheral wall 4*c* surrounding the impeller 2 in the radial direction of the rotational axis RS of the shaft 2*b*. The scroll portion 41 of the single-suction centrifugal air-sending device 11B further includes the side wall 4*d* perpendicular to the axial direction of the rotational axis RS. The side wall 4*d* has no suction port 5. The side wall 4*d* and the side wall 4*a* face each other. As illustrated in FIG. 6 and FIG. 8, the plurality of blades 2*d* of the centrifugal air-sending device 11B are provided on one side of the main plate 2*a* in the axial direction of the rotational axis RS of the shaft 2*b*.

The tongue portion 243 includes the first area portion 243*a* facing the main plate 2*a* in the direction parallel to the axial direction of the rotational axis RS of the impeller 2, and the second area portion 243*b* positioned closer to the side wall 4*a* than is the first area portion 243*a*. When the tongue portion 243 is viewed from the discharge port 42*a* as illustrated in FIG. 20, the tongue portion 243 is curved such that the first area portion 243*a* is positioned close to the rotational axis RS of the shaft 2*b*. That is, in the centrifugal air-sending device 1B, when the tongue portion 243 is viewed from the discharge port 42*a*, the first area portion 243*a* facing the main plate 2*a* is positioned closer to the rotational axis RS of the shaft 2*b* than is the second area portion 243*b* connected to the side wall 4*a* having the suction port 5. The tongue portion 243 is formed such that the first area portion 243*a* facing the main plate 2*a* and the second area portion 243*b* connected to the side wall 4*a* having the suction port 5 are disposed on the same curve line when the tongue portion 243 is viewed from the discharge port 42*a*. The first area portion 243*a* is a part of the tongue portion 243 facing the main plate 2*a* of the impeller 2 and positioned close to one end of the tongue portion 243 in the direction parallel to the axial direction of the rotational axis RS of the shaft 2*b*. The second area portion 243*b* is a part of the tongue portion 243 extending to the side wall 4*a* having the suction port 5 and positioned close to the other end of the tongue portion 243 in the direction parallel to the axial direction of the rotational axis RS of the shaft 2*b*. The first area portion 243*a* is a part of the tongue portion 243 positioned closer to the main plate 2*a* than is the second area portion 243*b*. The second area portion 243*b* is a part of the tongue portion 243 positioned closer to the suction port 5 than is the first area portion 243*a*. The second area portion 243*b* may include not only the part of the tongue portion 243 extending to the side wall 4*a* having the suction port 5 but also a part of the tongue portion 243 positioned closer to the side wall 4*a* than to the main plate 2*a* in the direction parallel to the axial direction of the rotational axis RS of the shaft 2*b*.

When the tongue portion 243 is viewed in a direction from the extension plate 42*b* to the diffuser plate 42*c* as illustrated in FIG. 21, a part of the tongue portion 243 closest to the impeller 2 has a straight shape parallel to the rotational axis RS of the impeller 2. The first area portion 243*a* and the second area portion 243*b* of the tongue portion 243 are positioned at equal distances from the rotational axis RS of the impeller 2. That is, when the tongue portion 243 is viewed in the direction from the extension plate 42*b* to the diffuser plate 42*c*, the first area portion 243*a* and the second area portion 243*b* at the part of the tongue portion 243 closest to the impeller 2 are disposed on the same straight line. In the centrifugal air-sending device 11 described above, the scroll casing 4 is formed such that the part of the tongue portion 43 positioned closer to the side wall 4*d* and the part of the peripheral wall 4*c* extending to the tongue portion 43 and positioned closer to the side wall 4*d* in the axial direction of the rotational axis RS of the impeller 2 are gently recessed inward of the scroll casing 4. In the centrifugal air-sending device 11B, however, the peripheral wall 4*c* is formed along a single curve surface without irregularities in the rotational axis direction RS of the impeller 2 as illustrated in FIG. 20 and FIG. 21.

[Operation of Centrifugal Air-Sending Device 1B]

When the impeller 2 rotates, air outside the scroll casing 4 is suctioned into the scroll casing 4 through the suction ports 5. The air suctioned into the scroll casing 4 is guided by the bell mouths 3 and suctioned into the impeller 2. The air suctioned into the impeller 2 causes an air flow to which a dynamic pressure and a static pressure are applied while the air passes through the plurality of blades 2*d*. The air flow is blown radially outward from the impeller 2. While the air flow blown from the impeller 2 is guided between the inner surface of the peripheral wall 4*c* and the blades 2*d* in the scroll portion 41, the dynamic pressure is converted into a static pressure. After the air flow blown from the impeller 2 passes through the scroll portion 41, the air flow is blown out of the scroll casing 4 from the discharge port 42*a* of the discharge portion 42 (arrow F2). The air flow blown from the impeller 2 concentrates at the main plate 2*a*. Apart of the air flow blown from the main plate 2*a* impinges on the inner surface of the peripheral wall 4*c* of the scroll portion 41 and flows toward the suction ports 5 along the peripheral wall 4*c* of the scroll portion 41. The air flow around the main plate 2*a* and the air flow having flowed toward the suction ports 5 are different in terms of their flow directions. After the air flows are guided between the inner surface of the peripheral wall 4*c* and the blades 2*d* in the scroll portion 41 and pass through the scroll portion 41, a part of the air flows re-enters the scroll portion 41 with the tongue portion 243 as the border (arrow F3).

[Advantageous Effects of Centrifugal Air-Sending Device 1B]

As described above, the tongue portion 243 of the centrifugal air-sending device 1B includes the first area portion 243*a* facing the main plate 2*a* in the direction parallel to the axial direction of the rotational axis RS, and the second area portions 243*b* positioned closer to the respective side walls 4*a* than is the first area portion 243*a*. The first area portion 243*a* has the first vertex 244 in the section perpendicular to the rotational axis RS. The first vertex 244 is the intersection point of the curve line formed by the tongue portion 243 and the bisector E21 of the first connection straight line LS21 connecting the winding start portion 241*a* and the connection portion 242*f*, which is the end of the discharge portion 42. The second area portion 243*b* has the second vertex 245, which is the intersection point of the curve line formed by the tongue portion 243 and the bisector E22 of the second connection straight line LS22 connecting the winding start portion 241*a* and the connection portion 242*f*, which is the end of the discharge portion 42 closer to the peripheral wall 4*c* than is the opposite end. When the virtual straight line connecting the rotational axis RS and the first vertex 244 is defined as the first straight line L21 and the virtual straight line connecting the rotational axis RS and the second vertex 245 is defined as the second straight line L22, the second straight line L22 is longer than the first straight line L21. With this structure of the tongue portion 243, a stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, local pressure fluctuation can be suppressed. Thus, noise can be reduced.

The winding start portion 241*a* is positioned closer to the discharge port 42*a* than is the virtual spiral curve 4*c*1 obtained by extending the curve of the spiral shape in the direction opposite to the air flow direction. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

In the centrifugal air-sending device 1B, the angle between the first diffuser portion 42*c*4 and the reference straight line T is defined as the first discharge port angle 621 and the angle between the second diffuser portion 42*c*5 and the reference straight line T is defined as the second discharge port angle θ22. In this case, the second discharge port angle θ22 is larger than the first discharge port angle θ21. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

In the tongue portion 243, the second vertex 245 is positioned closer to the discharge port end 42*c*1 than is the first vertex 244 on the line between the rotational axis RS and the discharge port end 42*c*1 on the reference straight line T. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

In the tongue portion 243, the shortest distance between the second vertex 245 and the reference straight line T is longer than the shortest distance between the first vertex 244 and the reference straight line T. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

The tongue portion 243 is curved such that the first area portion 243*a* is positioned close to the rotational axis RS when the tongue portion 243 is viewed from the discharge port 42*a*. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

The tongue portion 243 is curved such that the second area portions 243*b* are positioned farther away from the rotational axis RS than is the first area portion 243*a*. With this structure of the centrifugal air-sending device 1B, the stagnation point of air flows at the tongue portion 243 can be shifted depending on the air flow around the main plate 2*a* and the air flow around the suction ports 5 that are different in terms of their flow directions. As a result, it is possible to control, in the centrifugal air-sending device 1B, the amount of the air flow that re-enters the scroll portion 41 with the stagnation point of air flows as the border. Along with this, the local pressure fluctuation can be suppressed. Thus, noise can be reduced.

Embodiment 4

Figure 22:
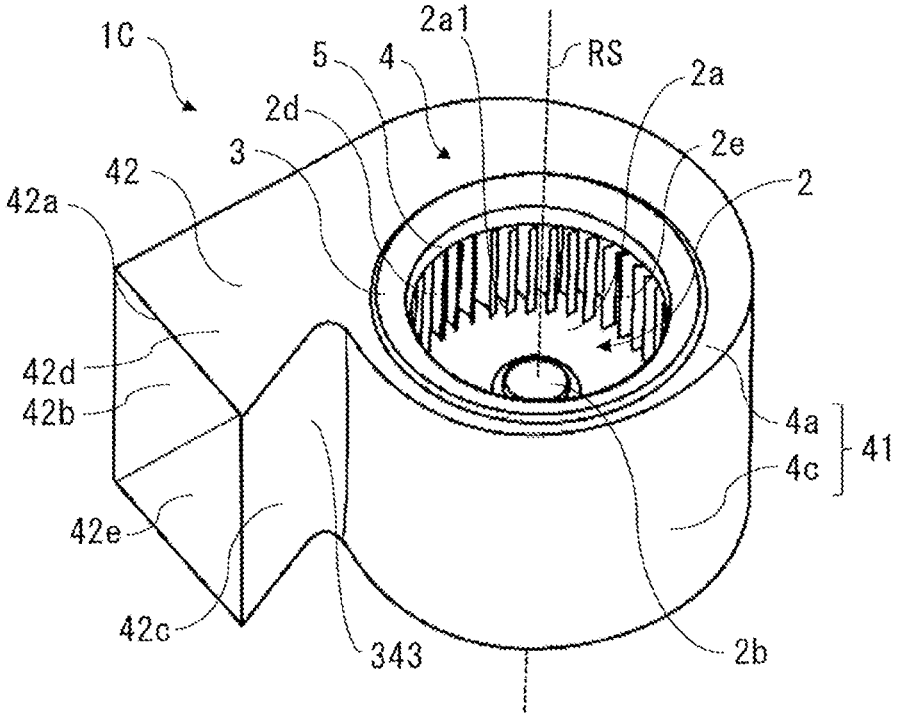
FIG. 22 is a perspective view of a centrifugal air-sending device according to Embodiment 4 of the present disclosure.
Figure 23:
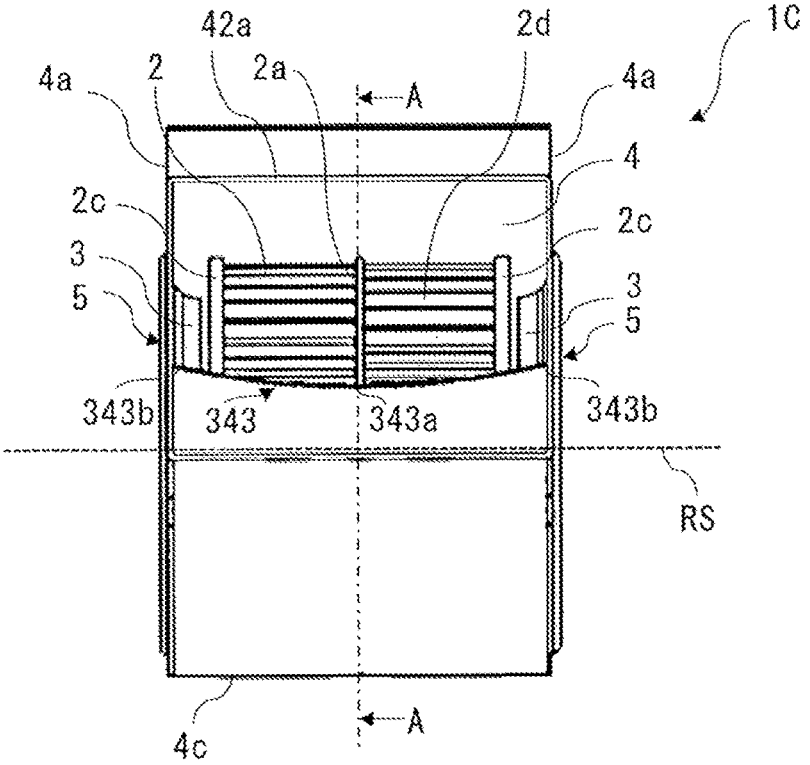
FIG. 23 is a side view of the centrifugal air-sending device of FIG. 22 that is viewed from the discharge port.
Figure 24:
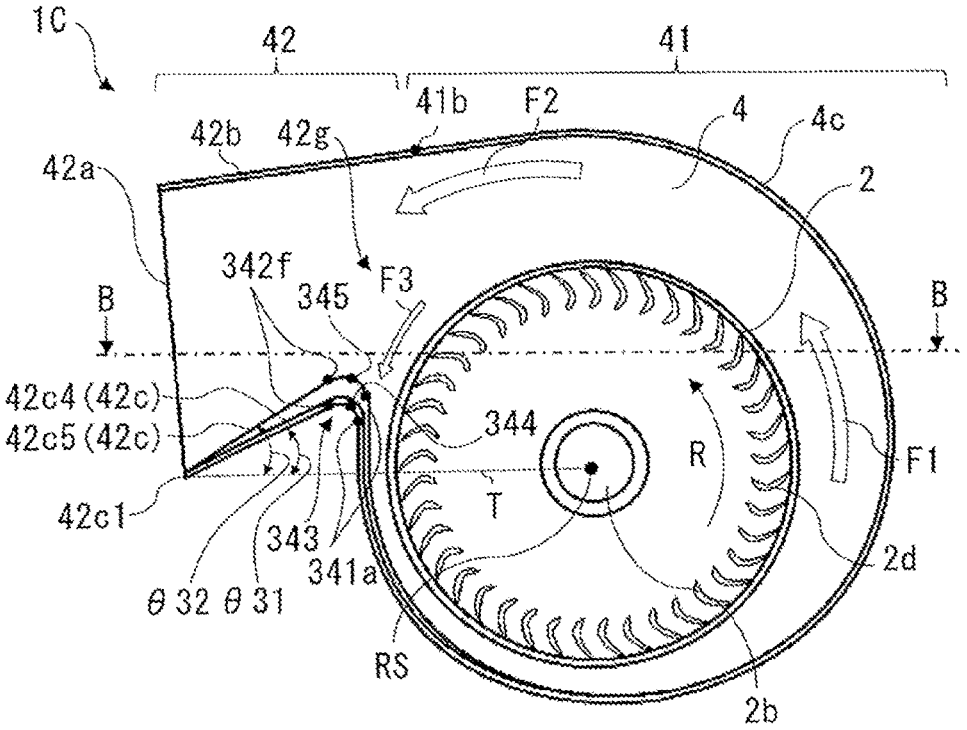
FIG. 24 is a sectional view of the centrifugal air-sending device that is cut along a line A-A in FIG. 23.
Figure 25:
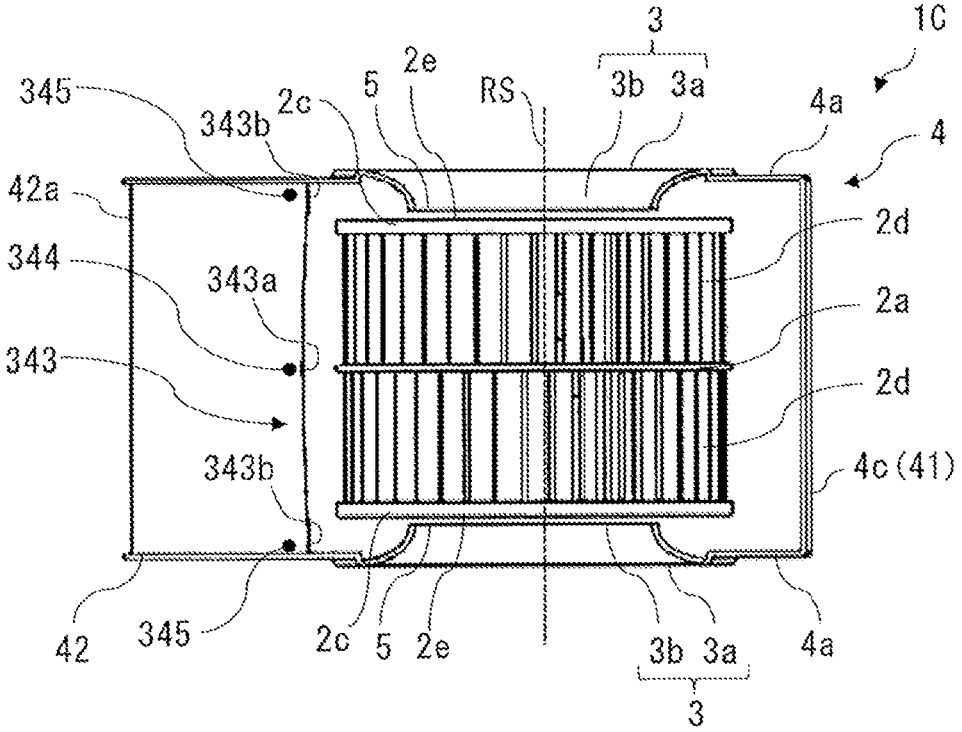
FIG. 25 is a horizontal sectional view of the centrifugal air-sending device of FIG. 22 at a part of a line B-B on the centrifugal air-sending device of FIG. 24.
Figure 26:
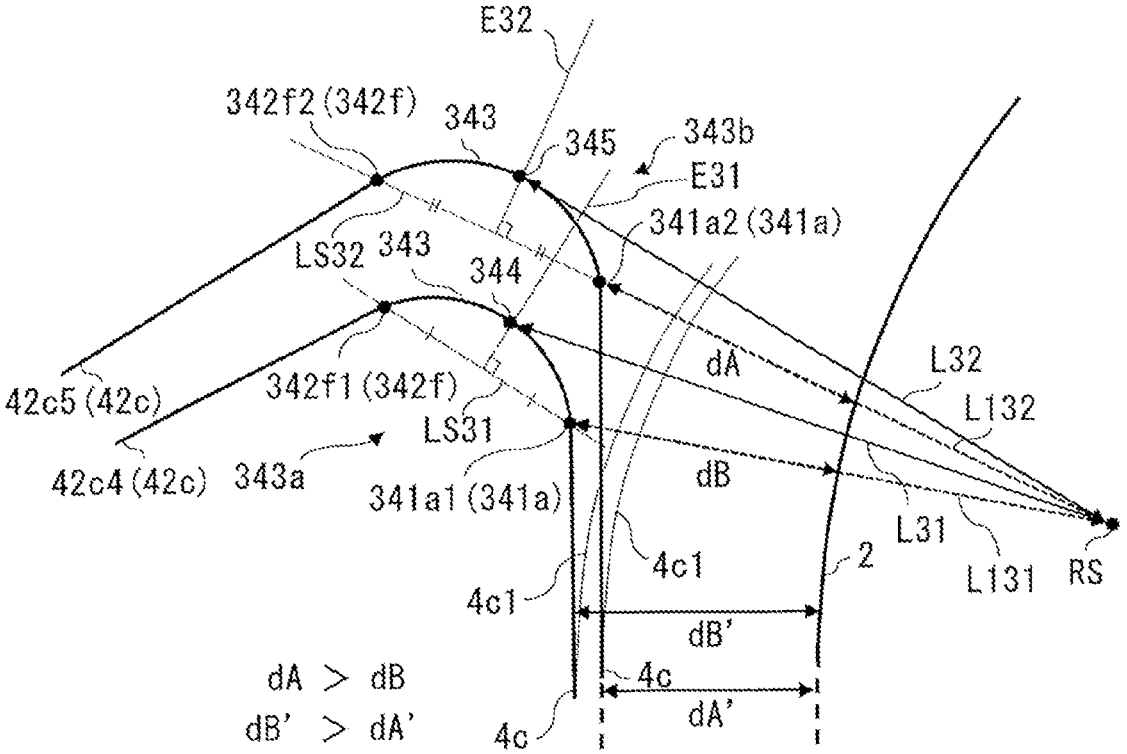
FIG. 26 is a conceptual diagram illustrating a relationship between a tongue portion and the rotational axis of the impeller in the centrifugal air-sending device of FIG. 22.

FIG. 22 is a perspective view of a centrifugal air-sending device 1C according to Embodiment 4 of the present disclosure. FIG. 23 is a side view of the centrifugal air-sending device 1C of FIG. 22 that is viewed from the discharge port 42*a*. FIG. 24 is a sectional view of the centrifugal air-sending device 1C that is cut along a line A-A in FIG. 23. FIG. 25 is a horizontal sectional view of the centrifugal air-sending device 1C of FIG. 22 at a part of a line B-B on the centrifugal air-sending device 1C of FIG. 24. FIG. 26 is a conceptual diagram illustrating a relationship between a tongue portion 343 and the rotational axis RS of the impeller 2 in the centrifugal air-sending device 1C of FIG. 22. Portions having the same structures as those of the centrifugal air-sending device 1, the centrifugal air-sending device 1A, and the centrifugal air-sending device 1B of FIG. 1 to FIG. 19 are represented by the same reference signs and description of the portions is omitted. The centrifugal air-sending device 1C according to Embodiment 3 is different from the centrifugal air-sending device 1 according to Embodiment 1 in terms of the structure of the tongue portion 43. The structures of portions other than the tongue portion 43 are similar to the structures in the centrifugal air-sending device 1 according to Embodiment 1. Thus, the following description is mainly directed to the structure of the tongue portion 343 of the centrifugal air-sending device 1C according to Embodiment 4 with reference to FIG. 22 to FIG. 26.

(Tongue Portion 343)

The scroll casing 4 has the tongue portion 343 between the diffuser plate 42*c* of the discharge portion 42 and a winding start portion 341*a* of the peripheral wall 4*c*. The tongue portion 343 introduces an air flow produced by the impeller 2 and passing through the scroll portion 41 to the discharge port 42*a*. The tongue portion 343 is a projection provided at the boundary between the scroll portion 41 and the discharge portion 42. In the scroll casing 4, the tongue portion 343 extends in the direction parallel to the axial direction of the rotational axis RS of the shaft 2*b*.

As illustrated in FIG. 24, the tongue portion 343 is bent to project toward the passage at the inflow port 42*g* of the discharge portion 42. The tongue portion 343 has a predetermined curvature radius and the peripheral wall 4*c* is smoothly connected to the diffuser plate 42*c* via the tongue portion 343. When air passing through the suction ports 5 and sent out from the impeller 2 is gathered by the scroll casing 4 and flows into the discharge portion 42, the tongue portion 343 is of use as a branch point in the passage. That is, the inflow port 42*g* of the discharge portion 42 has a passage of an air flow toward the discharge port 42*a* (arrow F2) and a passage of an air flow that re-enters the upstream portion from the tongue portion 343 (arrow F3). The air flow traveling toward the discharge portion 42 has a static pressure increasing while the air flow is passing through the scroll casing 4. Therefore, the pressure is higher than the pressure in the scroll casing 4. The tongue portion 343 is thus configured to define the pressure difference, and is configured to introduce the air traveling toward the discharge portion 42 to the individual passages by the curve surface.

The structure of the tongue portion 343 is further described with reference to FIG. 23 to FIG. 26. The tongue portion 343 includes a first area portion 343*a* facing the main plate 2*a* in the direction parallel to the axial direction of the rotational axis RS of the impeller 2, and second area portions 343*b* positioned closer to the respective side walls 4*a* than is the first area portion 343*a*. When the tongue portion 343 is viewed from the discharge port 42*a* as illustrated in FIG. 23, the tongue portion 343 is curved in a U-shape such that the first area portion 343*a* is positioned close to the rotational axis RS of the shaft 2*b*. That is, in the centrifugal air-sending device 1C, when the tongue portion 343 is viewed from the discharge port 42*a*, the first area portion 343*a* facing the main plate 2*a* is positioned closer to the rotational axis RS of the shaft 2*b* than is the second area portions 343*b* connected to the respective side walls 4*a* each having the suction port 5. The tongue portion 343 is formed such that the first area portion 343*a* facing the main plate 2*a* and the second area portions 343*b* connected to the respective side walls 4*a* each having the suction port 5 are disposed on the same curve line when the tongue portion 343 is viewed from the discharge port 42*a*. The first area portion 343*a* is a part of the tongue portion 343 facing the main plate 2*a* of the impeller 2 and positioned at the center of the tongue portion 343 in the direction parallel to the axial direction of the rotational axis RS of the shaft 2*b*. The second area portion 343*b* is a part of the tongue portion 343 extending to each of the side walls 4*a* each having the suction port 5 and positioned at each end of the tongue portion 343 in the direction parallel to the axial direction of the rotational axis RS of the shaft 2*b*. The first area portion 343*a* is a part of the tongue portion 343 positioned closer to the main plate 2*a* than are the second area portions 343*b*. Each of the second area portions 343*b* is a part of the tongue portion 343 positioned closer to the corresponding suction port 5 than is the first area portion 343*a*. The second area portion 343*b* may include not only the part of the tongue portion 343 extending to the side wall 4*a* having the suction port 5 but also a part of the tongue portion 343 positioned closer to the side wall 4*a* than to the main plate 2*a* in the direction parallel to the axial direction of the rotational axis RS of the shaft 2*b*.

When the tongue portion 343 is viewed in a direction from the extension plate 42*b* to the diffuser plate 42*c* as illustrated in FIG. 25, the tongue portion 343 is curved such that the first area portion 343*a* is positioned farther away from the rotational axis RS of the impeller 2 than are the second area portions 343*b*. In other words, when the tongue portion 343 is viewed in the direction from the extension plate 42*b* to the diffuser plate 42*c* as illustrated in FIG. 25, the tongue portion 343 is curved such that the second area portions 343*b* are positioned closer to the rotational axis RS of the impeller 2 than is the first area portion 343*a*. That is, the tongue portion 343 has a smooth inverted U-shape such that the tongue portion 343 is positioned gradually close to the impeller 2 and away from the discharge port 42*a* with increasing distance from the first area portion 343*a* to each of the second area portions 343*b*. As illustrated in FIG. 24 and FIG. 26, a part of the peripheral wall 4*c* extending to the tongue portion 343 has a shape conforming to the shape of the tongue portion 343. That is, the peripheral wall 4*c* is curved such that the part of the peripheral wall 4*c* is positioned gradually close to the rotational axis RS of the impeller 2 with increasing distance from the main plate 2*a* to each of the side walls 4*a*. That is, the scroll casing 4 is formed such that the center of the tongue portion 143 and the center of the part of the peripheral wall 4*c* extending to the tongue portion 143 in the axial direction of the rotational axis RS of the impeller 2 gently bulge from the inner surface of the scroll casing 4. Thus, the peripheral wall 4*c* is curved in a shape conforming to the shape of the tongue portion 343. Compared with the centrifugal air-sending device 1 according to Embodiment 1, the centrifugal air-sending device 1C is formed such that each of the second area portions 343*b* is positioned closer to the extension plate 42*b* than is the first area portion 343*a* and bulges toward the passage at the inflow port 42*g* more than does the first area portion 343*a*.

The structure of the tongue portion 343 is described in more detail with reference to FIG. 24 and FIG. 26. The tongue portion 343 is positioned between the peripheral wall 4*c* and the diffuser plate 42*c*. The winding start portion 341*a* is positioned at a boundary between the tongue portion 343 and the peripheral wall 4*c* of the scroll portion 41. As illustrated in FIG. 24, in the section perpendicular to the rotational axis RS of the shaft 2*b*, the winding start portion 341*a* is an inflection point between a curve line of the tongue portion 343 and the curve line of the peripheral wall 4*c*. A central winding start portion 341*a*1 is a winding start portion 341*a* at the first area portion 343*a*. A terminal winding start portion 341*a*2 is a winding start portion 341*a* at the second area portion 343*b*. As described above, the peripheral wall 4*c* has the spiral shape in the section perpendicular to the rotational axis RS of the impeller 2. As illustrated in FIG. 26, in the section perpendicular to the rotational axis RS of the shaft 2*b*, the winding start portion 341*a* is positioned closer to the discharge port 42*a* than is the virtual spiral curve 4*c*1 obtained by extending the curve of the spiral shape in the direction opposite to the air flow direction.

A connection portion 342*f* is positioned at a boundary between the tongue portion 343 and the diffuser plate 42*c* of the discharge portion 42. When the diffuser plate 42*c* is a plate having a curve surface, the connection portion 342*f* is an inflection point between the curve line of the tongue portion 343 and the curve line of the diffuser plate 42*c* in the section perpendicular to the rotational axis RS of the shaft 2*b*. When the diffuser plate 42*c* is a flat plate, as illustrated in FIG. 10, the connection portion 342*f*, which is the end of the discharge portion 42 closer to the peripheral wall 4*c* than is the opposite end, is a boundary between the straight line of the diffuser plate 42*c* and the curve line of the tongue portion 343 in the section perpendicular to the rotational axis RS of the shaft 2*b*. A central connection portion 342*f*1 is a connection portion 342*f* at the first area portion 343*a*. A terminal connection portion 342*f*2 is a connection portion 342*f* at the second area portion 343*b*. As illustrated in FIG. 26, the central connection portion 342*f*1 and the terminal connection portion 342*f*2 are disposed at different positions in the section perpendicular to the rotational axis RS of the shaft 2*b*. As illustrated in FIG. 24, the connection portion 342*f* positioned at the boundary between the tongue portion 343 and the diffuser plate 42*c* is an end of the tongue portion 343 and also the end of the diffuser plate 42*c*. In the section perpendicular to the rotational axis RS of the shaft 2*b*, the first diffuser portion 42*c*4 having the central connection portion 342*f*1 as its end and the second diffuser portion 42*c*5 having the terminal connection portion 342*f*2 as its end have different discharge port angles. More specifically, in the section perpendicular to the rotational axis RS of the shaft 2*b*, a virtual straight line connecting the rotational axis RS of the shaft 2*b* and the discharge port end 42*c*1 of the diffuser plate 42*c* included in the discharge port 42*a* is defined as the reference straight line T. An angle between the first diffuser portion 42*c*4 and the reference straight line T is defined as a first discharge port angle θ31. An angle between the second diffuser portion 42*c*5 and the reference straight line T is defined as a second discharge port angle θ32. In the centrifugal air-sending device 1C, the second discharge port angle θ32 of the second diffuser portion 42*c*5 is larger than the first discharge port angle θ31 of the first diffuser portion 42*c*4.

As illustrated in FIG. 26, the tongue portion 343 has a first vertex 344 and a second vertex 345. The first vertex 344 is a vertex of the tongue portion 343 at the first area portion 343*a*. In the section perpendicular to the rotational axis RS of the impeller 2, the first vertex 344 is an intersection point of the curve line formed by the tongue portion 343 and a bisector E31 of a first connection straight line LS31 connecting the central winding start portion 341*a*1 and the central connection portion 342*f*1. The first connection straight line LS31 and the bisector E31 intersect at a right angle in the section perpendicular to the rotational axis RS of the shaft 2*b*. The second vertex 345 is a vertex of the tongue portion 343 at the second area portion 343*b*. In the section perpendicular to the rotational axis RS of the shaft 2*b*, the second vertex 345 is an intersection point of the curve line formed by the tongue portion 343 and a bisector E32 of a second connection straight line LS32 connecting the terminal winding start portion 341*a*2 and the terminal connection portion 342*f*2. In the section perpendicular to the rotational axis RS of the impeller 2, the second vertex 345 is the intersection point of the curve line formed by the tongue portion 343 and the bisector E32 of the second connection straight line LS32 connecting the terminal winding start portion 341*a*2 and the terminal connection portion 342*f*2. The second connection straight line LS32 and the bisector E32 intersect at a right angle in the section perpendicular to the rotational axis RS of the shaft 2*b*.

A virtual straight line connecting the rotational axis RS of the impeller 2 and the first vertex 344 is defined as a first straight line L31. A virtual straight line connecting the rotational axis RS of the impeller 2 and the second vertex 345 is defined as a second straight line L32. In the centrifugal air-sending device 1C, the first straight line L31 connecting the first vertex 344 and the rotational axis RS is shorter than the second straight line L32 connecting the second vertex 345 and the rotational axis RS in the section perpendicular to the rotational axis RS of the shaft 2*b*. In other words, in the centrifugal air-sending device 1C, the second straight line L32 connecting the second vertex 345 and the rotational axis RS is longer than the first straight line L31 connecting the first vertex 344 and the rotational axis RS in the section perpendicular to the rotational axis RS of the shaft 2*b*. Therefore, the second vertex 345 of the second area portion 343*b* is positioned farther away from the rotational axis RS than is the first vertex 344 of the first area portion 343*a*. Thus, in the section perpendicular to the rotational axis RS of the shaft 2*b*, the space between the impeller 2 and the tongue portion 343 is wider in the second area portion 343*b* than in the first area portion 343*a*. As illustrated in FIG. 24, in the tongue portion 343, the shortest distance between the second vertex 345 and the reference straight line T is longer than the shortest distance between the first vertex 344 and the reference straight line T. Thus, in the section perpendicular to the rotational axis RS of the shaft 2*b*, the space between the impeller 2 and the tongue portion 343 is wider in the second area portion 343*b* than in the first area portion 343*a*.

The centrifugal air-sending device 1C has the following relationship in the section perpendicular to the rotational axis RS of the impeller 2. As illustrated in FIG. 26, in the centrifugal air-sending device 1C, a distance between the central winding start portion 341*a*1 and the impeller 2 on a virtual connection straight line L131 connecting the central winding start portion 341*a*1 and the rotational axis RS is defined as a first distance dB. In the centrifugal air-sending device 1C, a distance between the terminal winding start portion 341*a*2 and the impeller 2 on a virtual connection straight line L132 connecting the terminal winding start portion 341*a*2 and the rotational axis RS is defined as a second distance dA. In the centrifugal air-sending device 1C, a distance between the impeller 2 and the peripheral wall 4*c* extending to the first area portion 343*a* is defined as a first distance dB'. In the centrifugal air-sending device 1C, a distance between the impeller 2 and the peripheral wall 4*c* extending to the second area portion 343*b* is defined as a second distance dA'. In this case, the centrifugal air-sending device 1C has a relationship of second distance dA>first distance dB and a relationship of first distance dB'>second distance dA'.

Figure 27:
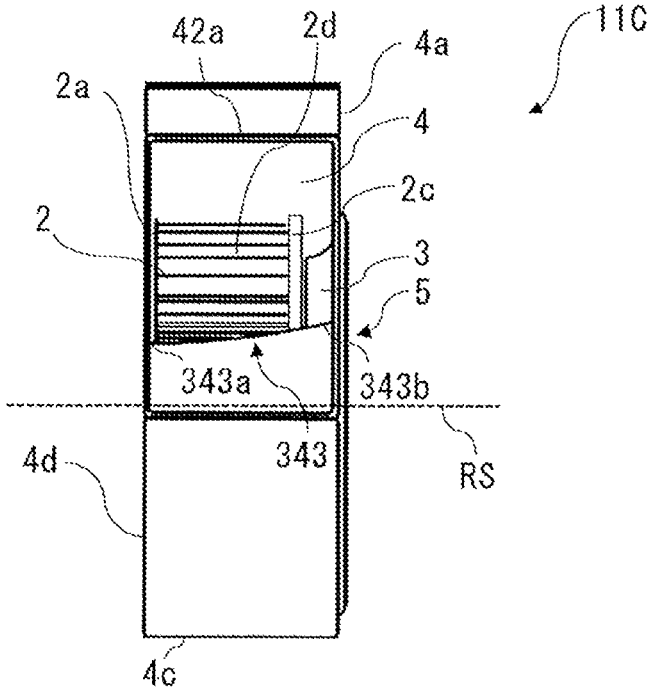
FIG. 27 is a side view of a modified example of the centrifugal air-sending device according to Embodiment 4 of the present disclosure that is viewed from the discharge port.
Figure 28:
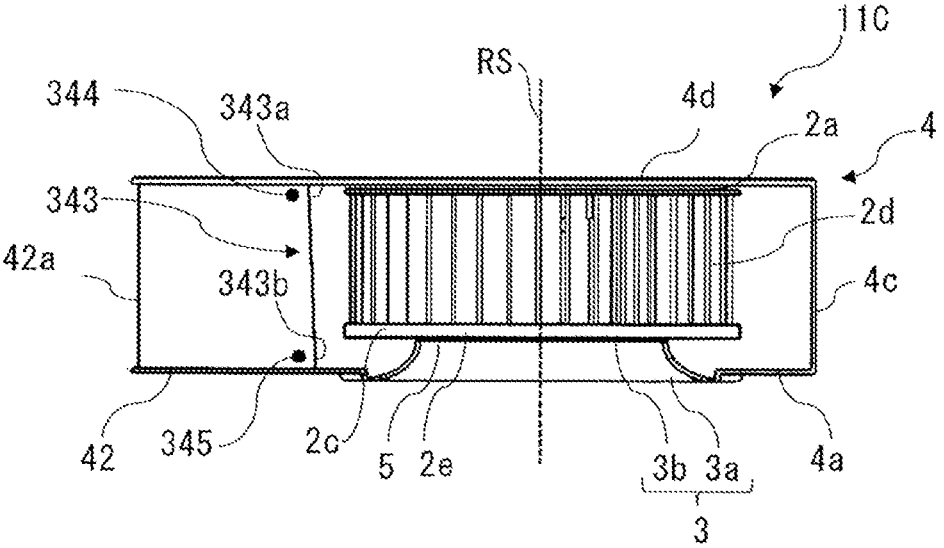
FIG. 28 is a horizontal sectional view of the centrifugal air-sending device of FIG. 27 at the part of the line B-B in FIG. 24.

FIG. 27 is a side view of a modified example of the centrifugal air-sending device 1C according to Embodiment 4 of the present disclosure that is viewed from the discharge port 42*a*. FIG. 28 is a horizontal sectional view of a centrifugal air-sending device 11C of FIG. 27 at the part of the line B-B in FIG. 24. Although the double-suction centrifugal air-sending device 1C is described with reference to FIG. 22 to FIG. 26, the centrifugal air-sending device 1C is not limited to the double-suction centrifugal air-sending device 1C but may be a single-suction centrifugal air-sending device 11C. Thus, the centrifugal air-sending device 11C is only required to have at least one side wall 4*a* having the suction port 5. The scroll portion 41 of the centrifugal air-sending device 11C includes the side wall 4*a* covering the impeller 2 in the axial direction of the rotational axis RS of the shaft 2*b* of the impeller 2, and having the suction port 5 through which air is suctioned, and the peripheral wall 4*c* surrounding the impeller 2 in the radial direction of the rotational axis RS of the shaft 2*b*. The scroll portion 41 of the single-suction centrifugal air-sending device 11C further includes the side wall 4*d* perpendicular to the axial direction of the rotational axis RS. The side wall 4*d* has no suction port 5. The side wall 4*d* and the side wall 4*a* face each other. As illustrated in FIG. 27 and FIG. 28, the plurality of blades 2*d* of the centrifugal air-sending device 11 are provided on one side of the main plate 2*a* in the axial direction of the rotational axis RS of the shaft 2*b*.

The tongue portion 343 includes the first area portion 343*a* facing the main plate 2*a* in the direction parallel to the axial direction of the rotational axis RS of the impeller 2, and the second area portion 343*b* positioned closer to the side wall 4*a* than is the first area portion 343*a*. When the tongue portion 343 is viewed from the discharge port 42*a* as illustrated in FIG. 27, the tongue portion 343 is curved such that the first area portion 343*a* is positioned close to the rotational axis RS of the shaft 2*b*. That is, in the centrifugal air-sending device 1C, when the tongue portion 343 is viewed from the discharge port 42*a*, the first area portion 343*a* facing the main plate 2*a* is positioned closer to the rotational axis RS of the shaft 2*b* than is the second area portion 343*b* connected to the side wall 4*a* having the suction port 5. The tongue portion 343 is formed such that the first area portion 343*a* facing the main plate 2*a* and the second area portion 343*b* connected to the side wall 4*a* having the suction port 5 are disposed on the same curve line when the tongue portion 343 is viewed from the discharge port 42*a*. The first area portion 343*a* is a part of the tongue portion 343 facing the main plate 2*a* of the impeller 2 and positioned close to one end of the tongue portion 343 in the direction parallel to the axial direction of the rotational axis RS of the shaft 2*b*. The second area portion 343*b* is a part of the tongue portion 343 extending to the side wall 4*a* having the suction port 5 and positioned close to the other end of the tongue portion 343 in the direction parallel to the axial direction of the rotational axis RS of the shaft 2*b*. The first area portion 343*a* is a part of the tongue portion 343 positioned closer to the main plate 2*a* than is the second area portion 343*b*. The second area portion 343*b* is a part of the tongue portion 343 positioned closer to the suction port 5 than is the first area portion 343*a*. The second area portion 343*b* may include not only the part of the tongue portion 343 extending to the side wall 4*a* having the suction port 5 but also a part of the tongue portion 343 positioned closer to the side wall 4*a* than to the main plate 2*a* in the direction parallel to the axial direction of the rotational axis RS of the shaft 2*b*.

When the tongue portion 343 is viewed in a direction from the extension plate 42*b* to the diffuser plate 42*c* as illustrated in FIG. 28, the tongue portion 343 is curved such that the first area portion 343*a* is positioned farther away from the rotational axis RS of the impeller 2 than is the second area portion 343*b*. In other words, when the tongue portion 343 is viewed in the direction from the extension plate 42*b* to the diffuser plate 42*c*, the tongue portion 343 is curved such that the second area portion 343*b* is positioned closer to the rotational axis RS of the impeller 2 than is the first area portion 343*a*. That is, the tongue portion 343 is smoothly curved such that the tongue portion 343 is positioned gradually close to the impeller 2 and away from the discharge port 42*a* with increasing distance from the first area portion 343*a* to the second area portion 343*b*. Further, a part of the peripheral wall 4*c* extending to the tongue portion 343 has a shape conforming to the shape of the tongue portion 343. That is, the peripheral wall 4*c* is curved such that the part of the peripheral wall 4*c* is positioned gradually close to the rotational axis RS of the impeller 2 with increasing distance from the main plate 2*a* to the side wall 4*a*. That is, the scroll casing 4 is formed such that the part of the tongue portion 143 positioned closer to the side wall 4*d* and the part of the peripheral wall 4*c* extending to the tongue portion 143 and positioned closer to the side wall 4*d* in the axial direction of the rotational axis RS of the impeller 2 gently bulge from the inner surface of the scroll casing 4. Thus, the peripheral wall 4*c* is curved in a shape conforming to the shape of the tongue portion 343. Compared with the centrifugal air-sending device 11, the centrifugal air-sending device 11C is formed such that the second area portion 343*b* is positioned closer to the extension plate 42*b* than is the first area portion 343*a* and bulges toward the passage at the inflow port 42*g* more than does the first area portion 343*a*.

[Operation of Centrifugal Air-Sending Device 1C]

When the impeller 2 rotates, air outside the scroll casing 4 is suctioned into the scroll casing 4 through the suction ports 5. The air suctioned into the scroll casing 4 is guided by the bell mouths 3 and suctioned into the impeller 2. The air suctioned into the impeller 2 causes an air flow to which a dynamic pressure and a static pressure are applied while the air passes through the plurality of blades 2*d*. The air flow is blown radially outward from the impeller 2. While the air flow blown from the impeller 2 is guided between the inner surface of the peripheral wall 4*c* and the blades 2*d* in the scroll portion 41, the dynamic pressure is converted into a static pressure. After the air flow blown from the impeller 2 passes through the scroll portion 41, the air flow is blown out of the scroll casing 4 from the discharge port 42*a* of the discharge portion 42 (arrow F2). The air flow blown from the impeller 2 concentrates at the main plate 2*a*. Apart of the air flow blown from the main plate 2*a* impinges on the inner surface of the peripheral wall 4*c* of the scroll portion 41 and flows toward the suction ports 5 along the peripheral wall 4*c* of the scroll portion 41. The air flow around the main plate 2*a* and the air flow having flowed toward the suction ports 5 are different in terms of their flow directions. After the air flows are guided between the inner surface of the peripheral wall 4*c* and the blades 2*d* in the scroll portion 41 and pass through the scroll portion 41, a part of the air flows re-enters the scroll portion 41 with the tongue portion 343 as the border (arrow F3).

[Advantageous Effects of Centrifugal Air-Sending Device 1C]

As described above, the tongue portion 343 of the centrifugal air-sending device 1C includes the first area portion 343*a* facing the main plate 2*a* in the direction parallel to the axial direction of the rotational axis RS, and the second area portions 343*b* positioned closer to the respective side walls 4*a* than is the first area portion 343*a*. The first area portion 343*a* has the first vertex 344 in the section perpendicular to the rotational axis RS. The first vertex 344 is the intersection point of the curve line formed by the tongue portion 343 and the bisector E31 of the first connection straight line LS31 connecting the winding start portion 341*a* and the connection portion 342*f*, which is the end of the discharge portion 42. The second area portion 343*b* has the second vertex 345, which is the intersection point of the curve line formed by the tongue portion 343 and the bisector E32 of the second connection straight line LS32 connecting the winding start portion 341*a* and the connection portion 342*f*, which is the end of the discharge portion 42 closer to the peripheral wall 4*c* than is the opposite end. When the virtual straight line connecting the rotational axis RS and the first vertex 344 is defined as the first straight line L31 and the virtual straight line connecting the rotational axis RS and the second vertex 345 is defined as the second straight line L32, the second straight line L32 is longer than the first straight line L31. With this structure of the tongue portion 343, a stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, local pressure fluctuation can be suppressed. Thus, noise can be reduced.

The winding start portion 341*a* is positioned closer to the discharge port 42*a* than is the virtual spiral curve 4*c*1 obtained by extending the curve of the spiral shape in the direction opposite to the air flow direction. With this structure of the centrifugal air-sending device 1C, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

In the centrifugal air-sending device 1C, the angle between the first diffuser portion 42*c*4 and the reference straight line T is defined as the first discharge port angle θ31 and the angle between the second diffuser portion 42*c*5 and the reference straight line T is defined as the second discharge port angle θ32. In this case, the second discharge port angle θ32 is larger than the first discharge port angle θ31. With this structure of the centrifugal air-sending device 1C, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

In the tongue portion 343, the shortest distance between the second vertex 345 and the reference straight line T is longer than the shortest distance between the first vertex 344 and the reference straight line T. With this structure of the centrifugal air-sending device 1C, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

The tongue portion 343 is curved such that the first area portion 343*a* is positioned close to the rotational axis RS when the tongue portion 343 is viewed from the discharge port 42*a*. With this structure of the centrifugal air-sending device 1C, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

The centrifugal air-sending device 1C has the relationship of second distance dA>first distance dB and the relationship of first distance dB'>second distance dA'. With this structure of the tongue portion 343, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

The centrifugal air-sending device 1C has the relationship of second distance dA>first distance dB and the relationship of first distance dB'>second distance dA' and the tongue portion 343 is curved such that the first area portion 343*a* is positioned farther away from the rotational axis RS than are the second area portions 343*b*. With this structure of the centrifugal air-sending device 1C, the stagnation point of air flows at the tongue portion 343 can be shifted depending on the air flow around the main plate 2*a* and the air flow around the suction ports 5 that are different in terms of their flow directions. As a result, it is possible to control, in the centrifugal air-sending device 1C, the amount of the air flow that re-enters the scroll portion 41 with the stagnation point of air flows as the border. Along with this, the local pressure fluctuation can be suppressed. Thus, noise can be reduced.

Embodiment 5

[Air-Sending Apparatus 30]

Figure 29:
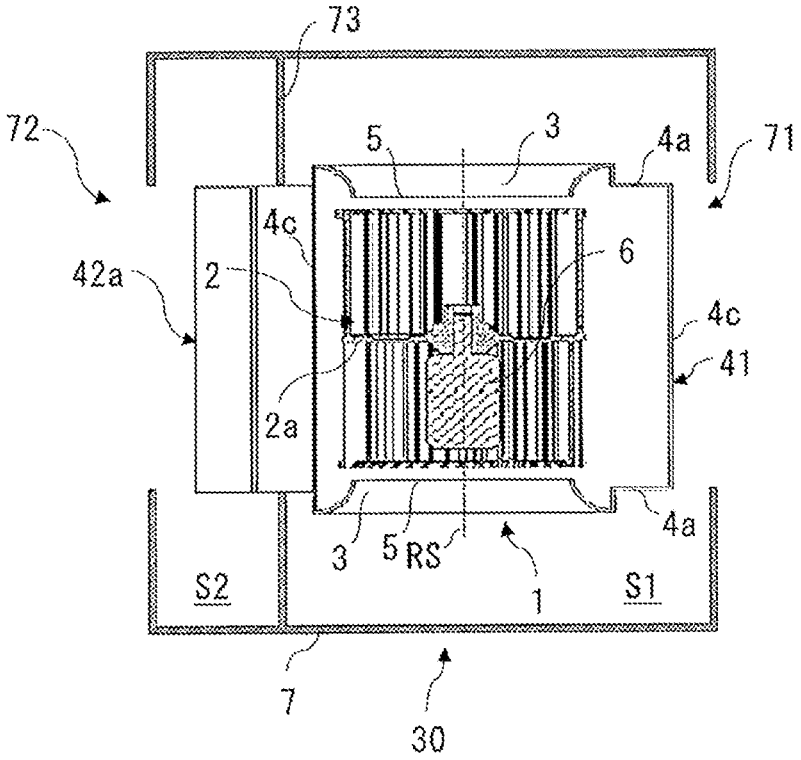
FIG. 29 is a diagram illustrating the structure of an air-sending apparatus according to Embodiment 5 of the present disclosure.

FIG. 29 is a diagram illustrating the structure of an air-sending apparatus 30 according to Embodiment 5 of the present disclosure. Portions having the same structures as those of the centrifugal air-sending device 1 and the other centrifugal air-sending devices of FIG. 1 to FIG. 26 are represented by the same reference signs and description of the portions is omitted. Examples of the air-sending apparatus 30 according to Embodiment 5 include a ventilator and a desk fan. The air-sending apparatus 30 includes the centrifugal air-sending device 1, the centrifugal air-sending device 1A, the centrifugal air-sending device 1B, or the centrifugal air-sending device 1C according to the corresponding one of Embodiments 1 to 4, and a case 7 housing, for example, the centrifugal air-sending device 1. In the following description, the term "centrifugal air-sending device 1" refers to the centrifugal air-sending device 1, the centrifugal air-sending device 1A, the centrifugal air-sending device 1B, or the centrifugal air-sending device 1C according to the corresponding one of Embodiments 1 to 4. The case 7 has two openings, which are a suction port 71 and a discharge port 72. As illustrated in FIG. 29, the suction port 71 and the discharge port 72 of the air-sending apparatus 30 face each other. The suction port 71 and the discharge port 72 of the air-sending apparatus 30 need not essentially face each other. For example, the suction port 71 or the discharge port 72 may be formed above or below the centrifugal air-sending device 1. In the case 7, a space S1 including the suction port 71 and a space S2 including the discharge port 72 are separated from each other by a partition plate 73. The centrifugal air-sending device 1 is installed with the suction ports 5 positioned in the space S1 including the suction port 71 and the discharge port 42*a* positioned in the space S2 including the discharge port 72.

When the impeller 2 is driven to rotate by a motor 6 in the air-sending apparatus 30, air is suctioned into the case 7 through the suction port 71. The air suctioned into the case 7 is guided by the bell mouths 3 and suctioned into the impeller 2. The air suctioned into the impeller 2 is blown radially outward from the impeller 2. After the air blown from the impeller 2 passes through the scroll casing 4, the air is blown from the discharge port 42*a* of the scroll casing 4 and then from the discharge port 72 of the case 7.

As the air-sending apparatus 30 according to Embodiment 5 includes the centrifugal air-sending device 1, the centrifugal air-sending device 1A, the centrifugal air-sending device 1B, or the centrifugal air-sending device 1C according to the corresponding one of Embodiments 1 to 4, noise can be reduced.

Embodiment 6

[Air-Conditioning Apparatus 40]

Figure 30:
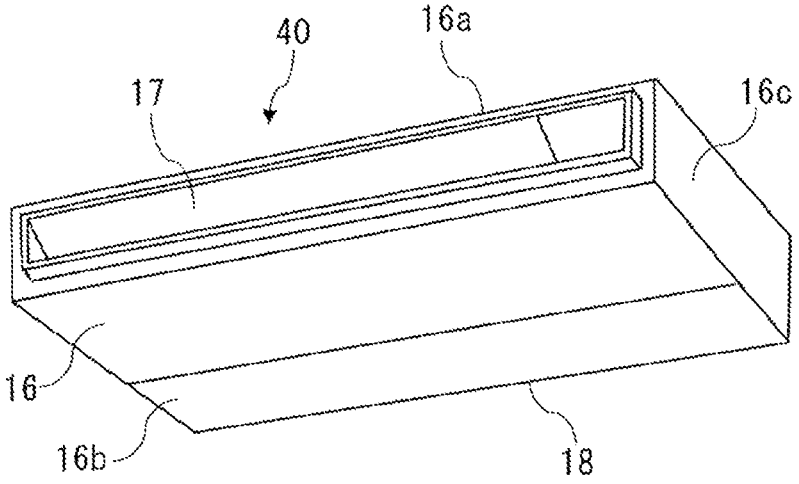
FIG. 30 is a perspective view of an air-conditioning apparatus according to Embodiment 6 of the present disclosure.
Figure 31:
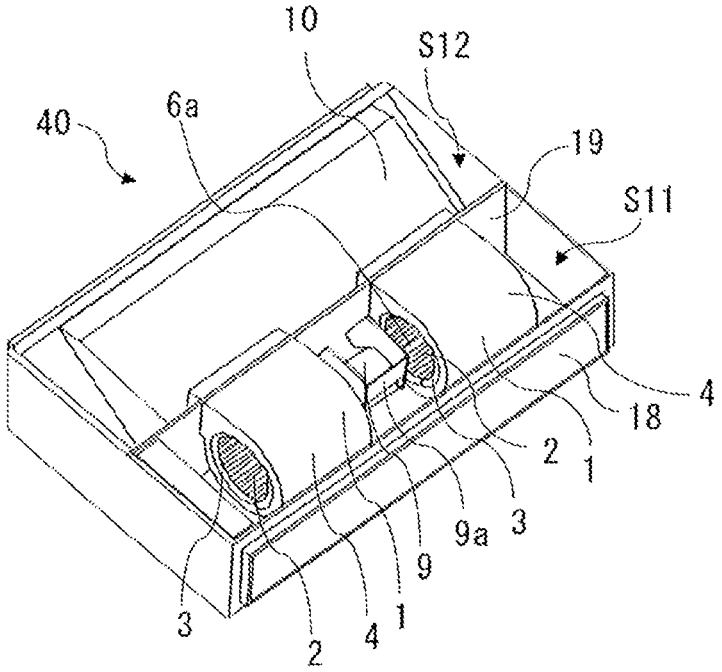
FIG. 31 is a diagram illustrating the internal structure of the air-conditioning apparatus according to Embodiment 6 of the present disclosure.
Figure 32:
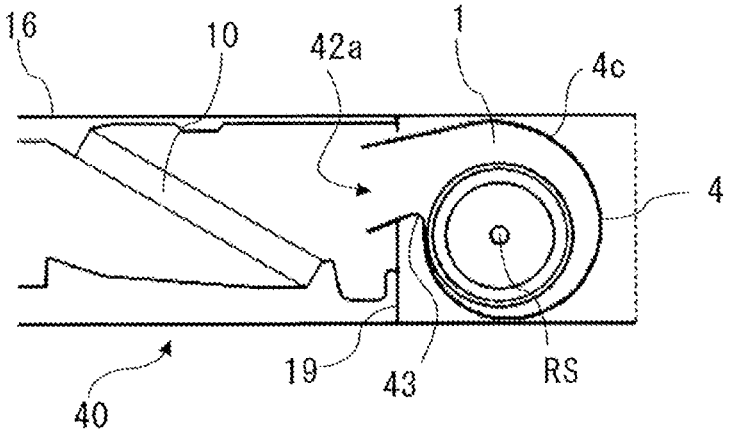
FIG. 32 is a sectional view of the air-conditioning apparatus according to Embodiment 6 of the present disclosure.

FIG. 30 is a perspective view of an air-conditioning apparatus 40 according to Embodiment 6 of the present disclosure. FIG. 31 is a diagram illustrating the internal structure of the air-conditioning apparatus 40 according to Embodiment 6 of the present disclosure. FIG. 32 is a sectional view of the air-conditioning apparatus 40 according to Embodiment 6 of the present disclosure. In each centrifugal air-sending device 1 used in the air-conditioning apparatus 40 according to Embodiment 6, portions having the same structures as those of the centrifugal air-sending device 1 of FIG. 1 to FIG. 29 are represented by the same reference signs and description of the portions is omitted. In FIG. 31, a top portion 16*a* is omitted for illustration of the internal structure of the air-conditioning apparatus 40. The air-conditioning apparatus 40 according to Embodiment 6 includes the centrifugal air-sending device 1, the centrifugal air-sending device 1A, the centrifugal air-sending device 1B, or the centrifugal air-sending device 1C according to the corresponding one of Embodiments 1 to 4, and a heat exchanger 10 facing the discharge port 42*a* of the centrifugal air-sending device 1. The air-conditioning apparatus 40 according to Embodiment 6 further includes a case 16 installed above a ceiling of an air-conditioned room. In the following description, the term "centrifugal air-sending device 1" refers to the centrifugal air-sending device 1, the centrifugal air-sending device 1A, the centrifugal air-sending device 1B, or the centrifugal air-sending device 1C according to the corresponding one of Embodiments 1 to 4.

(Case 16)

As illustrated in FIG. 30, the case 16 has a cubic shape including the top portion 16*a*, a bottom portion 16*b*, and side portions 16*c*. The shape of the case 16 is not limited to the cubic shape but may be, for example, a columnar shape, a prism shape, a conical shape, a shape including a plurality of corners, a shape including a plurality of curves, or other shapes. The case 16 includes a side portion 16*c* having a case discharge port 17 as one of the side portions 16*c*. As illustrated in FIG. 30, the shape of the case discharge port 17 is a rectangular shape. The shape of the case discharge port 17 is not limited to the rectangular shape but may be, for example, a circular shape, an oval shape, or other shapes. The case 16 includes, as one of the side portions 16*c*, a side portion 16*c* having a case suction port 18 that is opposite to the side portion 16*c* having the case discharge port 17. As illustrated in FIG. 31, the shape of the case suction port 18 is a rectangular shape. The shape of the case suction port 18 is not limited to the rectangular shape but may be, for example, a circular shape, an oval shape, or other shapes. A filter may be disposed to the case suction port 18 to remove dust in air.

The case 16 houses two centrifugal air-sending devices 1, a fan motor 9, and the heat exchanger 10. Each centrifugal air-sending device 1 includes an impeller 2 and a scroll casing 4 having a bell mouth 3. The shape of the bell mouth 3 of the centrifugal air-sending device 1 is similar to the shape of the bell mouth 3 of the centrifugal air-sending device 1 of Embodiment 1. The fan motor 9 is supported by a motor support 9*a* fixed to the top portion 16*a* of the case 16. The fan motor 9 includes an output shaft 6*a*. The output shaft 6*a* extends in parallel to the side portion 16*c* having the case suction port 18 and the side portion 16*c* having the case discharge port 17. As illustrated in FIG. 31, the two impellers 2 are attached to the output shaft 6*a* in the air-conditioning apparatus 40. The impeller 2 forms a flow of air suctioned into the case 16 from the case suction port 18 and blown to an air-conditioned space from the case discharge port 17. The number of the centrifugal air-sending devices 1 disposed in the case 16 is not limited to two but may be one, three, or more. When two or more centrifugal air-sending devices 1 are disposed, the centrifugal air-sending devices 1 include one or more centrifugal air-sending devices out of the centrifugal air-sending device 1, the centrifugal air-sending device 1A, the centrifugal air-sending device 1B, and the centrifugal air-sending device 1C according to Embodiments 1 to 4.

As illustrated in FIG. 31, each centrifugal air-sending device 1 is attached to a partition plate 19. The internal space of the case 16 is partitioned by the partition plate 19 into a space S11, which is a suction portion of the scroll casing 4, and a space S12, which is a discharge portion of the scroll casing 4.

As illustrated in FIG. 32, the heat exchanger 10 faces a discharge port 42*a* of each centrifugal air-sending device 1. In the case 16, the heat exchanger 10 is disposed on an air passage of air discharged by the centrifugal air-sending device 1. The heat exchanger 10 adjusts the temperature of air suctioned into the case 16 from the case suction port 18 and to be blown to the air-conditioned space from the case discharge port 17. The heat exchanger 10 may have a publicly known structure.

When the impeller 2 rotates, air in the air-conditioned space is suctioned into the case 16 through the case suction port 18. The air suctioned into the case 16 is guided by the bell mouths 3 and suctioned into the corresponding impellers 2. The air suctioned into each of the impellers 2 is blown radially outward from the impeller 2. After the air blown from the impellers 2 passes through the scroll casing 4, the air is blown from the discharge port 42*a* of the scroll casing 4 and supplied to the heat exchanger 10. The air supplied to the heat exchanger 10 exchanges heat and the temperature and humidity are adjusted while the air passes through the heat exchanger 10. The air passing through the heat exchanger 10 is blown to the air-conditioned space from the case discharge port 17.

As the air-conditioning apparatus 40 according to Embodiment 6 includes the centrifugal air-sending device 1, the centrifugal air-sending device 1A, the centrifugal air-sending device 1B, or the centrifugal air-sending device 1C according to the corresponding one of Embodiments 1 to 4, noise can be reduced.

Embodiment 7

[Refrigeration Cycle Apparatus 50]

Figure 33:
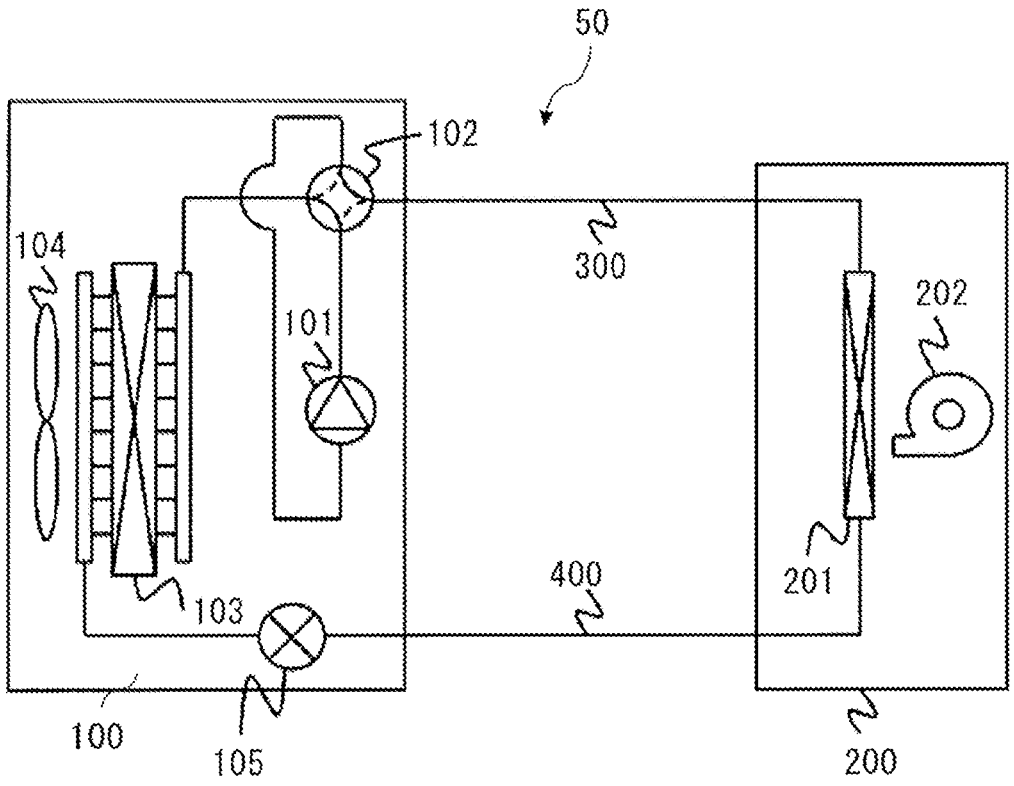
FIG. 33 is a diagram illustrating the structure of a refrigeration cycle apparatus according to Embodiment 7 of the present disclosure.

FIG. 33 is a diagram illustrating the structure of a refrigeration cycle apparatus 50 according to Embodiment 7 of the present disclosure. For example, the centrifugal air-sending device 1, the centrifugal air-sending device 1A, the centrifugal air-sending device 1B, or the centrifugal air-sending device 1C according to the corresponding one of Embodiments 1 to 4 is used for an indoor unit 200 of the refrigeration cycle apparatus 50 according to Embodiment 7. Although the following description is directed to a case where the refrigeration cycle apparatus 50 is used for air conditioning, the purpose of use of the refrigeration cycle apparatus 50 is not limited to air conditioning. For example, the refrigeration cycle apparatus 50 is used for refrigeration or air conditioning as a refrigerator, a freezer, a vending machine, an air-conditioning apparatus, a refrigeration apparatus, or a water heater.

The refrigeration cycle apparatus 50 according to Embodiment 7 transfers heat between outdoor air and indoor air via refrigerant to heat or cool a room, thereby performing air conditioning. The refrigeration cycle apparatus 50 according to Embodiment 7 includes an outdoor unit 100 and the indoor unit 200. In the refrigeration cycle apparatus 50, a refrigerant circuit through which the refrigerant circulates is formed by connecting the outdoor unit 100 and the indoor unit 200 by a refrigerant pipe 300 and a refrigerant pipe 400. The refrigerant pipe 300 is a gas pipe through which refrigerant in a gas phase flows. The refrigerant pipe 400 is a liquid pipe through which refrigerant in a liquid phase flows. Two-phase gas-liquid refrigerant may flow through the refrigerant pipe 400. In the refrigerant circuit of the refrigeration cycle apparatus 50, a compressor 101, a flow switching device 102, an outdoor heat exchanger 103, an expansion valve 105, and an indoor heat exchanger 201 are sequentially connected via refrigerant pipes.

(Outdoor Unit 100)

The outdoor unit 100 includes the compressor 101, the flow switching device 102, the outdoor heat exchanger 103, and the expansion valve 105. The compressor 101 compresses suctioned refrigerant and discharges the compressed refrigerant. The compressor 101 may include an inverter that changes an operation frequency to change the capacity of the compressor 101. The capacity of the compressor 101 is an amount of refrigerant sent out per unit time. Examples of the flow switching device 102 include a four-way valve. The flow switching device 102 changes the direction of a refrigerant passage. The refrigeration cycle apparatus 50 can achieve a heating operation or a cooling operation by changing a flow of refrigerant with the flow switching device 102 in accordance with an instruction from a controller (not illustrated).

The outdoor heat exchanger 103 exchanges heat between refrigerant and outdoor air. During the heating operation, the outdoor heat exchanger 103 is used as an evaporator and exchanges heat between outdoor air and low-pressure refrigerant flowing into the outdoor heat exchanger 103 from the refrigerant pipe 400 to evaporate and gasify the refrigerant. During the cooling operation, the outdoor heat exchanger 103 is used as a condenser and exchanges heat between outdoor air and refrigerant compressed by the compressor 101 and flowing into the outdoor heat exchanger 103 from the flow switching device 102 to condense and liquefy the refrigerant. The outdoor heat exchanger 103 is provided with an outdoor air-sending device 104 to increase the efficiency of the heat exchange between the refrigerant and the outdoor air. The outdoor air-sending device 104 may be provided with an inverter that changes an operation frequency of a fan motor to change the rotation speed of a fan. The expansion valve 105 is an expansion device (flow rate control unit). The flow rate control unit is used as the expansion valve by controlling the flow rate of refrigerant flowing through the expansion valve 105. The expansion valve 105 regulates the pressure of refrigerant by changing its opening degree. For example, if the expansion valve 105 is an electronic expansion valve, the opening degree is adjusted in accordance with an instruction from the controller (not illustrated) or other devices.

(Indoor Unit 200)

The indoor unit 200 includes the indoor heat exchanger 201 exchanges heat between refrigerant and indoor air, and is provided with an indoor air-sending device 202 regulates a flow of air to be subjected to the heat exchange at the indoor heat exchanger 201. During the heating operation, the indoor heat exchanger 201 is used as a condenser and exchanges heat between indoor air and refrigerant flowing into the indoor heat exchanger 201 from the refrigerant pipe 300 to condense and liquefy the refrigerant. Then, the refrigerant flows out of the indoor heat exchanger 201 toward the refrigerant pipe 400. During the cooling operation, the indoor heat exchanger 201 is used as an evaporator and exchanges heat between indoor air and refrigerant having a low pressure through the expansion valve 105 so that the refrigerant removes heat from the air. Thus, the refrigerant is evaporated and gasified and then flows out of the indoor heat exchanger 201 toward the refrigerant pipe 300. The indoor air-sending device 202 faces the indoor heat exchanger 201. The centrifugal air-sending device 1, the centrifugal air-sending device 1A, the centrifugal air-sending device 1B, or the centrifugal air-sending device 1C according to the corresponding one of Embodiments 1 to 4 is applied to the indoor air-sending device 202. The operation speed of the indoor air-sending device 202 is determined by user settings. The indoor air-sending device 202 may be provided with an inverter that changes an operation frequency of the fan motor (not illustrated) to change the rotation speed of the impeller 2.

[Examples of Operation of Refrigeration Cycle Apparatus 50]

Next, the cooling operation is described as an example of the operation of the refrigeration cycle apparatus 50. High-temperature and high-pressure gas refrigerant compressed and discharged by the compressor 101 flows into the outdoor heat exchanger 103 via the flow switching device 102. The gas refrigerant flowing into the outdoor heat exchanger 103 is condensed into low-temperature refrigerant by exchanging heat with outdoor air sent by the outdoor air-sending device 104. The low-temperature refrigerant flows out of the outdoor heat exchanger 103. The refrigerant flowing out of the outdoor heat exchanger 103 is expanded by the expansion valve 105 and the pressure is reduced to turn into low-temperature and low-pressure two-phase gas-liquid refrigerant. The two-phase gas-liquid refrigerant flows into the indoor heat exchanger 201 of the indoor unit 200 and is evaporated into low-temperature and low-pressure gas refrigerant by exchanging heat with indoor air sent by the indoor air-sending device 202. The low-temperature and low-pressure gas refrigerant flows out of the indoor heat exchanger 201. At this time, the indoor air cooled by the refrigerant that removes heat from the indoor air becomes conditioned air (blown air) and is blown into a room (air-conditioned space) from an air outlet of the indoor unit 200. The gas refrigerant flowing out of the indoor heat exchanger 201 is suctioned into the compressor 101 via the flow switching device 102 and is compressed again. The operation described above is repeated.

Next, the heating operation is described as an example of the operation of the refrigeration cycle apparatus 50. High-temperature and high-pressure gas refrigerant compressed and discharged by the compressor 101 flows into the indoor heat exchanger 201 of the indoor unit 200 via the flow switching device 102. The gas refrigerant flowing into the indoor heat exchanger 201 is condensed into low-temperature refrigerant by exchanging heat with indoor air sent by the indoor air-sending device 202. The low-temperature refrigerant flows out of the indoor heat exchanger 201. At this time, the indoor air heated by receiving heat from the gas refrigerant becomes conditioned air (blown air) and is blown into the room (air-conditioned space) from the air outlet of the indoor unit 200. The refrigerant flowing out of the indoor heat exchanger 201 is expanded by the expansion valve 105 and the pressure is reduced to turn into low-temperature and low-pressure two-phase gas-liquid refrigerant. The two-phase gas-liquid refrigerant flows into the outdoor heat exchanger 103 of the outdoor unit 100 and is evaporated into low-temperature and low-pressure gas refrigerant by exchanging heat with outdoor air sent by the outdoor air-sending device 104. The low-temperature and low-pressure gas refrigerant flows out of the outdoor heat exchanger 103. The gas refrigerant flowing out of the outdoor heat exchanger 103 is suctioned into the compressor 101 via the flow switching device 102 and is compressed again. The operation described above is repeated.

As the refrigeration cycle apparatus 50 according to Embodiment 7 includes the centrifugal air-sending device 1, the centrifugal air-sending device 1A, the centrifugal air-sending device 1B, or the centrifugal air-sending device 1C according to the corresponding one of Embodiments 1 to 4, noise can be reduced.

The structures described in Embodiments 1 to 7 are illustrative of examples of the present disclosure and may be combined with other publicly known technologies or partially omitted or modified without departing from the spirit of the present disclosure.

REFERENCE SIGNS LIST

1 centrifugal air-sending device 1A centrifugal air-sending device 1B centrifugal air-sending device 1C centrifugal air-sending device 2 impeller 2*a* main plate 2*a*1 peripheral edge 2*b* shaft 2*c* side plate 2*d* blade 2*e* suction port 3 bell mouth 3*a* upstream end 3*b* downstream end 4 scroll casing 4*a* side wall 4*c* peripheral wall 4*c*1 spiral curve 4*d* side wall 5 suction port 6 motor 6*a* output shaft 7 case 9 fan motor 9*a* motor support 10 heat exchanger 11 centrifugal air-sending device 11A centrifugal air-sending device 11B centrifugal air-sending device 11C centrifugal air-sending device 16 case 16*a* top portion 16*b* bottom portion 16*c* side portion 17 case discharge port 18 case suction port 19 partition plate 30 air-sending apparatus 40 air-conditioning apparatus 41 scroll portion 41*a* winding start portion 41*a*1 central winding start portion 41*a*2 terminal winding start portion 41*b* winding end portion 42 discharge portion 42*a* discharge port 42*b* extension plate 42*c* diffuser plate 42*c*1 discharge portend 42*c*4 first diffuser portion 42*c*5 second diffuser portion 42*d* first side plate 42*e* second side plate 42*f* connection portion 42*f*1 central connection portion 42*f*2 terminal connection portion 42*g* inflow port 43 tongue portion 43*a* first area portion 43*b* second area portion 44 first vertex 45 second vertex 50 refrigeration cycle apparatus 71 suction port 72 discharge port 73 partition plate 100 outdoor unit 101 compressor 102 flow switching device 103 outdoor heat exchanger 104 outdoor air-sending device 105 expansion valve 141*a* winding start portion 141*a*1 central winding start portion 141*a*2 terminal winding start portion 142*f* connection portion 142*f*1 central connection portion 142*f*2 terminal connection portion 143 tongue portion 143*a* first area portion 143*b* second area portion 144 first vertex 145 second vertex 200 indoor unit 201 indoor heat exchanger 202 indoor air-sending device 241*a* winding start portion 241*a*1 central winding start portion 241*a*2 terminal winding start portion 242*f* connection portion 242*f*1 central connection portion 242*f*2 terminal connection portion 243 tongue portion 243*a* first area portion 243*b* second area portion 244 first vertex 245 second vertex 300 refrigerant pipe 341*a* winding start portion 341*a*1 central winding start portion 341*a*2 terminal winding start portion 342*f* connection portion 342*f*1 central connection portion 342*f*2 terminal connection portion 343 tongue portion 343*a* first area portion 343*b* second area portion 344 first vertex 345 second vertex 400 refrigerant pipe

The invention claimed is:

1. A centrifugal air-sending device, comprising:

an impeller including a main plate having a disk shape and a plurality of blades arranged on a peripheral edge of the main plate; and a scroll casing housing the impeller, the scroll casing including a discharge portion including a discharge port through which an air flow produced by the impeller is discharged, and a scroll portion including at least one side wall covering the impeller in a direction perpendicular to an axial direction of a rotational axis of the impeller and including a suction port through which air is suctioned, a peripheral wall surrounding the impeller in a direction parallel to the axial direction of the rotational axis, and a tongue portion forming a curve surface, positioned between an end of the discharge portion and a winding start portion of the peripheral wall, and configured to introduce the air flow produced by the impeller to the discharge port, the tongue portion including a first area portion facing the main plate in the direction parallel to the axial direction of the rotational axis, and a second area portion positioned closer to the at least one side wall than is the first area portion, in a section perpendicular to the rotational axis, where the first area portion has a first vertex that is an intersection point of a curve line formed by the tongue portion and a bisector of a first connection straight line connecting the winding start portion and the end of the discharge portion, the second area portion has a second vertex that is an intersection point of the curve line formed by the tongue portion and a bisector of a second connection straight line connecting the winding start portion and the end of the discharge portion, a virtual straight line connecting the rotational axis and the first vertex is defined as a first straight line, and a virtual straight line connecting the rotational axis and the second vertex is defined as a second straight line, the second straight line being longer than the first straight line, the peripheral wall having a spiral shape in the section perpendicular to the rotational axis, the winding start portion being positioned closer to the discharge port than is a virtual spiral curve obtained by extending a curve of the spiral shape in a direction opposite to a direction of the air flow.

2. The centrifugal air-sending device of claim 1, wherein the discharge portion includes an extension plate extending to the peripheral wall, and a diffuser plate extending to the tongue portion, facing the extension plate, and positioned such that a sectional area of a passage gradually increases along an air flow direction in the discharge portion, wherein the diffuser plate includes a first diffuser portion extending to the first area portion, and a second diffuser portion extending to the second area portion, and wherein, in the section perpendicular to the rotational axis, where a virtual straight line connecting the rotational axis and a discharge port end of the diffuser plate included in the discharge port is defined as a reference straight line, an angle between the first diffuser portion and the reference straight line is defined as a first discharge port angle, and an angle between the second diffuser portion and the reference straight line is defined as a second discharge port angle, the second discharge port angle is larger than the first discharge port angle.

3. The centrifugal air-sending device of claim 2, wherein the second vertex of the tongue portion is positioned closer to the discharge port end than is the first vertex on a line between the rotational axis and the discharge port end on the reference straight line.

4. The centrifugal air-sending device of claim 2, wherein, in the tongue portion, a shortest distance between the second vertex and the reference straight line is longer than a shortest distance between the first vertex and the reference straight line.

5. The centrifugal air-sending device of claim 1, wherein the tongue portion is curved such that the first area portion is positioned close to the rotational axis when the tongue portion is viewed from the discharge port.

6. The centrifugal air-sending device of claim 1, wherein the tongue portion is curved such that the second area portion is positioned farther away from the rotational axis than is the first area portion.

7. The centrifugal air-sending device of claim 1, wherein, in the section perpendicular to the rotational axis, where a distance between the winding start portion of the first area portion and the impeller on a virtual connection straight line connecting the winding start portion of the first area portion and the rotational axis is defined as a first distance dB, a distance between the winding start portion of the second area portion and the impeller on a virtual connection straight line connecting the winding start portion of the second area portion and the rotational axis is defined as a second distance dA, a distance between the impeller and the peripheral wall extending to the first area portion is defined as a first distance dB', and a distance between the impeller and the peripheral wall extending to the second area portion is defined as a second distance dA', the centrifugal air-sending device has a relationship of second distance dA>first distance dB and a relationship of first distance dB'>second distance dA'.

8. The centrifugal air-sending device of claim 7, wherein the tongue portion is curved such that the first area portion is positioned farther away from the rotational axis than is the second area portion.

9. The centrifugal air-sending device of claim 6, wherein the peripheral wall is curved in a shape conforming to a shape of the tongue portion.

10. The centrifugal air-sending device of claim 1, wherein the scroll portion includes one side wall as the at least one side wall.

11. The centrifugal air-sending device of claim 1,
wherein the scroll portion includes two side walls as the at least one side wall, and
wherein the two side walls face each other.

12. An air-sending apparatus, comprising:
the centrifugal air-sending device of claim 1; and
a case housing the centrifugal air-sending device.

13. An air-conditioning apparatus, comprising:
the centrifugal air-sending device of claim 1; and
a heat exchanger facing the discharge port of the centrifugal air-sending device.

14. A refrigeration cycle apparatus, comprising the centrifugal air-sending device of claim 1.

15. A centrifugal air-sending device, comprising:
an impeller including a main plate having a disk shape and a plurality of blades arranged on a peripheral edge of the main plate; and
a scroll casing housing the impeller,
the scroll casing including
a discharge portion including a discharge port through which an air flow produced by the impeller is discharged, and
a scroll portion including
at least one side wall covering the impeller in a direction perpendicular to an axial direction of a rotational axis of the impeller and including a suction port through which air is suctioned,
a peripheral wall surrounding the impeller in a direction parallel to the axial direction of the rotational axis, and
a tongue portion forming a curve surface, positioned between an end of the discharge portion and a winding start portion of the peripheral wall, and configured to introduce the air flow produced by the impeller to the discharge port,
the tongue portion including
a first area portion facing the main plate in the direction parallel to the axial direction of the rotational axis, and
a second area portion positioned closer to the at least one side wall than is the first area portion,
in a section perpendicular to the rotational axis,
where the first area portion has a first vertex that is an intersection point of a curve line formed by the tongue portion and a bisector of a first connection straight line connecting the winding start portion and the end of the discharge portion,
the second area portion has a second vertex that is an intersection point of the curve line formed by the tongue portion and a bisector of a second connection straight line connecting the winding start portion and the end of the discharge portion,
a virtual straight line connecting the rotational axis and the first vertex is defined as a first straight line, and
a virtual straight line connecting the rotational axis and the second vertex is defined as a second straight line,
the second straight line being longer than the first straight line,
the discharge portion including
an extension plate extending to the peripheral wall, and
a diffuser plate extending to the tongue portion, facing the extension plate, and positioned such that a sectional area of a passage gradually increases along an air flow direction in the discharge portion,
where a virtual straight line connecting the rotational axis and a discharge port end of the diffuser plate included in the discharge port is defined as a reference straight line,
a shortest distance between the second vertex and the reference straight line being longer than a shortest distance between the first vertex and the reference straight line.

16. A centrifugal air-sending device, comprising:
an impeller including a main plate having a disk shape and a plurality of blades arranged on a peripheral edge of the main plate; and
a double-suction scroll casing housing the impeller,
the double-suction scroll casing including
a discharge portion including a discharge port through which an air flow produced by the impeller is discharged, and
a scroll portion including
at least one side wall covering the impeller in a direction perpendicular to an axial direction of a rotational axis of the impeller and including a suction port through which air is suctioned,
a peripheral wall surrounding the impeller in a direction parallel to the axial direction of the rotational axis, and
a tongue portion forming a curve surface, positioned between an end of the discharge portion and a winding start portion of the peripheral wall, and configured to introduce the air flow produced by the impeller to the discharge port,
the tongue portion including
a first area portion facing the main plate in the direction parallel to the axial direction of the rotational axis, and
a second area portion positioned closer to the at least one side wall than is the first area portion,
in a section perpendicular to the rotational axis,
where the first area portion has a first vertex that is an intersection point of a curve line formed by the tongue portion and a bisector of a first connection straight line connecting the winding start portion and the end of the discharge portion,
the second area portion has a second vertex that is an intersection point of the curve line formed by the tongue portion and a bisector of a second connection straight line connecting the winding start portion and the end of the discharge portion,
a virtual straight line connecting the rotational axis and the first vertex is defined as a first straight line, and
a virtual straight line connecting the rotational axis and the second vertex is defined as a second straight line,
the second straight line being longer than the first straight line.

17. A centrifugal air-sending device, comprising:
an impeller including a main plate having a disk shape and a plurality of blades arranged on a peripheral edge of the main plate; and
a scroll casing housing the impeller,
the scroll casing including
a discharge portion including a discharge port through which an air flow produced by the impeller is discharged, and
a scroll portion including
at least one side wall covering the impeller in a direction perpendicular to an axial direction of a rotational axis of the impeller and including a suction port through which air is suctioned,
a peripheral wall surrounding the impeller in a direction parallel to the axial direction of the rotational axis, and
a tongue portion forming a curve surface, positioned between an end of the discharge portion and a winding start portion of the peripheral wall, and configured to introduce the air flow produced by the impeller to the discharge port, the tongue portion including a first area portion facing the main plate in the direction parallel to the axial direction of the rotational axis, and a second area portion positioned closer to the at least one side wall than is the first area portion, in a section perpendicular to the rotational axis, where the first area portion has a first vertex that is an intersection point of a curve line formed by the tongue portion and a bisector of a first connection straight line connecting the winding start portion and the end of the discharge portion, the second area portion has a second vertex that is an intersection point of the curve line formed by the tongue portion and a bisector of a second connection straight line connecting the winding start portion and the end of the discharge portion, a virtual straight line connecting the rotational axis and the first vertex is defined as a first straight line, and a virtual straight line connecting the rotational axis and the second vertex is defined as a second straight line, the second straight line being longer than the first straight line, the tongue portion being curved such that the first area portion is positioned close to the rotational axis when the tongue portion is viewed from the discharge port.

18. A centrifugal air-sending device, comprising:

an impeller including a main plate having a disk shape and a plurality of blades arranged on a peripheral edge of the main plate; and a scroll casing housing the impeller, the scroll casing including a discharge portion including a discharge port through which an air flow produced by the impeller is discharged, and a scroll portion including at least one side wall covering the impeller in a direction perpendicular to an axial direction of a rotational axis of the impeller and including a suction port through which air is suctioned, a peripheral wall surrounding the impeller in a direction parallel to the axial direction of the rotational axis, and a tongue portion forming a curve surface, positioned between an end of the discharge portion and a winding start portion of the peripheral wall, and configured to introduce the air flow produced by the impeller to the discharge port, the tongue portion including a first area portion facing the main plate in the direction parallel to the axial direction of the rotational axis, and a second area portion positioned closer to the at least one side wall than is the first area portion, in a section perpendicular to the rotational axis, where the first area portion has a first vertex that is an intersection point of a curve line formed by the tongue portion and a bisector of a first connection straight line connecting the winding start portion and the end of the discharge portion, the second area portion has a second vertex that is an intersection point of the curve line formed by the tongue portion and a bisector of a second connection straight line connecting the winding start portion and the end of the discharge portion, a virtual straight line connecting the rotational axis and the first vertex is defined as a first straight line, and a virtual straight line connecting the rotational axis and the second vertex is defined as a second straight line, the second straight line being longer than the first straight line, the tongue portion being curved such that the second area portion is positioned farther away from the rotational axis than is the first area portion.

19. A centrifugal air-sending device, comprising:

an impeller including a main plate having a disk shape and a plurality of blades arranged on a peripheral edge of the main plate; and a scroll casing housing the impeller, the scroll casing including a discharge portion including a discharge port through which an air flow produced by the impeller is discharged, and a scroll portion including at least one side wall covering the impeller in a direction perpendicular to an axial direction of a rotational axis of the impeller and including a suction port through which air is suctioned, a peripheral wall surrounding the impeller in a direction parallel to the axial direction of the rotational axis, and a tongue portion forming a curve surface, positioned between an end of the discharge portion and a winding start portion of the peripheral wall, and configured to introduce the air flow produced by the impeller to the discharge port, the tongue portion including a first area portion facing the main plate in the direction parallel to the axial direction of the rotational axis, and a second area portion positioned closer to the at least one side wall than is the first area portion, in a section perpendicular to the rotational axis, where the first area portion has a first vertex that is an intersection point of a curve line formed by the tongue portion and a bisector of a first connection straight line connecting the winding start portion and the end of the discharge portion, the second area portion has a second vertex that is an intersection point of the curve line formed by the tongue portion and a bisector of a second connection straight line connecting the winding start portion and the end of the discharge portion, a virtual straight line connecting the rotational axis and the first vertex is defined as a first straight line, and a virtual straight line connecting the rotational axis and the second vertex is defined as a second straight line, the second straight line being longer than the first straight line, in the section perpendicular to the rotational axis, where a distance between the winding start portion of the first area portion and the impeller on a virtual connection straight line connecting the winding start portion of the first area portion and the rotational axis is defined as a first distance dB, a distance between the winding start portion of the second area portion and the impeller on a virtual connection straight line connecting the winding start portion of the second area portion and the rotational axis is defined as a second distance dA, a distance between the impeller and the peripheral wall extending to the first area portion is defined as a first distance dB', and a distance between the impeller and the peripheral wall extending to the second area portion is defined as a second distance dA', the centrifugal air-sending device having a relationship of second distance dA>first distance dB and a relationship of first distance dB'>second distance dA'.

* * * * *